US006544098B1

(12) United States Patent
Hampton et al.

(10) Patent No.: US 6,544,098 B1
(45) **Date of Patent: *Apr. 8, 2003**

(54) INTERACTIVE TOY

(75) Inventors: David Mark Hampton, Nevada City, CA (US); Caleb Chung, Boise, ID (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/425,773

(22) Filed: Oct. 22, 1999

Related U.S. Application Data

(62) Division of application No. 09/211,101, filed on Dec. 15, 1998, now Pat. No. 6,149,490.

(51) Int. Cl.[7] ..... A63H 3/28
(52) U.S. Cl. ..... 446/301; 446/353; 446/298
(58) Field of Search ..... 446/301, 298, 446/299, 300, 303, 330, 337, 352, 353, 354, 175

(56) References Cited

U.S. PATENT DOCUMENTS

| | | | |
|---|---|---|---|
| 3,638,351 | A | 2/1972 | Kosicki et al. |
| 3,755,960 | A | 9/1973 | Tepper et al. |
| 3,912,694 | A | 10/1975 | Chiappe et al. |
| 4,139,968 | A | 2/1979 | Milner |
| 4,221,927 | A | 9/1980 | Dankman et al. |
| 4,245,430 | A | 1/1981 | Hoyt |
| 4,249,338 | A | 2/1981 | Wexler |
| 4,267,606 | A | 5/1981 | Stelter et al. |
| 4,318,245 | A | 3/1982 | Stowell et al. |
| 4,375,106 | A | 2/1983 | Voll |
| 4,439,161 | A | 3/1984 | Wiggins et al. |
| 4,451,911 | A | 5/1984 | Klose et al. |
| 4,516,950 | A | 5/1985 | Berman et al. |
| 4,591,248 | A | 5/1986 | Freeman |
| 4,654,659 | A | 3/1987 | Kubo |
| 4,659,919 | A | 4/1987 | Price |

(List continued on next page.)

FOREIGN PATENT DOCUMENTS

| | | | |
|---|---|---|---|
| DE | 33 45 978 | A1 | 6/1985 |
| GB | 2 256 598 | A | 12/1992 |
| WO | WO 9603190 | A1 | 2/1996 |
| WO | WO 97/41936 | | 11/1997 |

*Primary Examiner*—Derris H. Banks
*Assistant Examiner*—Ali Abdelwahed
(74) *Attorney, Agent, or Firm*—Michael, Best & Friedrich, LLC

(57) ABSTRACT

A very compact interactive toy is provided that provides highly life-like and intelligent seeming interaction with the user thereof. The toy can take the form of a small animal-like creature having a variety of moving body parts that have very precisely controlled and coordinated movements thereof so as to provide the toy with life-like mannerisms. The toy utilizes sensors for detecting sensory inputs which dictate the movements of the body parts in response to the sensed inputs. The sensors also allow several of the toys to interact with each other. The body parts are driven for movement by a single motor which is relatively small in terms of its power requirements given the large number of different movements that it powers. In addition, the motor is reversible so that the body parts can be moved in a non-cyclic life-like manner. For space conservation, a cam operating mechanism is provided that is very compact with the cam mechanisms for the parts all operated off of a single small control shaft of the cam operating mechanism, e.g. approximately one inch in length, driven for rotation by the single, low power motor.

7 Claims, 42 Drawing Sheets

Microfiche Appendix Included
(4 Microfiche, 297 Pages)

U.S. PATENT DOCUMENTS 4,673,371 A 6/1987 Furukawa
4,675,519 A 6/1987 Price
4,696,653 A 9/1987 McKeefery
4,717,364 A 1/1988 Furukawa
4,740,186 A 4/1988 Sirota
4,754,133 A 6/1988 Bleich
4,799,171 A 1/1989 Cummings
4,802,879 A 2/1989 Rissman et al.
4,809,335 A 2/1989 Rumsey
4,840,602 A 6/1989 Rose
4,850,930 A 7/1989 Sato et al.
4,857,030 A 8/1989 Rose
4,864,607 A 9/1989 Mitamura et al.
4,900,289 A 2/1990 May et al.
4,923,428 A 5/1990 Curran
4,949,327 A 8/1990 Forsse et al.
5,011,449 A 4/1991 Handy et al.
5,267,886 A 12/1993 Wood et al.
5,279,514 A 1/1994 Lacombe et al.
5,281,180 A 1/1994 Lam et al.
5,288,069 A 2/1994 Matsumoto
5,324,225 A 6/1994 Satoh et al.
5,375,839 A 12/1994 Pagani
5,376,038 A 12/1994 Arad et al.
5,468,172 A 11/1995 Basile
5,471,192 A 11/1995 Dash
5,636,994 A 6/1997 Tong
5,700,178 A 12/1997 Cimerman et al.
5,816,885 A 10/1998 Goldman et al.
6,110,000 A * 8/2000 Ting ..... 446/302
6,149,490 A * 11/2000 Hampton et al.
6,309,275 B1 * 10/2001 Fong et al. ..... 446/297

* cited by examiner

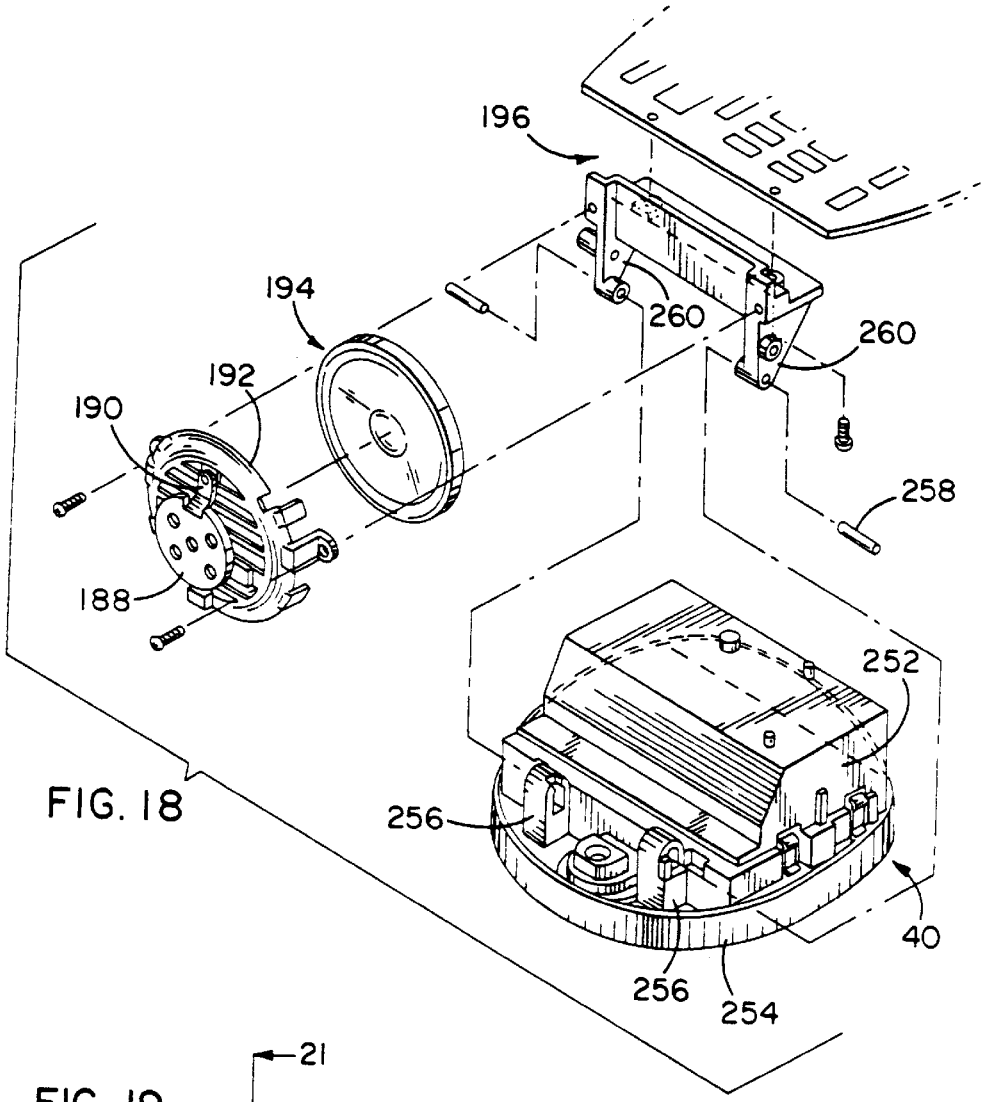
FIG. 18
FIG. 19
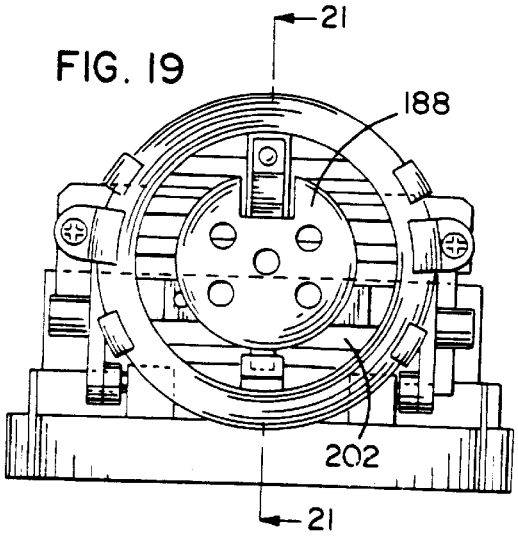
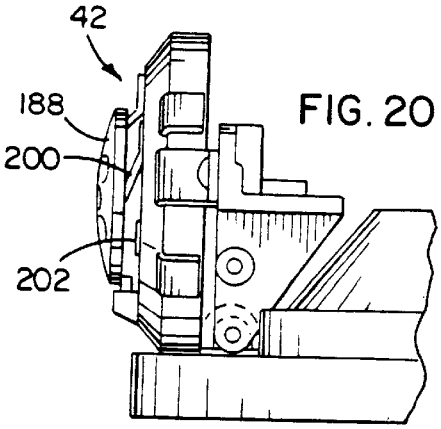
FIG. 20

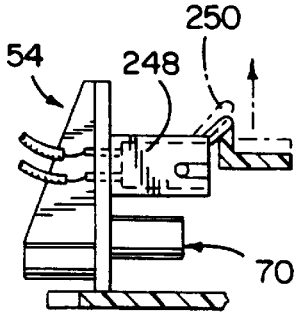
FIG. 29
FIG. 30
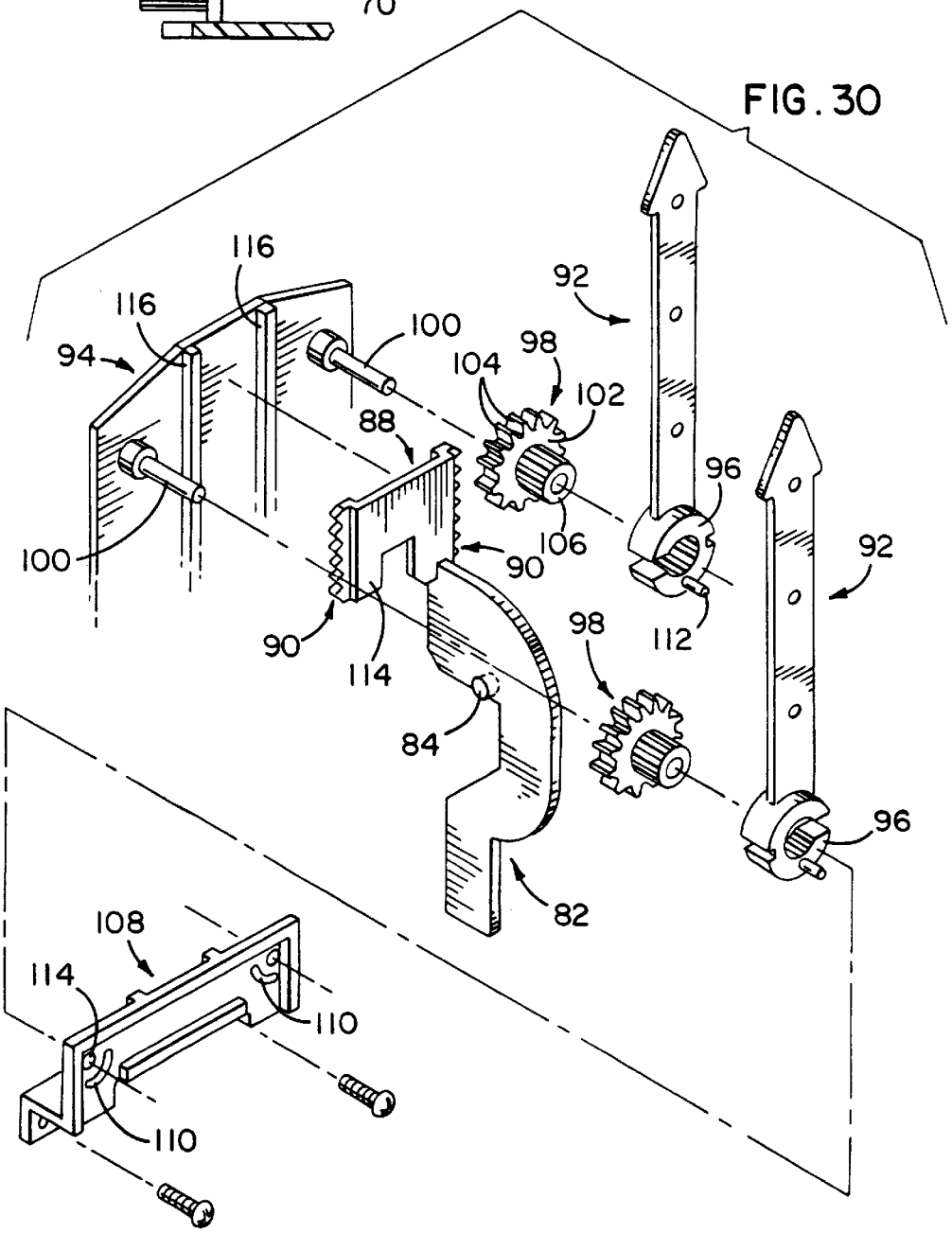

FIG. 37
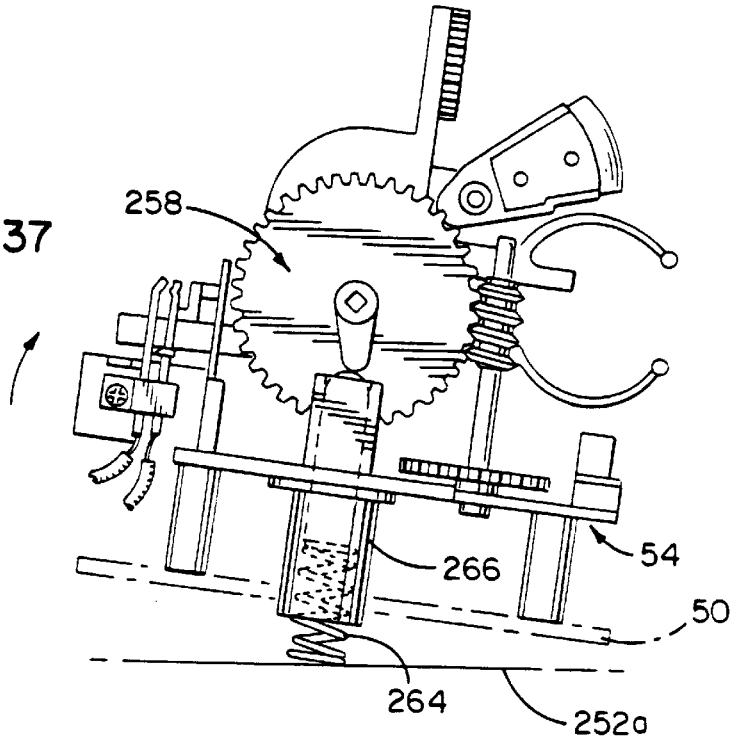
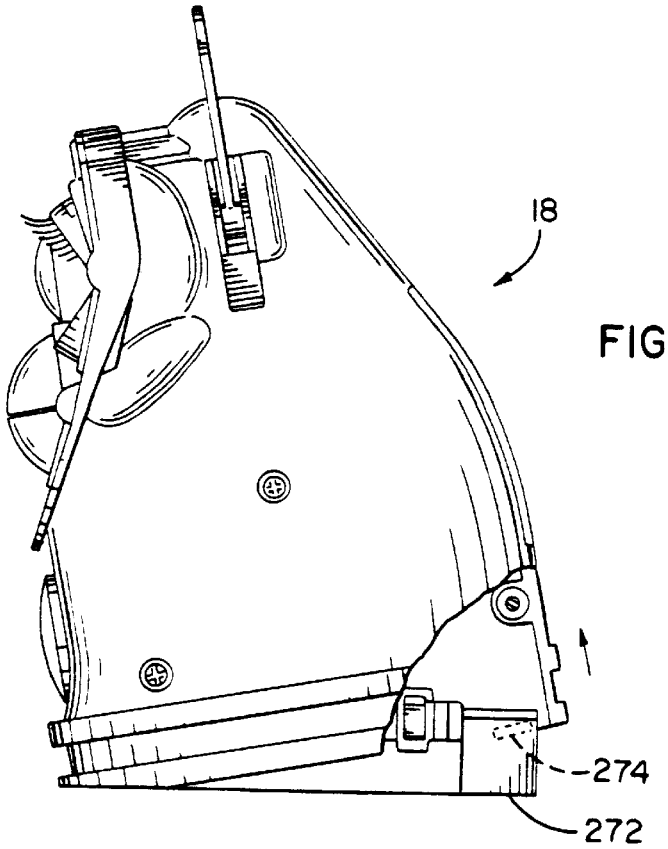
FIG. 38

1004
1040
C6
100UF
D2
EL-IL7
R8,10
R9
43
1044
Q1
9012G
BATT
1046
D1
IN4148
1048
C5
IUF
R10
100
IR-TX

1006
C7
.IUF
OSC I
/INIT
1050
VDD
T150C04
VSS
PA0
PA1
PA2
PA3
PA4
PA5
PA6
PA7
PB0
PB1/IRQ
DA1
DA2
VBATT
D0
D1
D2
D3
CTS
RTS
IR-TX
R12
4.7K
LS1
32OHM
RESET
1052

1010
D3 NORMAL LOW
GND
U4D
LM324
1084
1088
R23
2.2M
1090
C14
.1UF
D4
IN4148
1086
R24
4.7M
1092
1080
C16
.01UF
1082
R26
270K
1074
C17
.0033UF
R25
100K
U4C
LM324
1072
1076
1078
C15
.1UF
R22
4.7K
VCC
1068
VG
1070
HDRI
MIC

1012
COUNT
1108
R29
10K
U5C
74HC14
1106
U5A
74HC14
1104
ST-23G
Q5
R27
4.7K
1100
1102
1098
$V_{BATT}$
EL-IL7
D5
R28
1K
1096
U5B
74HC14
1094
LED

INTERACTIVE TOY

CROSS REFERENCE TO RELATED APPLICATION

This application is a division of prior application Ser. No. 09/211,101, filed Dec. 15, 1998, now U.S. Pat No. 6,149,490, which is hereby incorporated by reference.

MICROFICHE APPENDIX

This application includes, pursuant to 37 C.F.R. §§1.77 (c)(2), 1.96(b), a microfiche appendix consisting of four (4) sheets of microfiche containing 297 frames of a program listing embodying the present invention.

FIELD OF THE INVENTION

The present invention relates to interactive toys and, more particularly, to a very compact interactive toy that can perform movements with body parts thereof in a precisely controlled and coordinated manner in response to external sensed conditions.

BACKGROUND OF THE INVENTION

One major challenge with toys in general is keeping a child interested in playing with the toy for more than a short period of time. To this end, toy dolls and animals have been developed that can talk and/or have moving body parts. The goal with these devices is to provide a plaything that appears to interact with the child when they play with the toy.

One serious drawback in prior art toys that attempted to provide life-like interaction for the child is the increased cost associated with the various components needed to simulate the functions necessary to provide the toy with life-like mannerisms. In this regard, the size of the toy also is an issue as it is generally true that the more the toy can do in terms of simulating life-like actions and speech, the greater the size of the toy to accommodate the electronics and mechanical linkages and motors utilized therein. Furthermore, and especially in regard to the mechanical construction thereof, the greater number of moving body parts and associated linkages and the greater number of motors also increases the likelihood of failures such as due to impacts. Such failures are unacceptable for children's toys as they are prone to being dropped and knocked around, and thus must be reliable in terms of their ability to withstand impacts and pass drop tests to which they may be subjected. In addition, the use of several motors and associated linkages drives up the cost of the toy which is undesirable for high volume retail sales thereof. Accordingly, there is a need for an interactive toy that provides life-like interaction with the user that is of a compact size and which is reasonably priced for retail sale.

In addition to the above noted problems, another significant shortcoming with prior art toys is that even in those toys that include a lot of different moving part and significant electronics incorporated therewith, the movement of the parts tends to be less than life-like. More particularly, many prior interactive toys utilize a single direction motor that drives a control shaft or shafts and/or cams for rotation in one direction so that the movement of the parts controlled thereby repeat over and over to produce a cyclical action thereof. As is apparent, cyclical movement of toy parts does not produce part motions that appear to be life-like and consequently a child's interest in the toy can wane very rapidly once they pick up on the predictable nature of the movement of the toy parts.

Thus, where prior art interactive toys have several moving parts, the life-like action attributed to these moving parts is due to the random nature of their movements with respect to each other as the individual parts tend to move in a predictable cyclic action; in other words, there is no control over the motion of a specific part individually on command in prior toys, and highly controlled coordination of one part with the movement of other parts is generally not done. For example, in a toy that has blinking eyes, cams can be used to cause the blinking. However, the blinking action does not occur in a precise, controlled manner, and instead occurs cyclically with the timing of the occurrence of the blink not being of significance in terms of the cam design. As would be expected, the focus of the design of the cams for parts such as the above-described blinking eyes is to simply make sure that all the parts that are moved thereby undergo the proper range of motion when the cam is driven. Thus, there is a need for an interactive toy that provides for more precisely controlled and coordinated movements between its various moving parts and allows for individual parts to be moved in a more realistic manner over the cyclic movement provided for parts in prior toys.

SUMMARY OF THE INVENTION

In accordance with the present invention, a very compact interactive toy is provided that provides highly life-like and intelligent seeming interaction with the user thereof. The toy can take the form of a small animal-like creature having a variety of moving body parts that have very precisely controlled and coordinated movements thereof so as to provide the toy with life-like mannerisms. The toy utilizes sensors for detecting sensory inputs which dictate the movements of the body parts in response to the sensed inputs. The sensors also allow several of the toys to interact with each other, as will be described more fully hereinafter. The body parts are driven by a single motor which is relatively small in terms of its power requirements given the large number of different movements that it powers. In addition, the motor is reversible so that the body parts can be moved in a non-cyclic life-like manner.

More particularly, the drive system that powers the movement of the toy body parts, e.g. eye, mouth, ear and foot assemblies, in addition to the single small electric motor includes a single control shaft that mounts cam mechanisms associated with each body part for causing movement thereof when the motor is activated. The cam mechanisms include programmed cam surfaces so as to provide the body parts with precisely controlled movements. The programmed cam surfaces include active portions for generating the full range of movement of the associated body parts. Thus, when the motor is activated by the controller, it can cause the cam mechanisms to traverse the active portions of their cam surfaces for movement of the associated body parts. Every position on the programmed cam surfaces is significant to the controller in terms of causing the appropriate and desired movement of the body parts in response to the detected input from the toy sensors.

Further, because the motor is reversible, the control shaft can be rotated so as to cause a specific cam mechanism to traverse its programmed cam surface active portion and then cause back and forth rotations of the shaft for corresponding back and forth movements of the associated body part such as blinking of the eyes and/or opening and closing of the mouth and/or raising or lowering of the ears. In this manner, the body parts can be provided with a non-cyclic movement for making the toy to appear to be more life-like than prior toys that simply had unidirectional rotating shafts for cams of body parts which created repetitive and predictable motion thereof. In these prior toys that simply utilize a single directional motor for driving shafts and cams for repetitive cycling of body parts, the importance of the cam surfaces are minimized. On the other hand, in the present invention the cams have surfaces that are programmed for very precise and controlled movements of the body parts in particular ranges of shaft movements such that generally every point on a particular cam surface has meaning to the controller in terms of what type of movement the body part is undergoing and where it needs to be for its subsequent movement, or for when the body part is to remain stationary. In this manner, the controller can coordinate movements of the body parts to provide the toy with different states such as sleeping, waking or excited states. Further, the controller is provided with sound generating circuitry for generating words that complement the different states such as snoring in the sleeping state or various exclamations in the excited state.

As previously stated, the motor preferably is a very small, low power electric motor that is effective to drive all the different body parts of the toy for all of their movements while keeping the toy economical and minimizing its power requirements to provide acceptable battery life for the toy. Nevertheless, the small, low cost motor utilized with the toy herein still has to be precision controlled in terms of the position of the control shaft which rotates the cams of the body parts. In this regard, the present invention employs an optical counter assembly which counts intervals of the revolutions of an apertured gear wheel with the use of standard types of IR transmitters and receivers on either side thereof that are small components fixed in housings rigidly mounted inside the toy.

This is in contrast to closed-loop type servomotors that utilize a resistance potentiometer as a feedback sensor. The potentiometer wiper arm is a movable part that creates frictional resistance to motor shaft rotation. As such, the present optical counting assembly is advantageous in comparison thereto due to lesser power requirements as there is no frictional resistance created thereby. And further, the optical counting assembly is better able to withstand drop tests as the parts are all stationary and rigidly mounted in the toy versus the movable wiper arm.

In addition, the use of a single motor and single control shaft for operating all the cam mechanisms associated with each of the body parts allows the toy to be very compact and relatively inexpensive when considering the high degree of interactivity with the user that it provides. As there is only a single control shaft, a single small, reversible motor can be utilized. Further, the programmed surfaces of the cam mechanisms are preferably provided on the walls of slots with the cam mechanisms including followers that ride in the slots and that are unbiased such as by springs or the like to any particular position in the slots, such as found in prior toys. In this manner, there is no biasing force which the motor must overcome to provide the camming action between the follower and the slot walls thereby lessening power requirements for the motor and allowing a smaller motor to be utilized.

The toy also preferably includes a lower pivotal foot portion similarly operated by a cam mechanism off of the control shaft. The pivotal foot portion allows the toy to rock back and forth to give the appearance of dancing such as if this motion is caused to be repetitive. As previously discussed, the toy includes sensors, e.g. IR transmitters and receivers, for allowing communication between the toys. For instance, if several of the toys are placed in close proximity, and one detects a sensory input that the controller interprets as instructions to make the toy dance, e.g. four loud, sharp sounds in succession, the motor of the toy will be activated so that cam of the foot portion will be rotated by the control shaft to cause repetitive pivoting of the foot portion, or dancing of the toy. This toy will then signal the other proximate toys via the IR link to begin to dance. Other types of toy-toy interactions are also possible, e.g. conversations between toys, transmitting sickness apparent by sneezing between toys.

The toy herein is also capable of playing games with the user in a highly interactive and intelligent seeming manner. These games are implemented by specific predetermined inputs to the toy by the user that the toy can sense such as a predetermined pattern of the same action done a predetermined number of times or different actions in a specific sequence in response to output from the toy. For example, the toy can be taught to do tricks. Initially, a predetermined trick initiating sensor can be actuated to shift the toy into its trick learning mode. To teach it tricks, the same or another predetermined sensor can be actuated a predetermined number of times when the specific toy output, e.g. a predetermined sound such as a kiss, is generated by the toy. Thereafter, every time the trick initiating sensor is actuated for the trick learning mode and the toy generates the output that is desired to be taught, the same predetermined sensor must be actuated by the user the predetermined number of times which will thereby "teach" the toy to generate the desired output whenever the trick initiating sensor is actuated.

Another game is of the "Simon Says" variety where the toy will provide a predetermined number of instructions for the user to perform in a predetermined pattern, e.g. "pet, tickle, light, sound", which must be then performed with the toy providing a response to each action when done properly. If the user performs the first game pattern successfully, the toy will then continue on to the next pattern which can be the same pattern of actions that were performed in the prior pattern with one more action added thereto. In this manner, the toy herein provides a child with highly intelligent seeming interaction by allowing the child to play interactive games therewith which should keep them interested in playing with the toy for a longer period of time.

These and other advantages are realized with the described interactive plaything. The invention advantages may be best understood from the following detailed description taken in conjunction with the accompanying microfiche appendix, appendix A and the drawings.

BRIEF DESCRIPTION OF THE DRAWINGS

FIG. 18 is an exploded perspective view of the pivotal attachment of the foot portion to a bracket member to which the front switch, a speaker and printed circuit board are attached;

FIG. 19 is a front elevational view of the assembled front switch and speaker to the bracket of FIG. 18;

FIG. 20 is a side elevational view of the pivotal attachment of the foot portion to the bracket with the front switch and speaker attached thereto;

FIG. 29 is a front elevational view partially in section of the tongue switch being actuated;

FIG. 30 is an exploded perspective view of an ear assembly including a pair of pivotal ear shafts and a cam mechanism for pivoting thereof;

FIG. 37 is an elevational view similar to FIG. 34 showing the cam mechanism for the foot portion operable to tilt the body in a forward direction;

FIG. 38 is a side elevational view of the toy body showing the foot portion tilting the body forwardly;

DETAILED DESCRIPTION OF THE PREFERRED EMBODIMENTS

Figure 10:
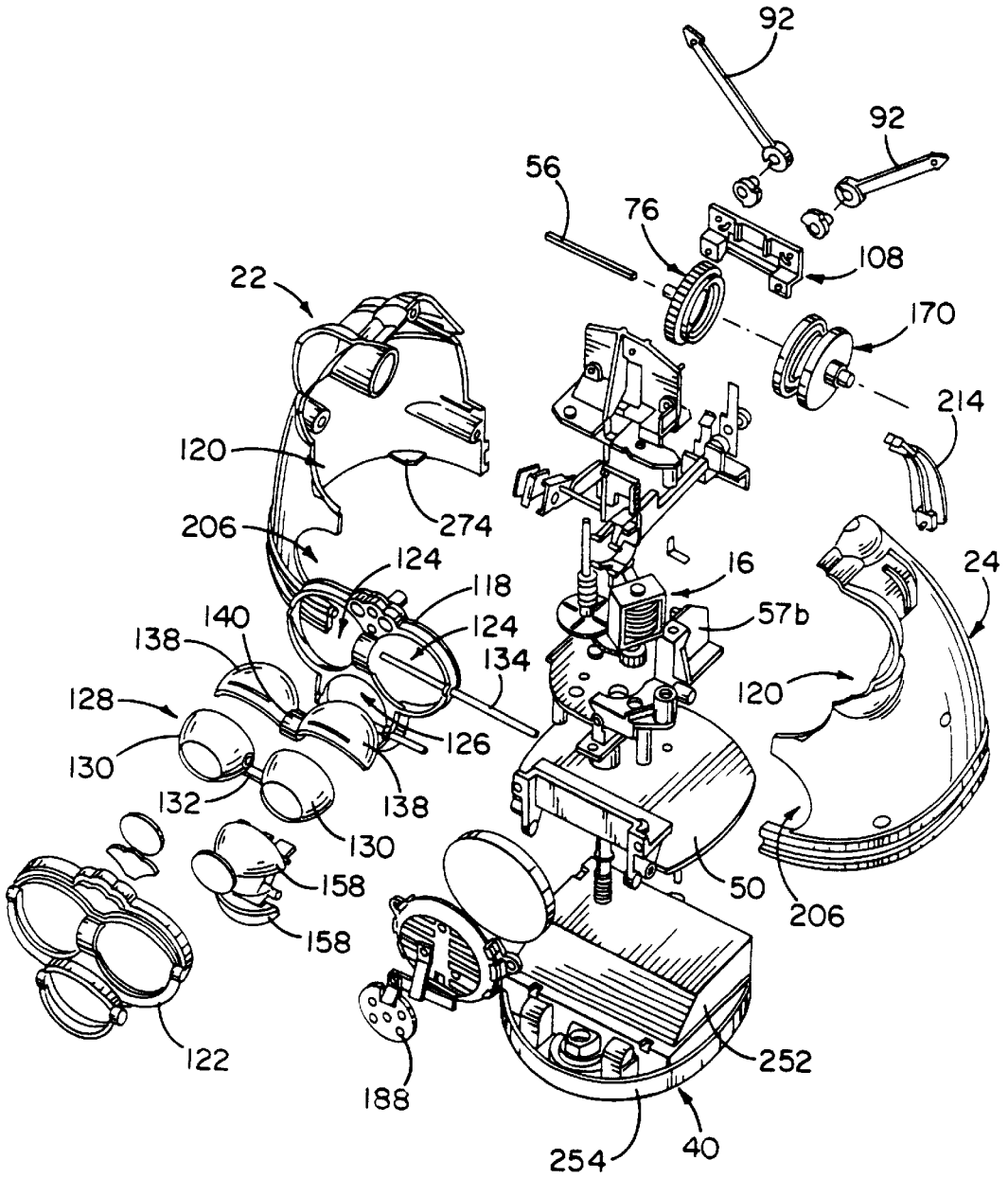
FIG. 10 is an exploded perspective view of the toy body showing the various internal components thereof.
Figure 12:
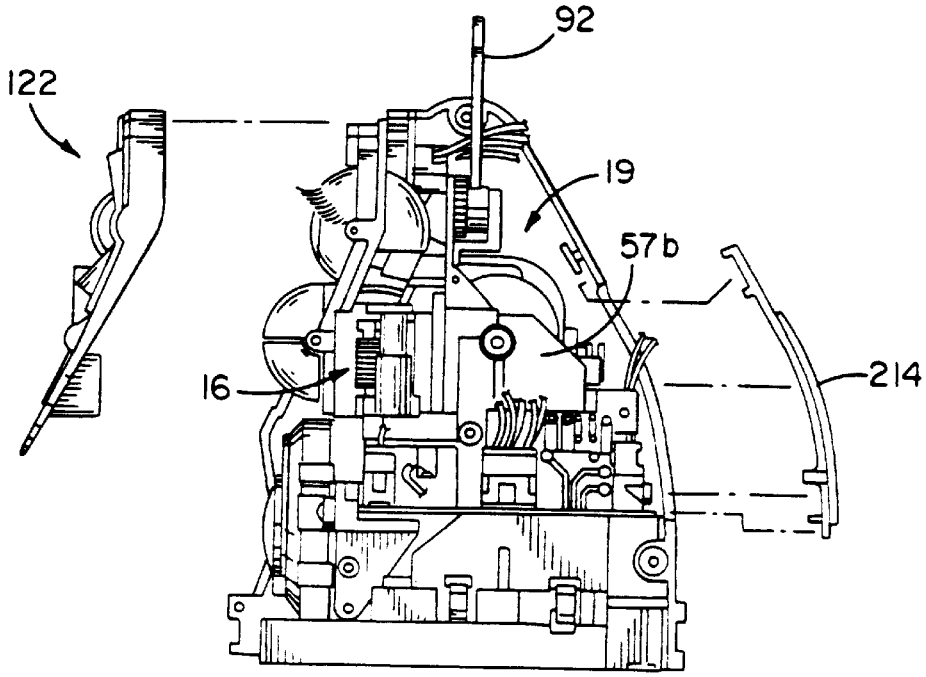
FIG. 12 is a side elevational view of the interior of the toy body and showing a front face plate and a rear switch actuator broken away from the body.
Figure 13:
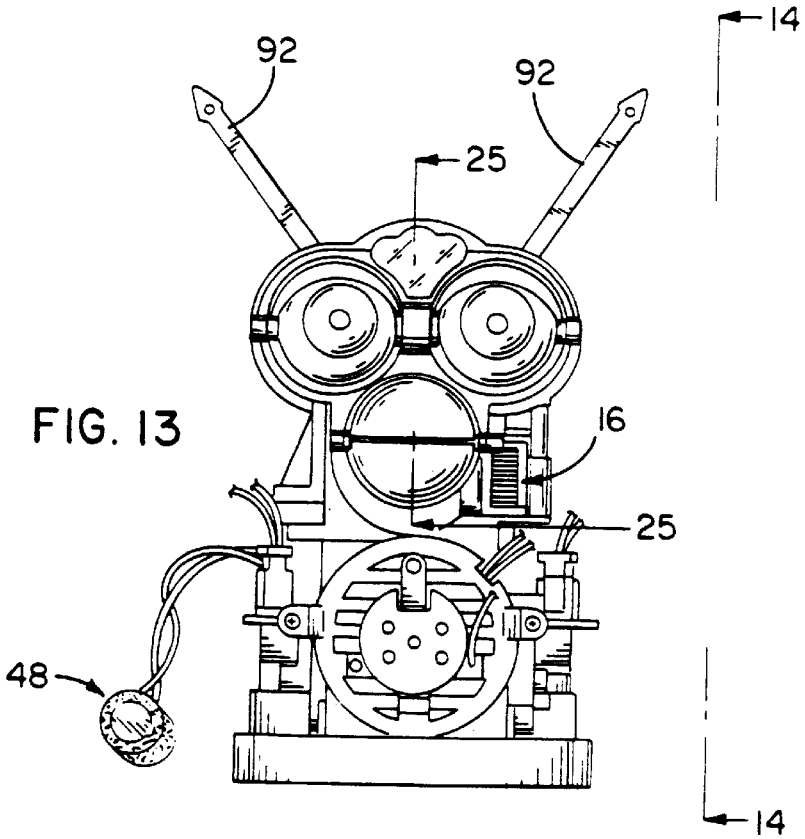
FIG. 13 is a front elevational view of the toy with the body removed.
Figure 14:
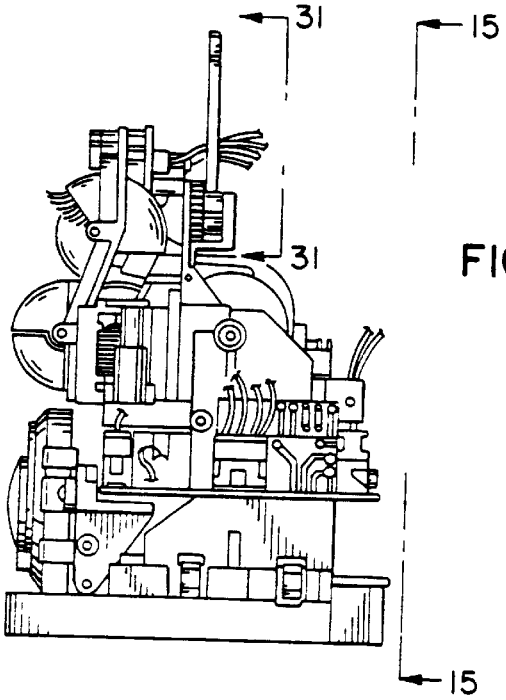
FIG. 14 is a view taken along line 14—14 of FIG. 13.

In FIGS. 1–8, an interactive toy 10 is shown having a number of moving body parts, generally designated 12, which are precisely controlled and coordinated in their movements in response to external sensed conditions. The precise control and coordination of the movements of the body parts 12 provide a highly life-like toy 10 to provide high levels of interaction with the user to keep them interested in playing with the toy over long periods of time. A preferred form of the toy 10 is available from the assignee herein under the name "Furby"™. The toy body parts 12 are controlled and coordinated in response to predetermined sensory inputs detected by various sensors, generally designated 14, provided for the toy 10. In response to predetermined detected conditions, the sensors 14 signal a controller or control circuitry 1000 described hereinafter which controls a drive system 15 for the parts 12 as by activating motor 16 (FIG. 10) of the drive system 15 to generate the desired coordinated movements of the various body parts 12. It is preferred that the toy 10 utilize a single, low power reversible electric motor 16 that is able to power the parts 12 for their life-like movements while providing for acceptable battery life. Further, the controller 1000 includes sound generating circuitry as described herein to make the toy 10 appear to talk in conjunction with the movement of the body parts 12 so as enhance the ability of the toy to provide seemingly intelligent and life-like interaction with the user in that the toy 10 can have different physical and emotional states as associated with different coordinated positions of the body parts 12 and sounds, words and/or exclamations generated by the control circuitry 1000.

Figure 1:
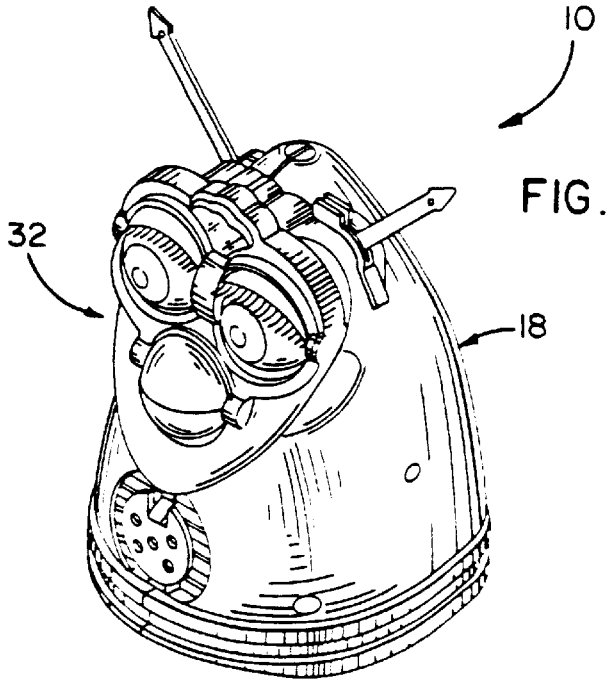
FIGS. 1–7 are various views of a toy in accordance with the present invention showing a body of the toy and various movable body parts thereof.
Figure 2:
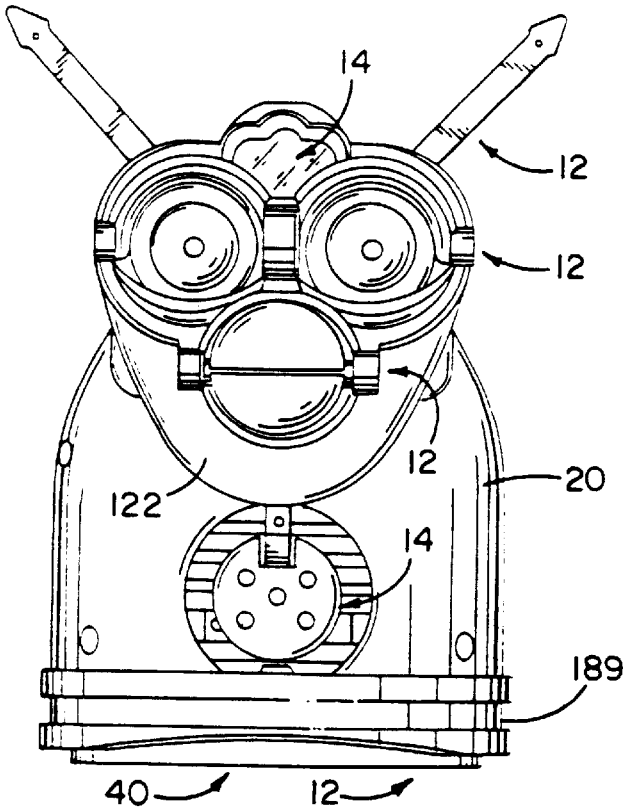
Figure 3:
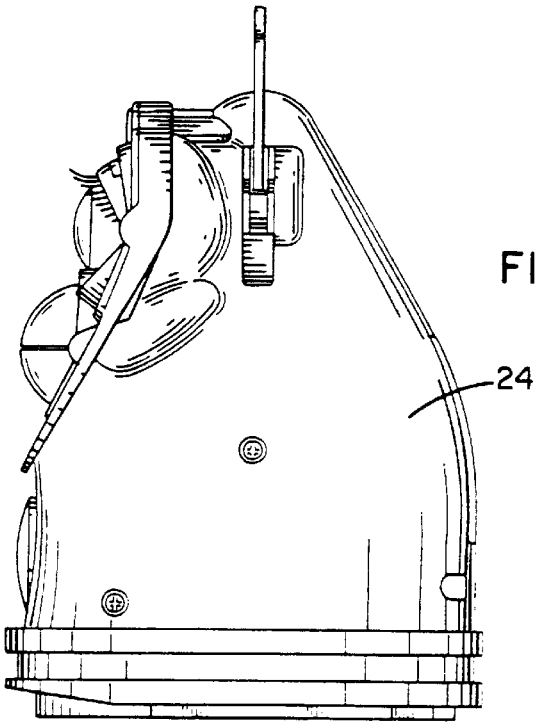
Figure 4:
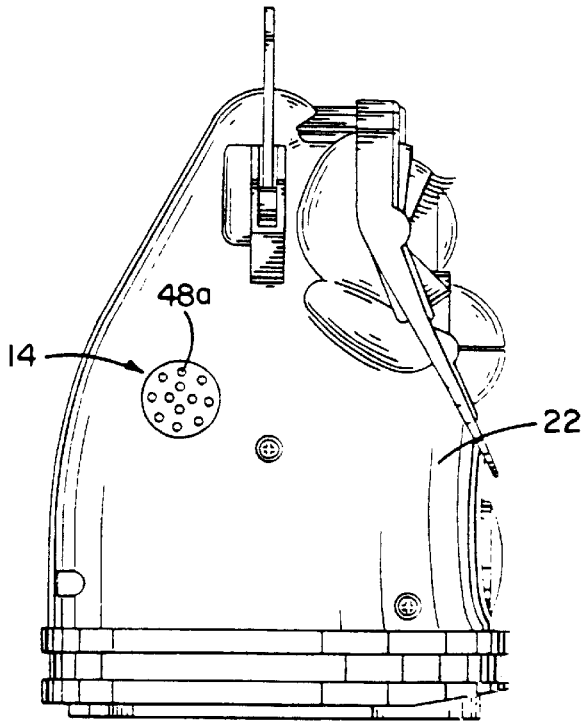
Figure 5:
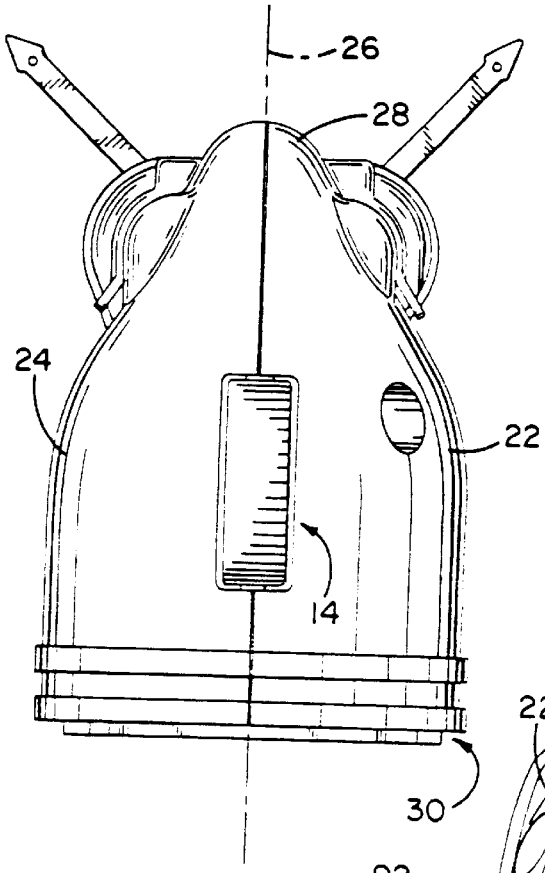
Figure 6:
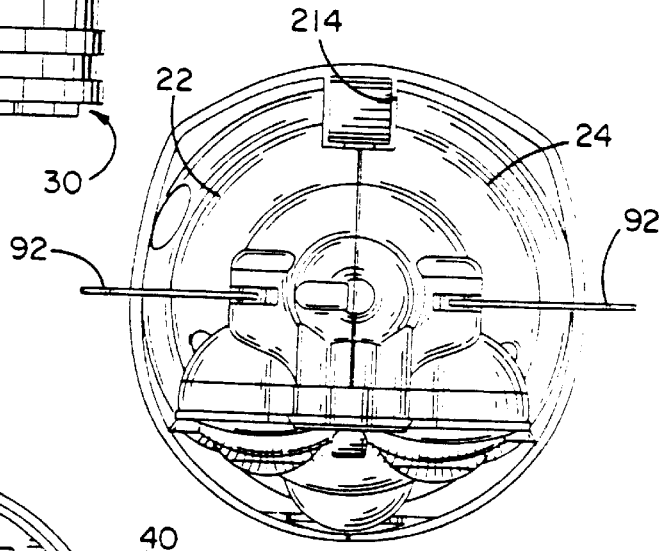
Figure 7:
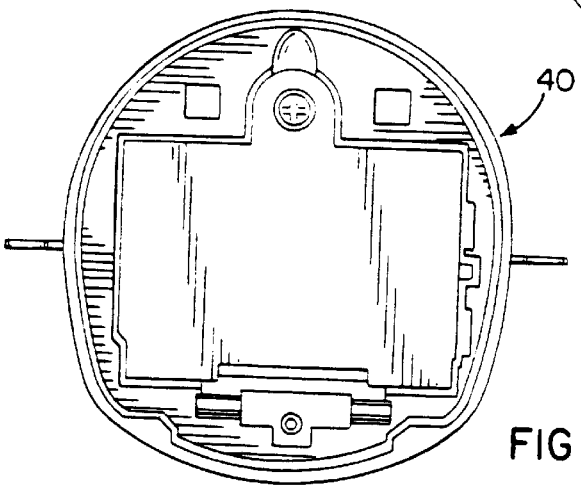
Figure 8A:
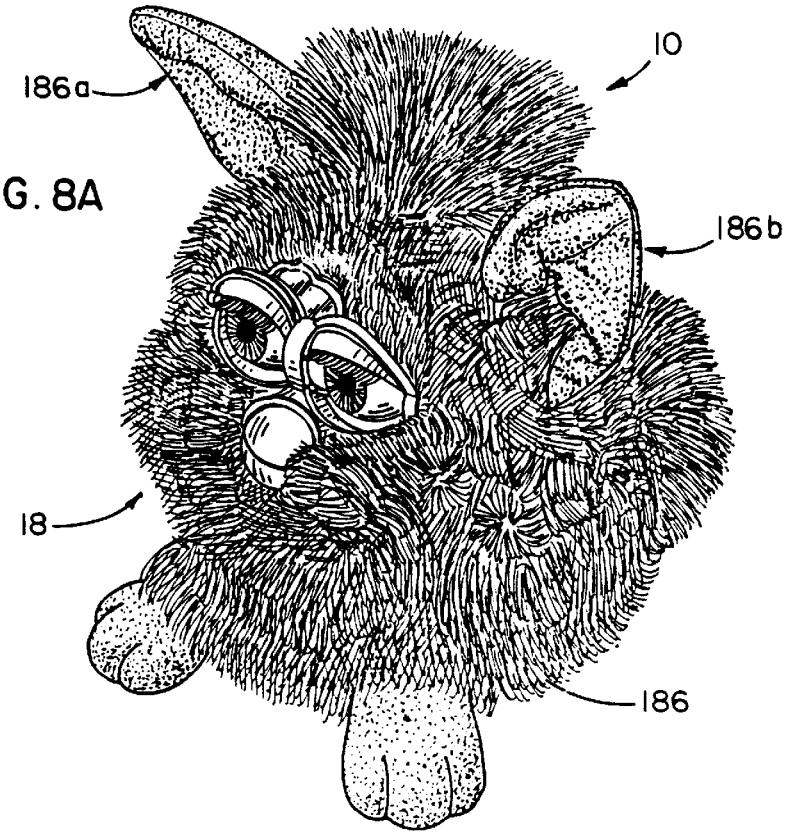
FIG. 8 is a perspective view of the toy including a hide attached over the body.

A major advantage provided by the present toy 10 is that it is able to achieve the highly life-like qualities by the precise coordination of movements of its various body parts 12 in conjunction with its auditory capabilities in response to inputs detected by sensors 14 thereof in a compactly sized toy and in a cost-effective manner. More particularly, the toy 10 includes a main body 18 thereof that has a relatively small and compact form and which contains all the circuitry and various linkages and cams for the moving body parts 12 in the interior 19 thereof, as will be described in more detail hereinafter. As shown, the body 18 includes a carapace or housing 20 having a clamshell design including respective substantially mirror image housing halves 22 and 24 of plastic material that are attached together in alignment about longitudinal axis 26 of the toy body 18. As stated, the housing of the toy 10 has a very compact design and to this end the housing 20 has a preferred dimension between upper end 28 and lower end 30 along longitudinal axis 26 of approximately 4½ inches, and a preferred dimension at its widest portion at the housing lower end 30 laterally transverse to the axis 26 of approximately 3¼ inches. As best seen in FIG. 5, the housing halves 22 and 24 begin to taper approximately midway between the upper and lower ends 28 and 30 toward one another as they progress upwardly toward the housing upper end 28. As is apparent, the preferred toy 10 herein has a very compact size so as to allow it to be readily portable which allows children of all ages to carry the toy between rooms and on trips, etc., as may be desired.

The majority of the moving body parts 12 of the toy 10 herein are provided in a front facial area 32 toward the upper end 28 of the toy body 18. In the facial area 32 there are eye and mouth assemblies 34 and 36, respectively, as best seen in FIGS. 25–28, with an ear assembly 38 as shown in FIGS. 30–33 adjacent thereto. The toy 10 also includes a movable foot portion or assembly 40 at the lower end 30 thereof, as best seen in FIGS. 18–20.

Figure 11:
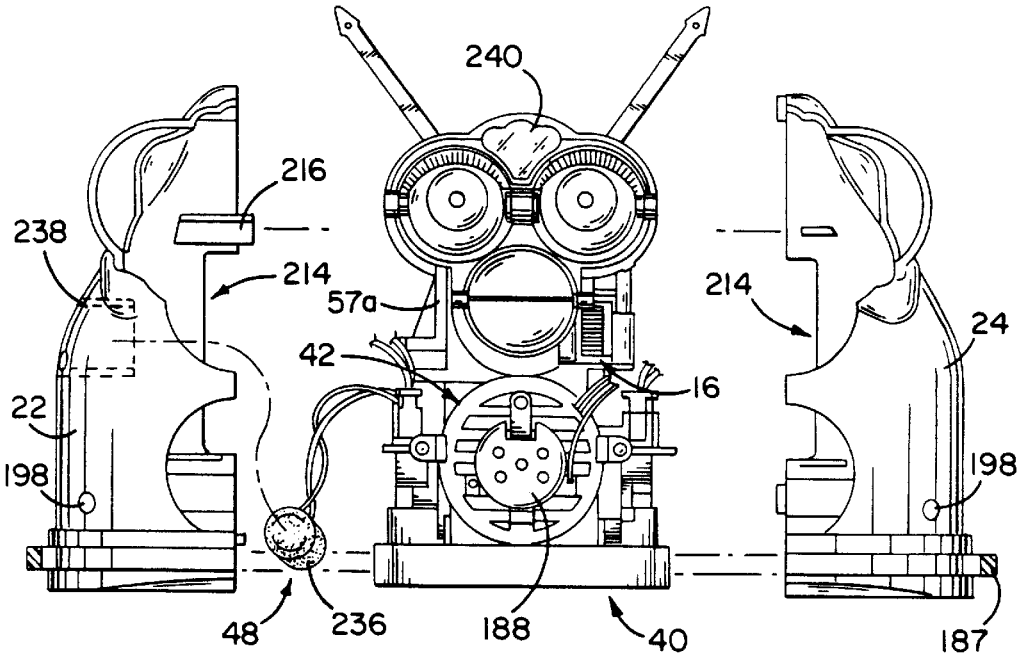
FIG. 11 is an elevational exploded view of the body showing a front sensor and an audio sensor for the toy.
Figure 8B:
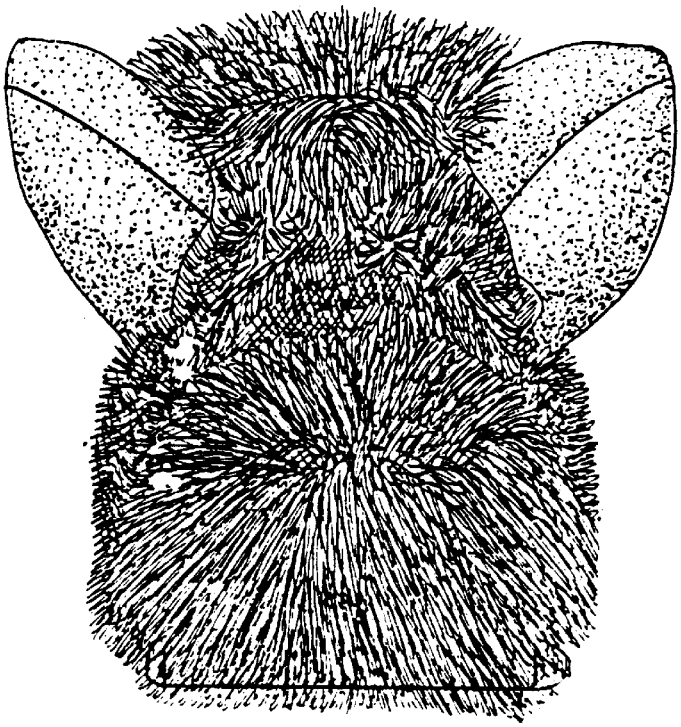
Figure 8C:
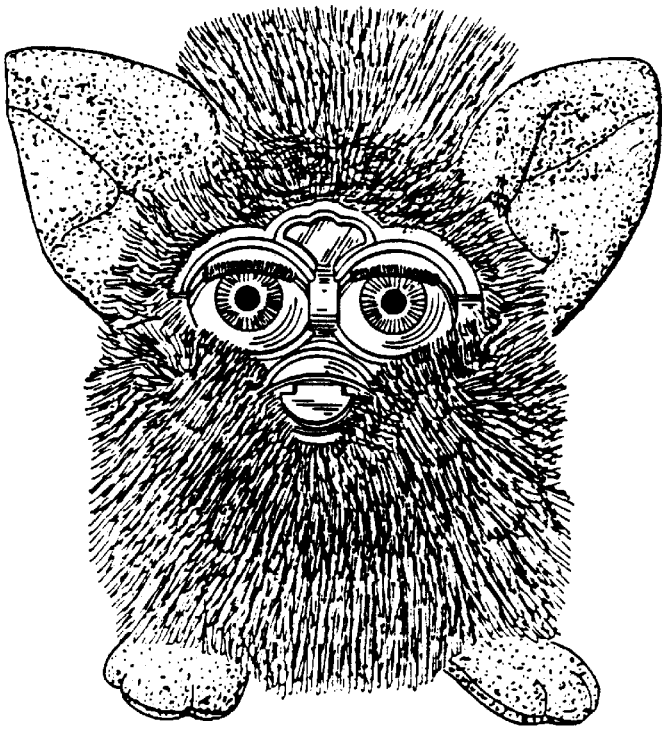
Figure 8D:
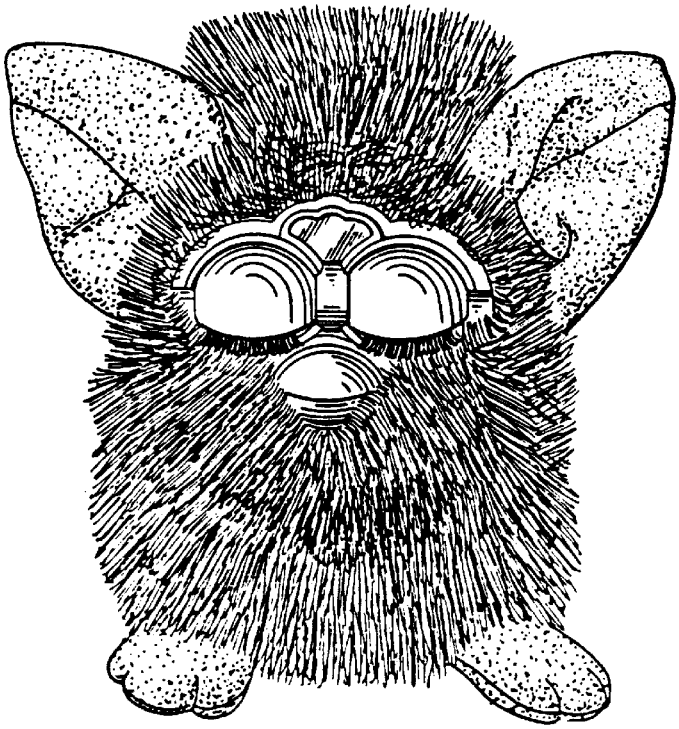
Figure 8E:
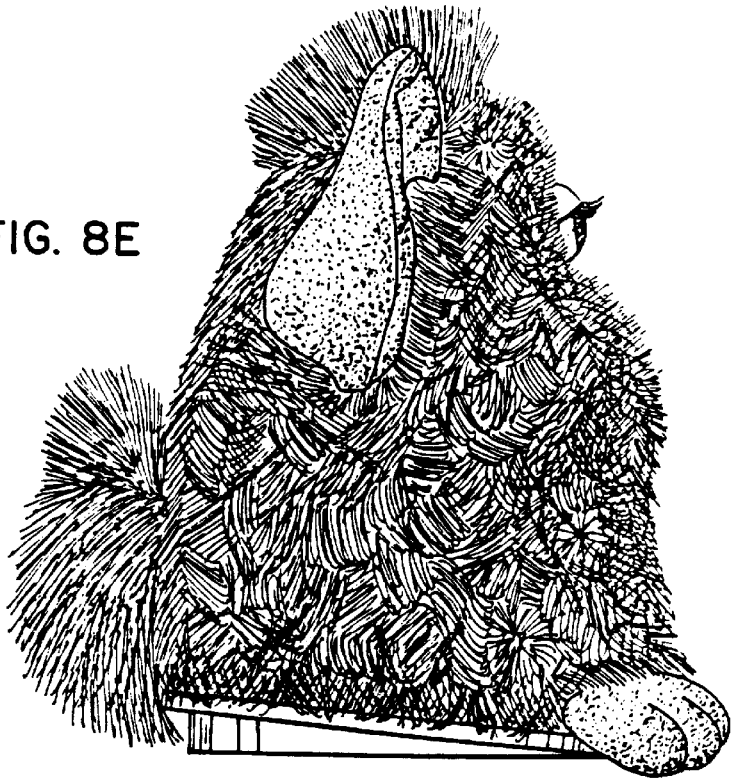
Figure 8F:
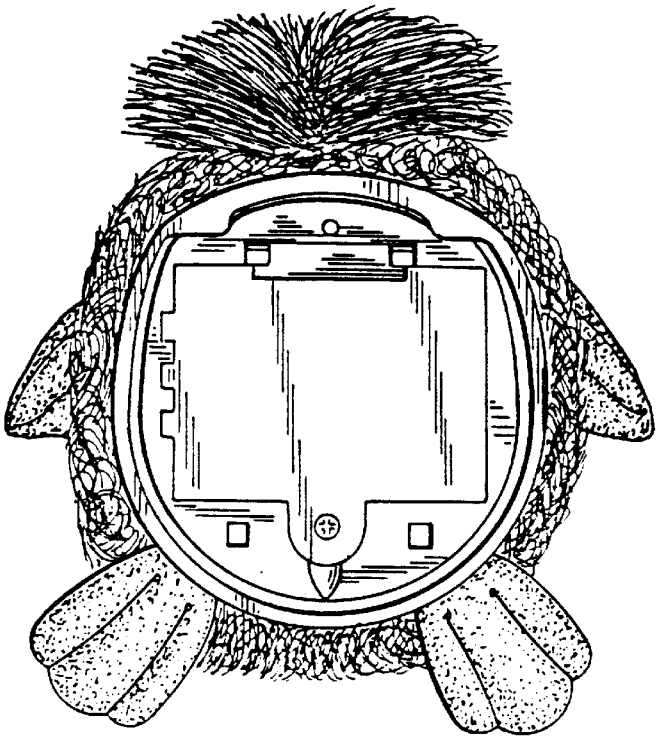
Figure 8G:
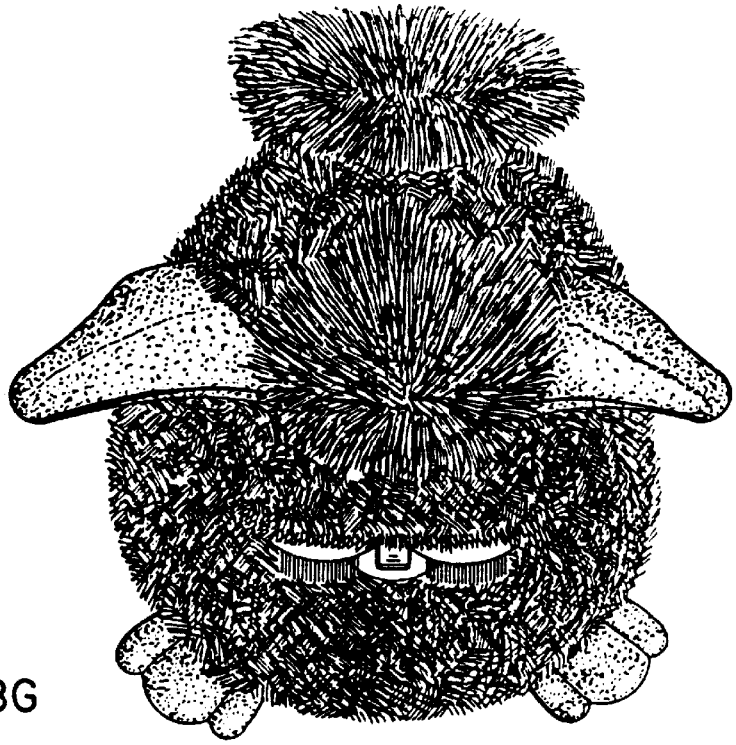
Figure 9:
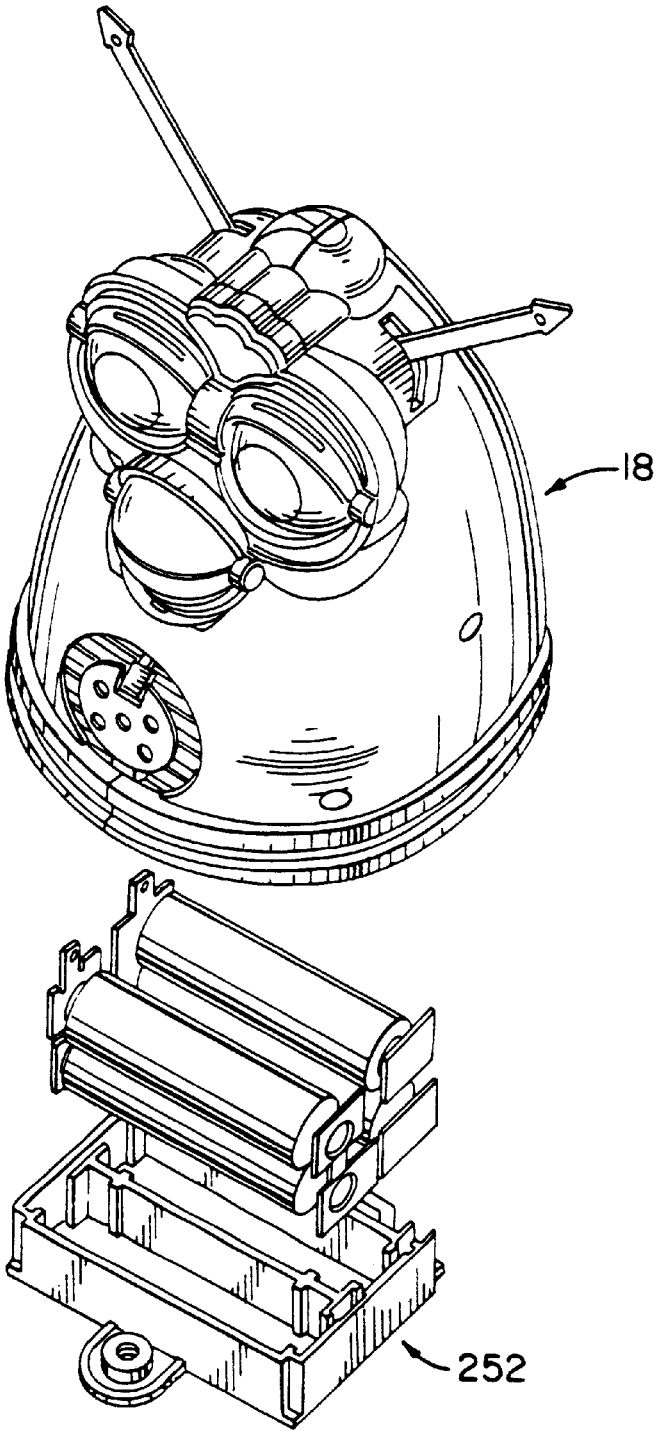
FIG. 9 is a perspective view of the toy body showing a foot portion which is separated therefrom.
Figure 21:
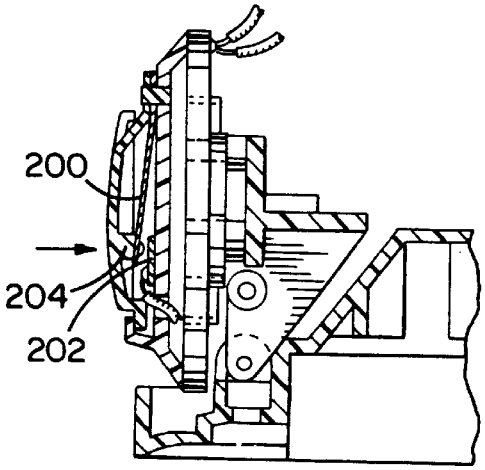
FIG. 21 is a cross-sectional view taken along line 21—21 of FIG. 19 showing the front switch in its actuated position.
Figure 25:
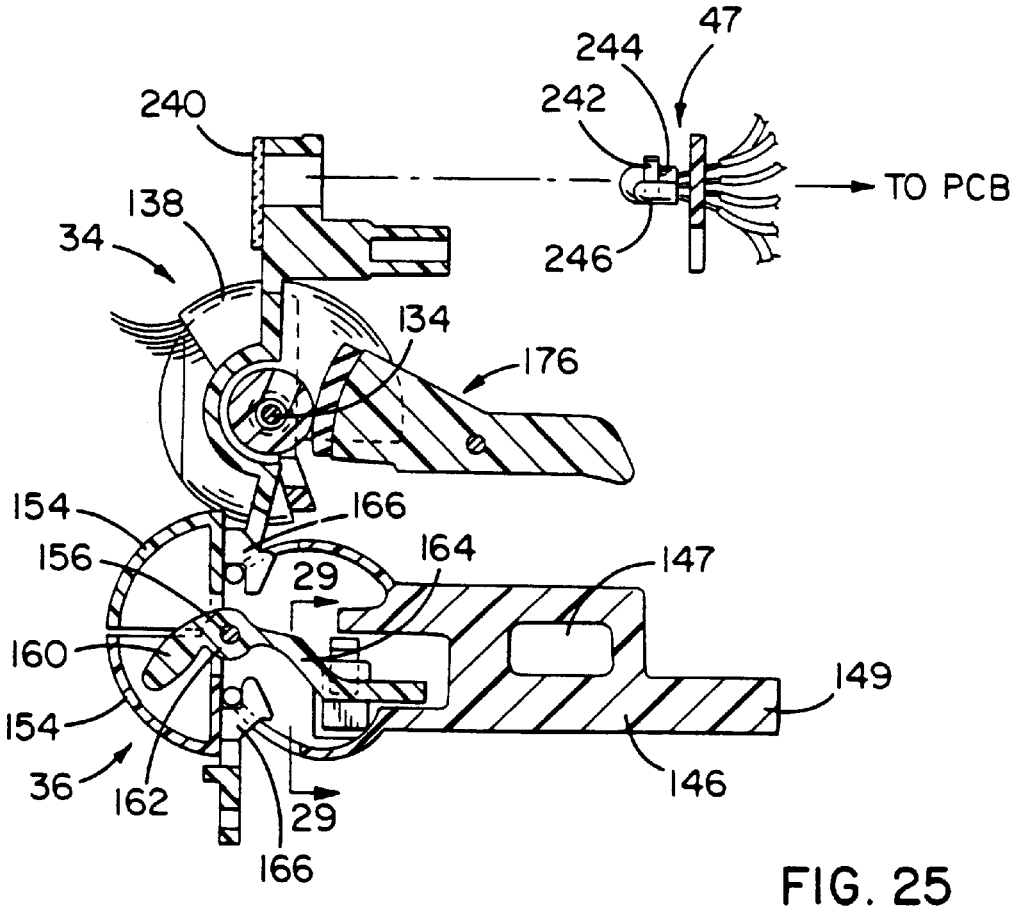
FIG. 25 is a view taken along line 25—25 of FIG. 13 showing cam mechanisms for the eye and mouth assemblies and an IR link and light sensor.
Figure 26:
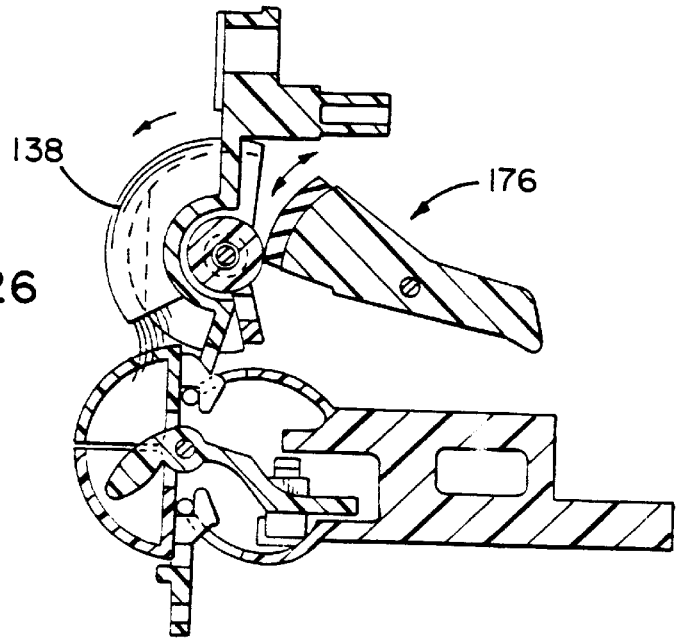
FIG. 26 is a view similar to FIG. 25 with the eye assembly shifted to its closed position.
Figure 27:
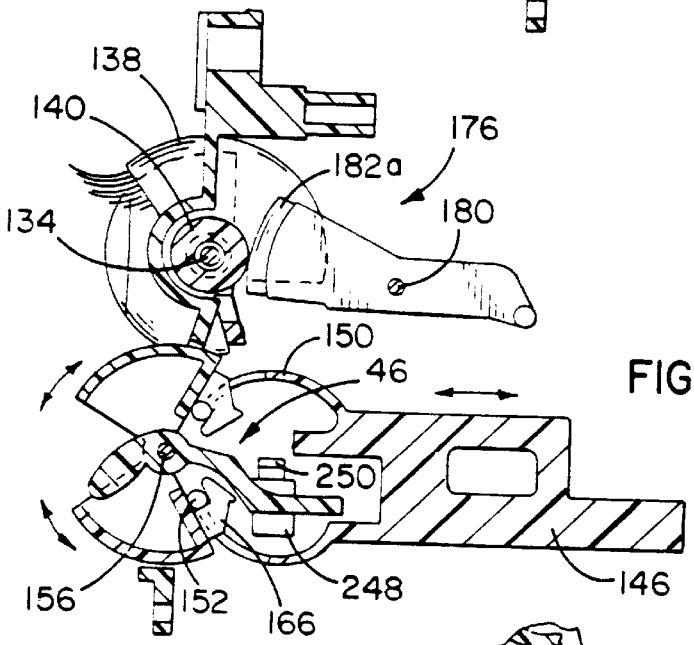
FIG. 27 is a view similar to FIG. 25 with the mouth assembly shifted to its open position.
Figure 28:
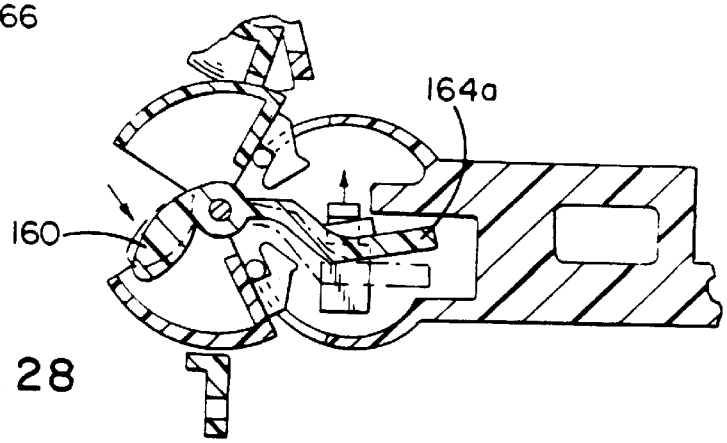
FIG. 28 is a view similar to FIG. 27 showing a tongue of the mouth assembly and switch actuator thereof shifted to actuate a tongue switch.
Figure 35:
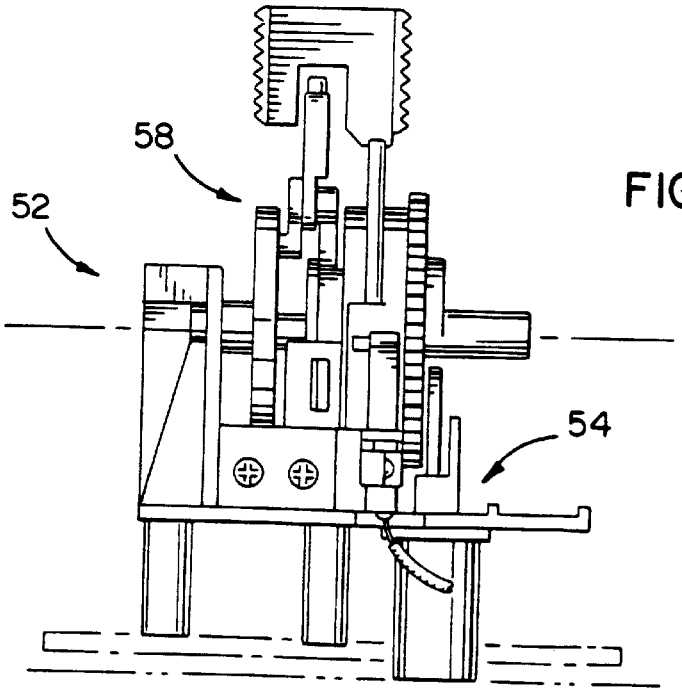
FIG. 35 is a view taken along line 35—35 of FIG. 34 showing the cam operating mechanism for the toy body parts.
Figure 36:
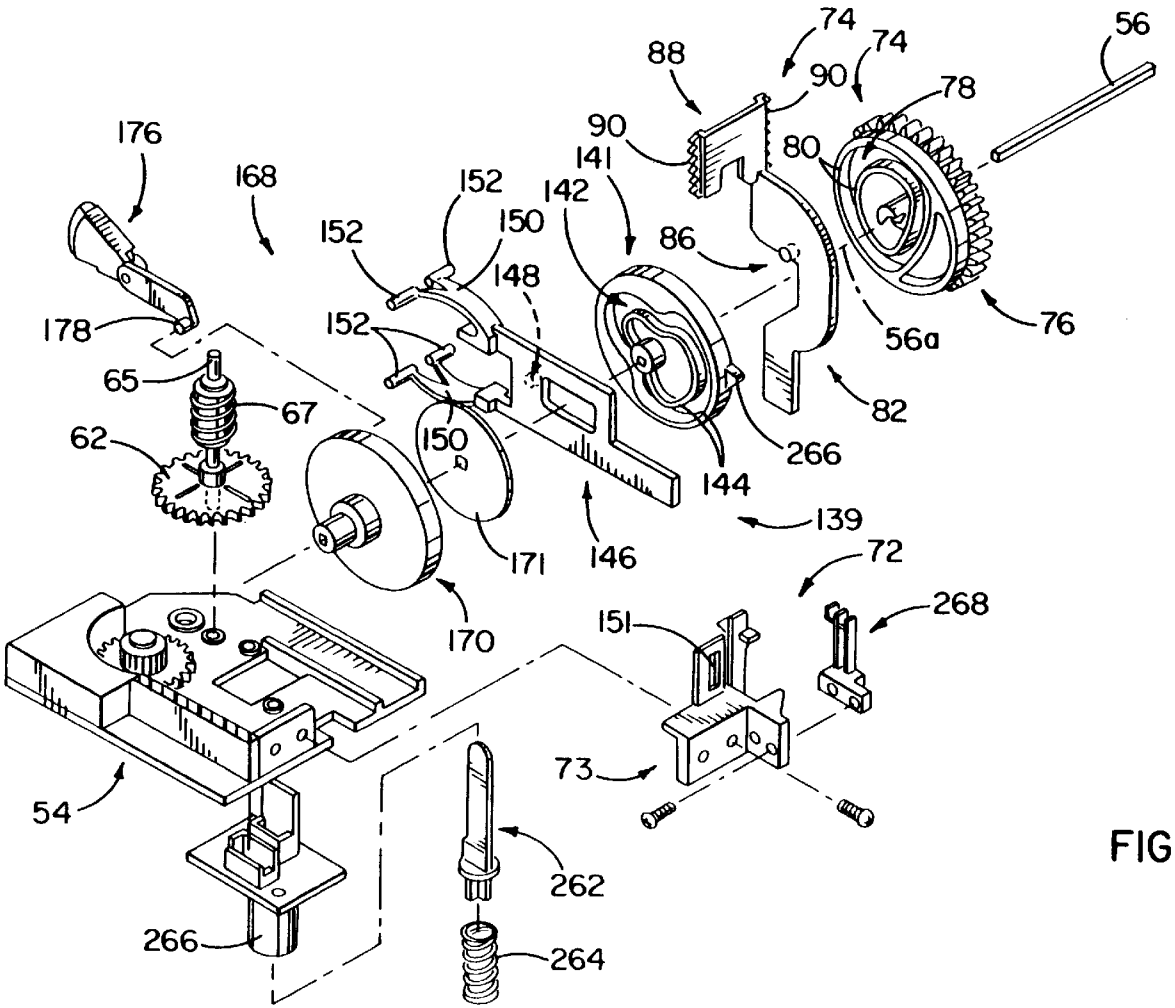
FIG. 36 is an exploded perspective view of the cam operating mechanism.
Figure 40:
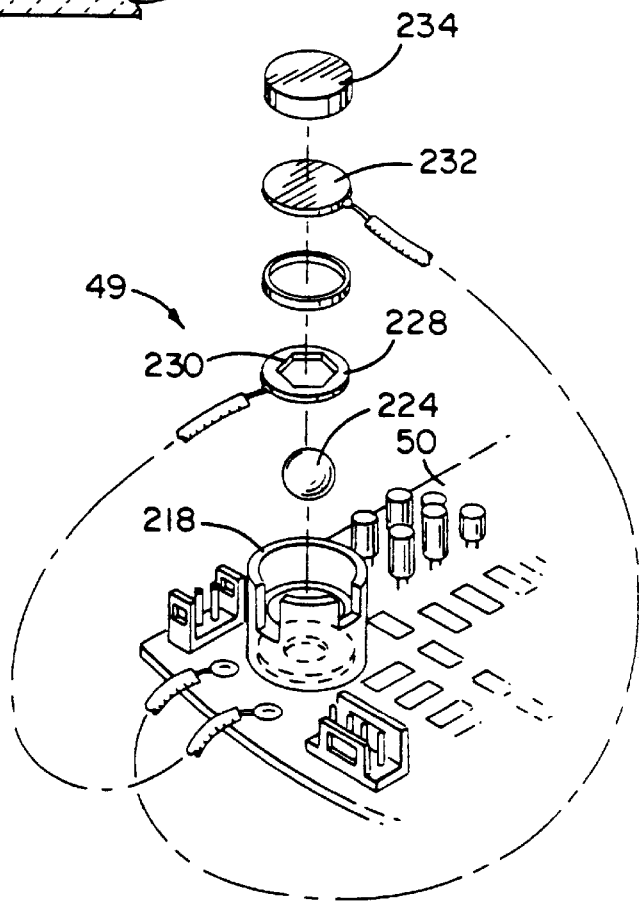
FIG. 40 is an exploded perspective view of a tilt switch including a housing, a ball actuator, and an intermediate control, spacer and upper contact members.
Figure 41:
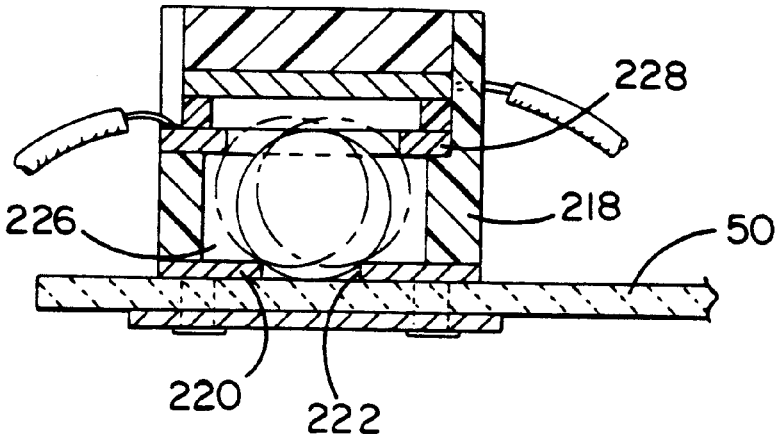
FIG. 41 is a cross-sectional view showing the ball actuator in a lower chamber of the tilt switch housing.
Figure 42:
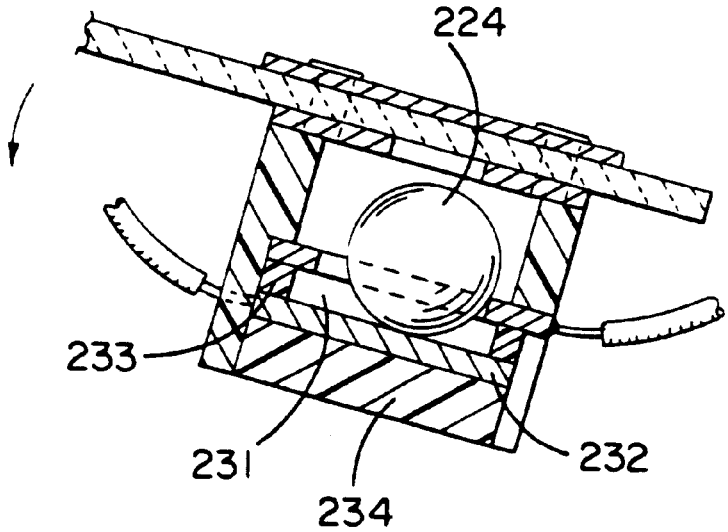
FIG. 42 is a cross-sectional view similar to FIG. 41 except with the toy upside down showing the ball projecting through the control member and into engagement with the upper contact member.

The sensors 14 for the toy 10 will next be generally described. The toy 10 has a front sensor assembly 42 below the facial area 32 thereof as shown in FIGS. 19–21. A rear sensor assembly 44 is provided on the back side of the toy and can best be seen in FIG. 22. The mouth or tongue sensor assembly 46 is provided in the area of the mouth assembly 36 and is shown in FIGS. 27–29. The light sensor and IR link assembly 47 is mounted in the toy body 18 centrally above the eye assembly 34, as can be seen in FIG. 25. An audio sensor 48 is mounted to housing half 22, as can be seen in FIG. 11. FIGS. 40–42 depict a tilt switch assembly 49 mounted to printed circuit board (PCB) 50 in the toy interior 19. As previously indicated, the sensors 14 are effective to detect predetermined external conditions and signal the control circuitry 1000 of the toy 10 which then controls activation of motor 16 for driving the body parts 12 for precision controlled and coordinated movements thereof via cam operating mechanism, generally designated 52, shown in FIGS. 35 and 36. In the interest of space and power conservation, the toy 10 in its preferred form has a drive system 15 that utilizes only a single reversible motor 16 for driving of the cam operating mechanism 52 which is mounted to a frame or harness 54 in a very compact space in the interior 19 of the housing.

Figure 15:
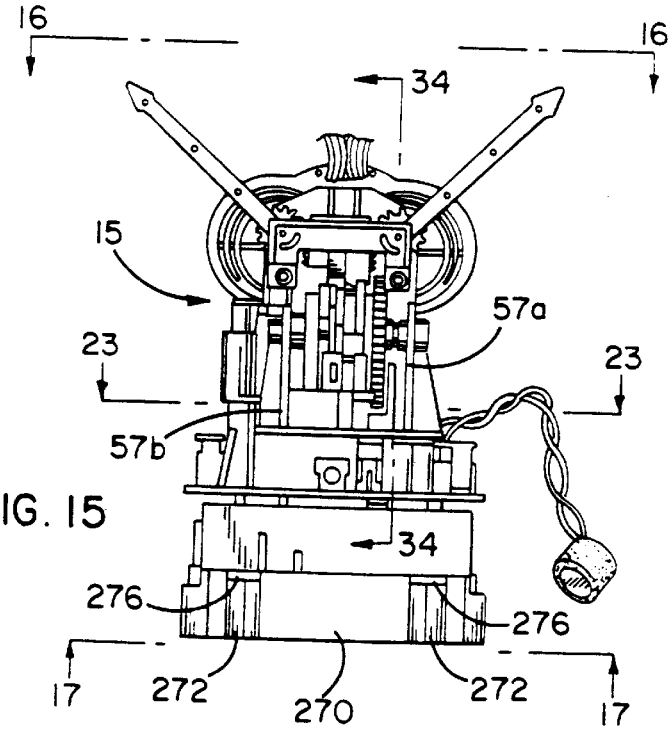
FIG. 15 is a view taken along line 15—15 of FIG. 14.
Figure 16:
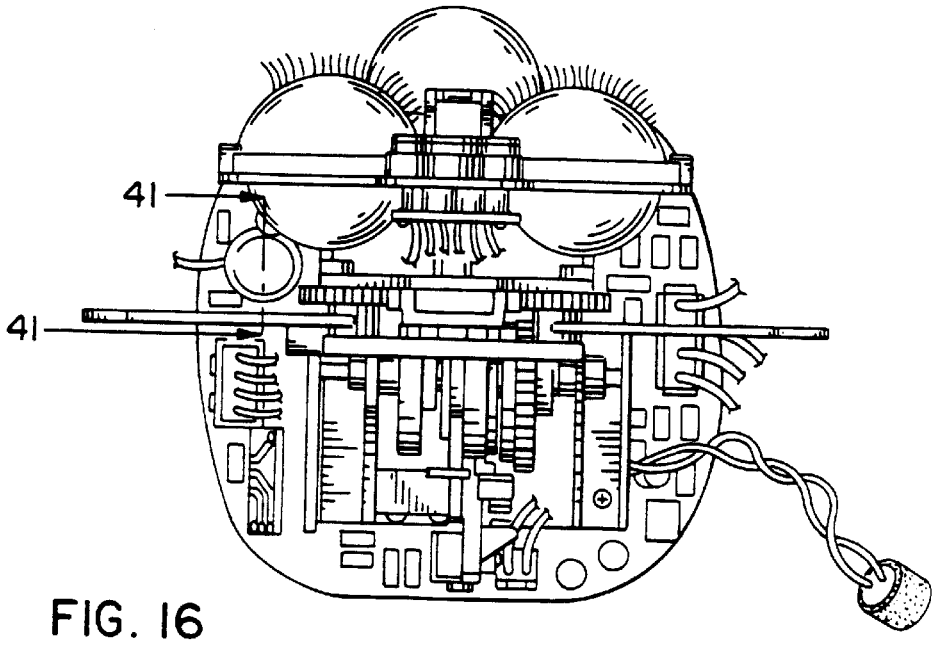
FIG. 16 is a view taken along line 16—16 of FIG. 15.
Figure 17:
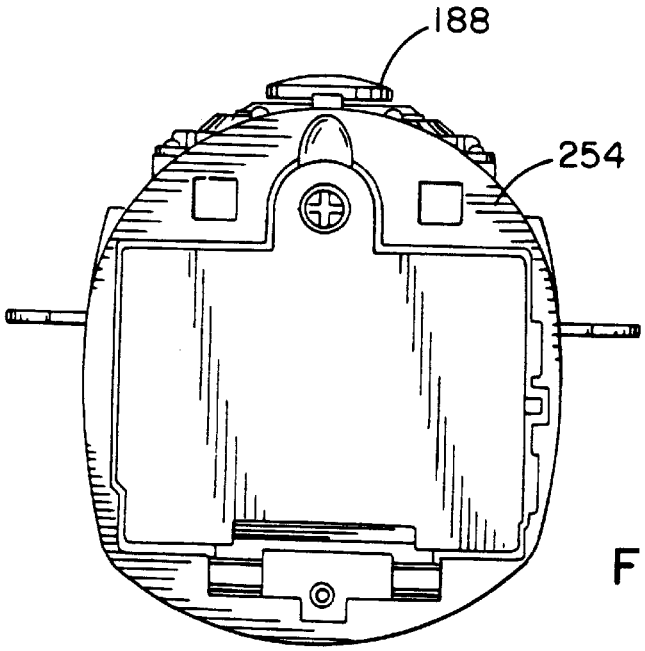
FIG. 17 is a view taken along line 17—17 of FIG. 15.

More specifically, the cam operating mechanism 52 including the portion of the frame 54 therefor can include a transverse dimension of slightly greater than 1 inch while still being effective to control the movements of every moving body part assembly 34–40. The compact nature of the cam operating mechanism 52 is primarily due to the use of a single control shaft 56 which is driven for rotation by the single motor 16 of the drive system 15 herein. Ends of the shaft 56 are fixed in hub portions of cam members that are rotatably mounted to parallel vertical walls 57*a* and 57*b* of the frame 54, as best seen in FIG. 15. Rotation of the control shaft 56 causes cam mechanisms, generally designated 58, associated with the body parts 12 to generate movement thereof in a controlled and coordinated manner, as previously discussed.

In this regard, it is important for the controller 1000 to be able to precisely control and know the position of the shaft 56 when the motor is activated 16; however, it is desirable to avoid the expense and moving parts of utilizing a closed loop servo mechanism for providing the necessary feedback. The preferred drive system 15 herein instead includes an optical counting assembly 60 which counts intervals of the rotation of a slotted gear wheel 62 in gear train transmission 64 of the drive system 15. The gear wheel 62 is mounted at the lower end of a common vertical shaft 65 having worm gear 67 formed at its upper end, and is driven for rotation by the upper portion 69*a* of intermediate compound gear 69 which, in turn, is driven for rotation by gear 16*a* on the output shaft of the motor 16 which drives the larger lower portion 69*b* of compound gear 69 for rotation. By incrementally counting slots 66 in the wheel 62 as the wheel 62 is rotated when the motor 16 is activated as the slots 66 pass between an IR transmitter 68 and an IR receiver 70 on either side of the gear wheel 62, the controller 1000 can receive accurate information regarding the position of the control shaft 56 for precisely controlling the movements of the body parts 12. Preferably four slots 66 are equally spaced at ninety degree intervals about the wheel 62. In addition, an initialization switch assembly 72 is provided that is affixed to the frame 54 for the cam operating mechanism 52 via mounting bracket 73 to zero out the count in the control circuitry 1000 on a regular basis when the switch assembly 72 is actuated.

Figure 39:
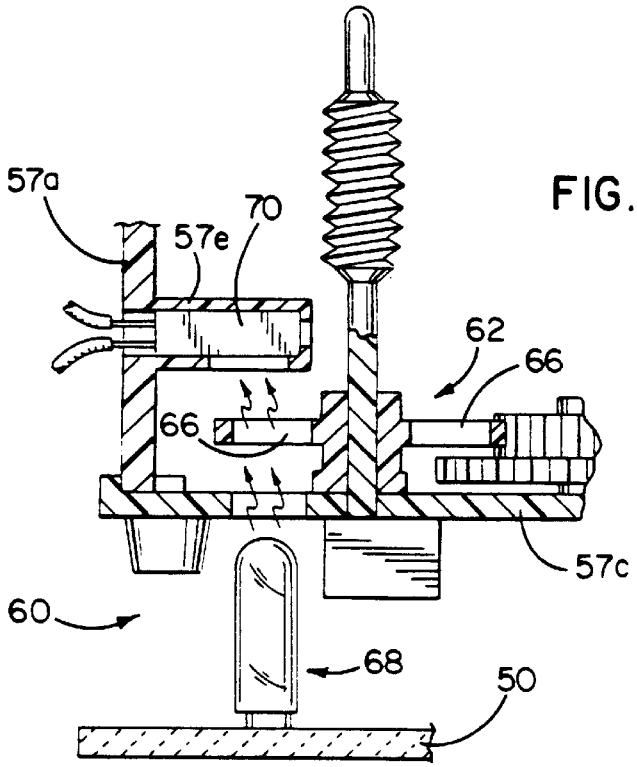
FIG. 39 is a cross-sectional view taken along line 39—39 of FIG. 34 showing an optical counting assembly for the motor.

The transmitter 68 is rigidly mounted to PCB 50 beneath flat base portion 57*c* of the frame 54 with the base portion 57*c* including an integral depending sheath portion 57*d* for covering and protecting the IR transmitter element 68. The IR receiver element 70 is rigidly mounted to frame 54 in box-shaped housing portion 57*e* thereof integrally formed with frame vertical wall 57*a,* as shown in FIG. 39. In this manner, the optical counting assembly 60 herein is improved over prior feedback mechanisms that require moving parts or impart frictional resistance to motor operation, as the assembly 60 utilizes elements 68 and 70 that are fixed in the body interior 19 and which do not affect the power requirements of motor 16.

The cam mechanisms 58 associated with each of the body parts 12 each include a cam member and a follower or actuator linkage thereof. More specifically and referencing FIGS. 30–33 and 36, with respect to the ear assembly 38, a cam mechanism 74 is provided including a gear cam member 76 having an arcuate slot 78 formed on one side thereof. The slot 78 is defined by slot walls 80 including cam surfaces 80*a* which engage a cam follower 82, and more specifically, a follower pin projection 84 thereof which rides in the slot 78 against the cam surfaces 80*a* as the shaft 56 is rotated. The shaft 56 is rotated when the motor 16 is activated via gear train transmission 64 by meshing of worm gear 67 with the peripheral teeth 76*a* of the gear cam member 76 fixed on and for rotation with the control shaft 56. In the preferred form, the shaft 56 has a square cross-sectioned shape with the gear cam member 76 having a complementary square opening for press-fitting of the cam member 76 thereon. The cam follower 82 has a hook shape in profile with a cut out 86 so as to provide clearance for the shaft 56 extending therethrough with the hook-shaped follower 82 projecting upwardly from the shaft 56 substantially perpendicular to the axis 56*a* thereof. At the upper end of the follower 82 is a rack portion 88 having teeth 90 on either side thereof. Pivotal ear shafts 92 are mounted to a transverse vertical extension portion 94 of the frame 54 via lower annular mounting portions 96 thereof and pinion gears 98 for pivoting of each of the shafts 92.

The frame extension 94 includes mounting posts 100 projecting rearwardly therefrom and onto which the gears 98 are rotatably mounted. The gears 98 include peripheral teeth 104 and a rearwardly projecting hub portion 106 preferably having a splined external surface thereof. The hub 106 is sized to fit the annular mounting portions 96 of the ear shafts 92 with these annular portions including interior splined surfaces that cooperate with the splines of the hubs 106 so that rotation of the gears 98 will cause pivoting of the ear shafts 92 unless a braking force is applied to the shafts 92. In this instance, there is sufficient clearance between the mounting portions 96 and the hubs 106 so that the splines thereof allow relative motion therebetween to provide a clutch function for the ear assembly 34.

To provide limits of the pivotal movement of the ear shafts 92, a bracket member 108 is affixed to the frame portion 94 and includes arcuate slots 110 on either side therefor for receipt of a pin 112 which projects rearwardly from the bottom of ear shaft annular mounting member 96. Adjacent the slots 110, the bracket member 108 includes apertures 114 for receipt of the distal ends of the mounting posts 100.

Figure 31:
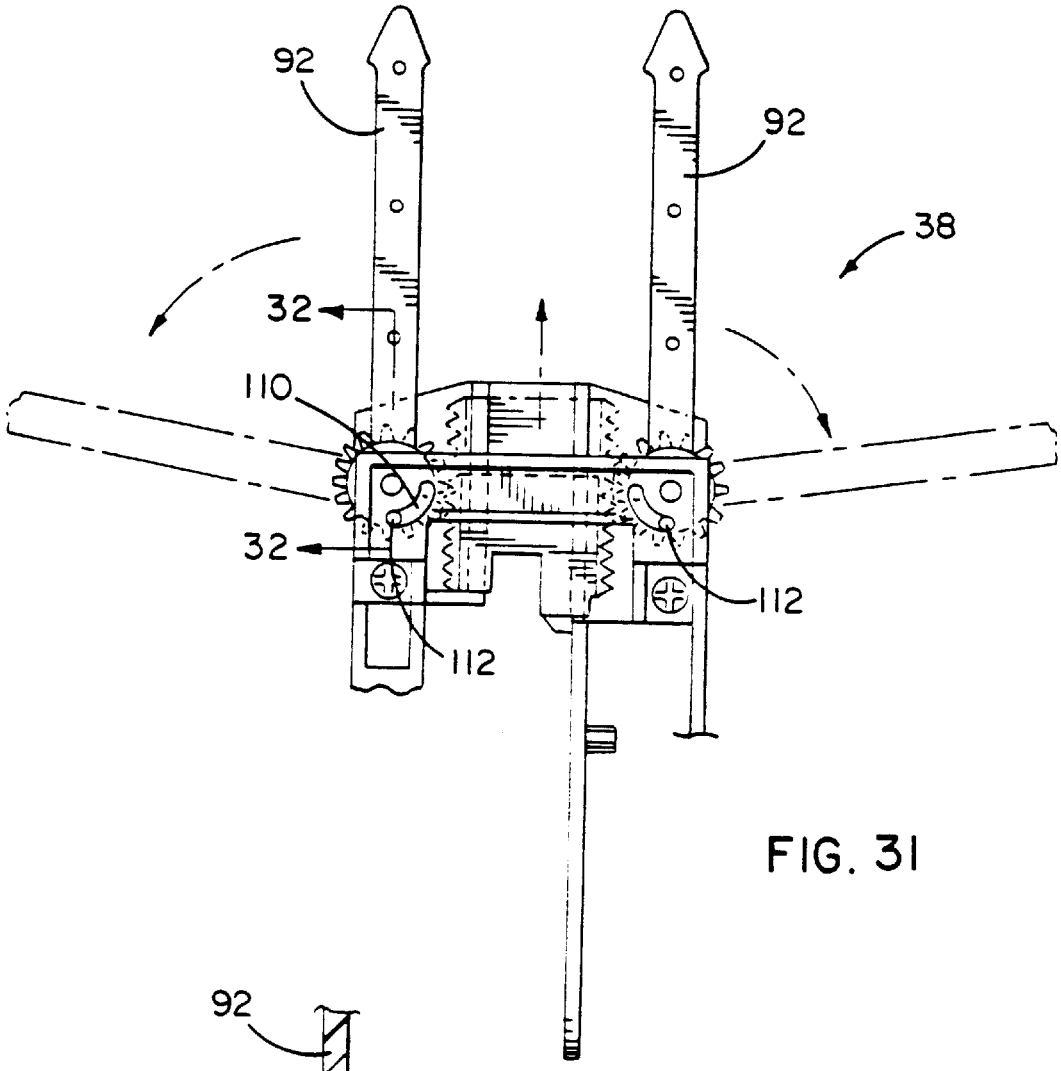
FIG. 31 is a view taken along line 31—31 of FIG. 14 showing the ear shafts pivoted from raised positions to lowered positions.
Figure 32:
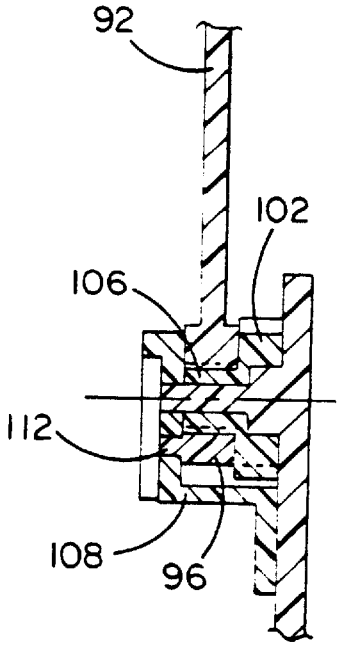
FIG. 32 is a cross-sectional view taken along line 32—32 of FIG. 31.
Figure 33:
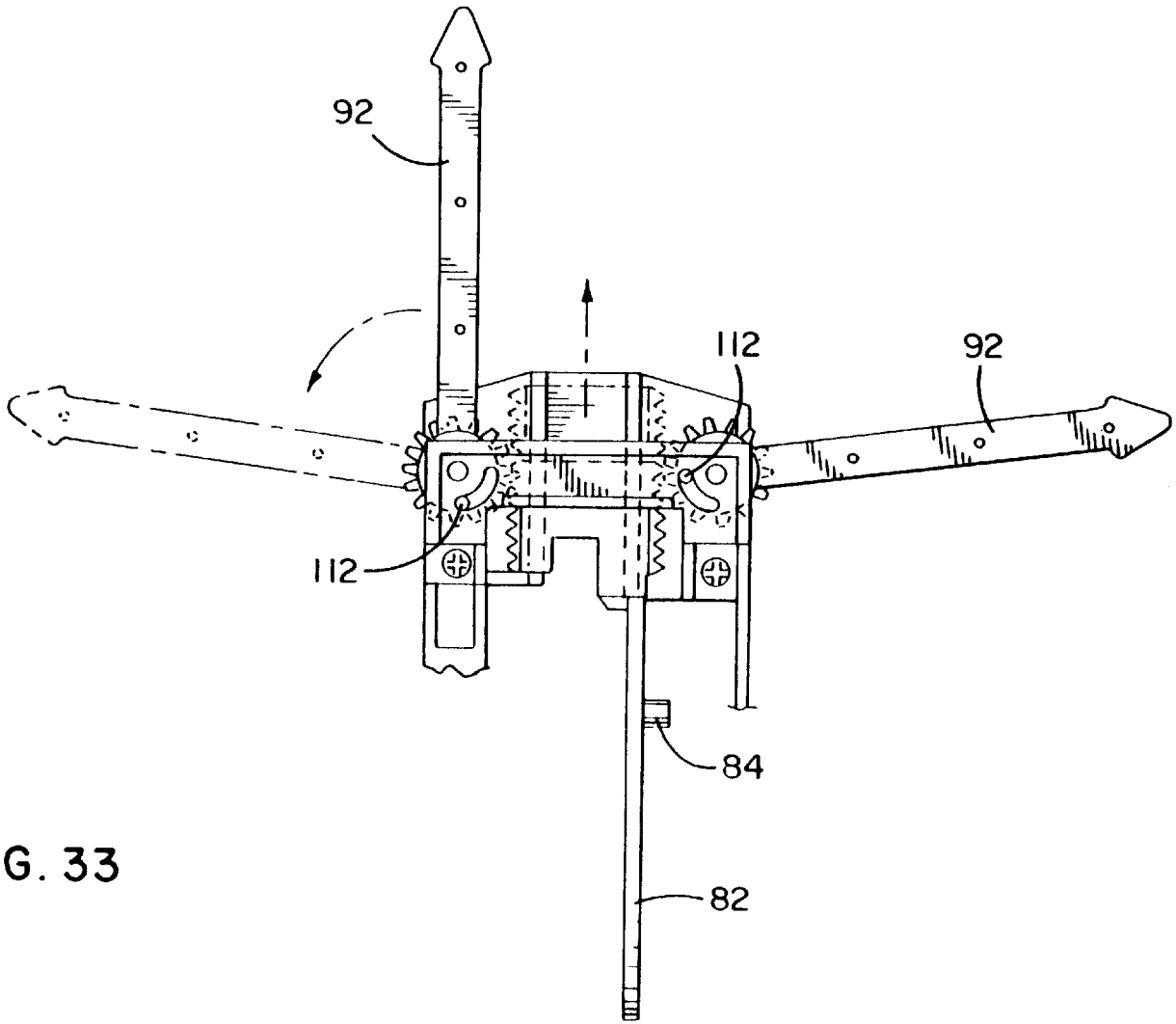
FIG. 33 is a view similar to FIG. 31 with one of the ear shafts raised and one of the ears lowered.

With continuing reference to FIGS. 31–33, control shaft 56 causes the cam follower pin 84 to ride in the slot 78 of the gear cam member 76 which generates vertical up and down movement of the follower member 82 including the rack portion 88 thereof. The rack portion 88 includes an offset wall 114 intermediate the gear teeth 90 on either side thereof so that with the portion 88 riding along the vertical frame extension 94, the rack portion 88 will be guided by laterally spaced, vertical guide rails 116 thereon for vertical translating movement with the gear portion teeth 90 on either side thereof meshing with the teeth 104 of the gears 98 for causing pivoting of the ear shafts 92. In this manner, the ear cam mechanism 74 has a rack and pinion type of gearing arrangement to generate a pivoting action of the ear shafts 92 in a plane parallel to the axis of the shaft 56 from up and down translation of the cam follower 82 perpendicular to the shaft axis.

Accordingly, when the follower 82 is in its lower position, the ear shafts 92 will be in a substantially vertical raised position with the pins 112 at the lower end of the bracket arcuate guide slots 110. As the follower 82 is shifted vertically upward, the ear shafts 92 pivot in a direction opposite to each other toward their lowered position, and reach this position when the pins 112 are at their uppermost end of the bracket guide slots 110. As the splined connection between the shaft annular portions 96 and pinion hubs 106 allow for relative motion such as when a child grabs an ear during movement thereof, it is possible for a particular shaft 92 to become out of alignment with where the controller 1000 thinks it is located. However, due to the provision of the guide slots 110, once the ear assembly 38 is instructed by the controller 1000 to travel to one of its raised or lowered position, the splined connection will allow the gear 98 associated with the out of alignment shaft 92 to rotate relative to the portion 96 thereof until the gear 98 stops rotating as the rack portion 88 reaches the end of its travel. Then, subsequent movement away from the end position will occur with the ear shafts 92 in alignment with each other absent a braking force applied thereto.

Both the eye and mouth assemblies 34 and 36 are mounted to a face frame member 118 having openings for the assemblies 34 and 36, as well as for the light and IR link sensor assembly 48. The face frame 118 is mounted to the housing 20 in an upper opening 120 thereof formed when the housing halves 22 and 24 are connected via complementary shaped face plate 122 seated in the opening 120. The frame 118 includes a pair of upper eye openings 124 and a lower mouth opening 126 centered therebelow similar to the face plate 122. An eye member 128 is provided including a pair of semi-spherical eyeballs 130 joined by connecting portion 132 extending there-between with the eyeballs 130 sized to fit in the eye openings 128 of the frame 118 and pivotally attached thereto via pivot shaft 134. Thus, the pivot shaft 134 is spaced forwardly and vertically higher than the control shaft 56 and extends parallel thereto. The pivot shaft 134 also mounts an eyelid member 136 which includes one-third spherical eyelids 138 and a central annular bearing portion 140 through which the pivot shaft 134 extends and interconnecting the pair eyelids 138. With the eye and eyelid members 128 and 136 both pivotally mounted to shaft 134, the bearing portion 140 will be disposed above the connecting portion 132.

The mouth assembly 36 includes substantially identical upper and lower mouth portions 152 and 154 in the form of upper and lower halves of a beak that are sized to fit in the mouth opening 126 of the frame 118 and are pivotally attached thereto via pivot shaft 156. The mouth portions 154 are pivotally mounted on shaft 156 by rear semi-circular boss portions 158 thereof spaced on either side of the mouth portions 154 so as to provide space for a tongue member 160 therebetween. The tongue member 160 includes an intermediate annular bearing portion 162 through which the pivot shaft 156 extends and having a rearwardly extending switch actuator portion 164 so that depressing the tongue 160 pivots the portion 164 for actuating tongue sensor assembly 46, as described more fully hereinafter. The mouth portions 154 also include upper and lower pairs of oppositely facing hook-shaped coupling portions 166 to allow an associated cam mechanism 58 to cause movement of the mouth portions 154, as described below.

The cam mechanisms 58 for the eye and mouth assemblies 34 and 36, respectively, will next be described with reference to FIGS. 25–27 and 36. The mouth cam assembly 139 includes a disc-shaped cam member 141 adjacent to gear cam member 76 on the control shaft 56 and fixed for rotation therewith. Similar to cam member 76, cam member 141 includes an arcuate slot 142 formed on one side thereof as defined by slot walls 144. The mouth cam follower 146 includes a pin 148 projecting therefrom and into the slot 142 for engagement with cam surfaces 144*a* on the slot walls 144. Accordingly, rotation of the shaft 54 rotates the cam member 141 with the pin 148 riding in the slot 142 thereof to cause the follower 146 to translate in a fore and aft direction. The cam follower 146 projects forwardly from the shaft 56 substantially perpendicular to the axis thereof and has a window 147 through which shaft 56 extends, and a lower rear extension 149 that fits through slot 151 formed in the initialization switch bracket 73 for guiding translating fore and aft movement of the follower 146. Toward the forward end of the cam follower 146 are a pair of vertically spaced flexible arcuate arm portions 150 having small pairs of pivot pins portions 152 extending oppositely and laterally from forked distal ends thereof spaced forwardly of the shaft 56 and extending parallel thereto.

The pin portions 152 seat in the hook coupling portions 166 of the mouth portions 154 so that when the cam follower 146 is shifted forwardly with rotation of the disc cam member 141, the flexible arcuate arms 150 will pivot the mouth portions 154 toward one another to their closed position, and when the follower 146 is shifted rearwardly by rotation of the cam member 141, the arms 150 will pull the mouth portions for pivoting them away from each other to their open position with the pivoting occurring in a plane perpendicular to the shaft 56. In addition, the flexible nature of the arms 150 provides enough give so that the mouth portions 154 can be shifted open and closed from the other of their open and closed positions regardless of the position of the follower 146, such as by a child trying to reach the tongue 160 when the mouth portions 154 are closed.

Figure 34:
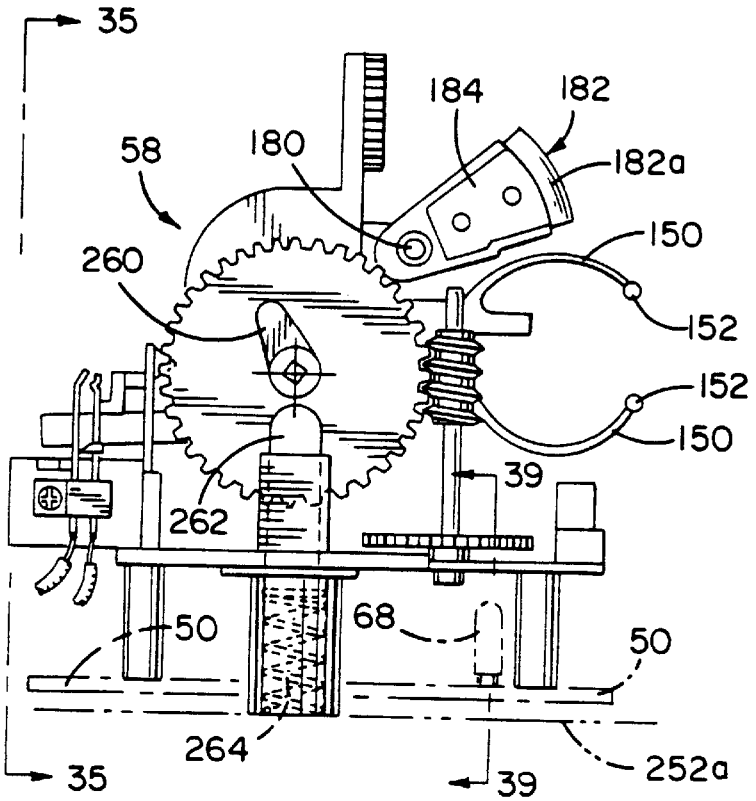
FIG. 34 is a view taken along line 34—34 of FIG. 15 showing a cam mechanism for the foot portion.

Continuing with reference to FIGS. 25–27 and FIG. 36, the eye assembly 34 has cam mechanism 168 associated therewith and which includes a disc-shaped cam member 170 having an arcuate slot 172 formed on one side thereof as defined by slot walls 174. The cam member 170 is fixed on shaft 56 for rotation therewith and spaced from the cam member 141 along shaft 56 by disc spacer 171. A cam follower 176 includes a pin 178 projecting therefrom and into the slot 172 for engagement with cam surfaces 174*a* on the slot walls 174. The cam follower 176 is pivotally mounted to the lower end of the frame vertical extension 94 via pivot pin 180. Thus, as the control shaft 56 is rotated, the cam member 170 rotates to cause pivoting of the follower 176. A bearing member 182 is clamped into a recess on upwardly angled main body 176*a* of the follower 176 by a clamping plate 184, as best seen in FIG. 34. The follower 176, and in particular main bearing body 176*a* thereof, projects forwardly and upwardly from the shaft 56 perpendicular to the axis thereof toward the eyelid member 136.

The bearing 182 is preferably made of a resilient material such as rubber and includes an arcuate portion 182*a* projecting forwardly from the front of the follower 176 and into rolling engagement with the annular surface of the bearing portion 140 of the eyelid member 136 for pivoting thereof about the shaft 134 in a plane perpendicular to the shaft 56 as the cam follower 176 is pivoted with rotation of the cam member 170. Pivoting of the eyelids 138 over associated eyeballs 130 allows the toy 10 to be shifted between sleeping and waking states in conjunction with other predetermined movements of other body parts 12, as discussed hereinafter, and also to provide for blinking of the eyes of the toy 10. The rubber bearing 182 also provides a friction clutch so that there can be a slip between the bearing 182 and eyelid member portion 140 so that the eyelids 138 can be shifted by a child from one of their open and closed positions to the other regardless of the position of the follower 176.

Thus, the cam mechanisms 58 include followers or actuator linkages operated thereby that provide for arcuate movements of the body parts 12 to more closely simulate the movements of actual body parts. The linkages cause arcuate or pivotal movements of the eyelids 138 and mouth portions 152 and 154 in planes that are substantially parallel to each other with the arcuate or pivotal movement of the ear shafts 92 occurring in a plane that is transverse, and preferably perpendicular, to the planes in which the eyelids and mouth portions pivot.

As previously discussed, the controller 1000 utilizes inputs from the toy sensors 14 for activating the motor 16 to generate rotation of the shaft 56 in a precisely controlled manner for generating correspondingly precisely controlled movements of the toy body parts 12. The toy includes sensors 14 to detect motion of and along its body, such as by rubbing, petting or depressing on external hide 186 attached about body 18 at predetermined positions thereon, and predetermined auditory and lighting conditions. The hide 186 covers the front and rear sensor actuators 188 and 214, and apertures 48*a* in the housing half 22 for the audio sensor 48. The hide 186 includes ear portions 186*a* and 186*b* for fitting over the ear shafts 92 and is sewn to the face plate 122 about its periphery which is, in turn, glued or otherwise attached to the housing 20 in the face opening 120 thereof. The bottom of the hide 186 includes looped material through which a plastic draw member 187 is inserted and tightly drawn for seating in lower annular groove 189 formed around the bottom of the housing 20.

More specifically, the front sensor assembly 42 includes an apertured disc actuator 188 having an upper arm portion 190 attached to speaker grill 192, as best seen in FIGS. 18–21. The speaker grill 192 and speaker 194 are fixed to a bracket 196 which, in turn, is rigidly mounted to the toy body 18 by way of laterally aligned internal bosses 198 on either housing half 22 and 24. The disc actuator 188 is preferably of a plastic material and the arm portion 190 thereof spaces the disc 188 forwardly of the speaker grill 192 and allows the disc 188 to be flexibly and resiliently shifted or pushed back toward the speaker grill 192.

Contacts 200 and 202 of a leaf spring switch are mounted between the disc actuator 188 and the speaker grill 192 with contact strip 200 fixed at its upper end between the arm 190 and the grill 192 and depending down to an abutment portion 204 projecting from the rear of the disc actuator 188, and in alignment with contact strip 202 extending laterally across the lower portion of the speaker grill 192 and affixed thereto. Thus, depressing the disc actuator 188 as by pushing or rubbing on the hide 186 thereover causes the abutment portion 204 to engage the free end of the contact strip 200 for resiliently shifting it into engagement with strip 202 which signals the processor 1000. As the speaker grill 192 is mounted in a lower opening 206 formed when the housing halves 22 and 24 are connected at the front of the body 18 centered below the opening 120 of the toy facial area, actuating the front sensor assembly 22 can simulate tickling of the toy 10 in its belly region.

Figure 22:
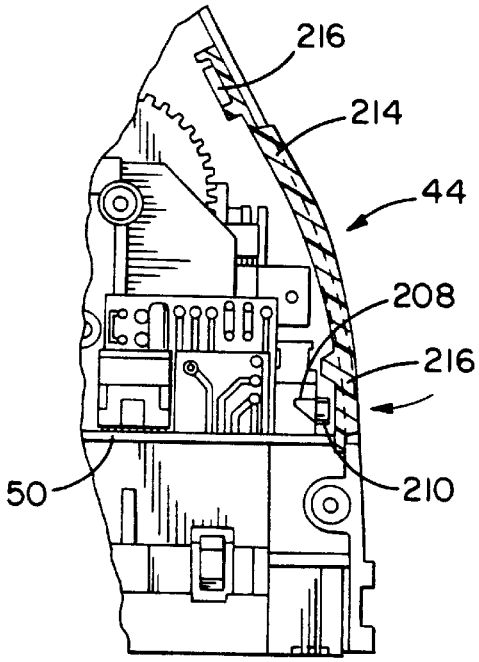
FIG. 22 is an elevational view partially in section of an actuator for the rear switch.
Figure 23:
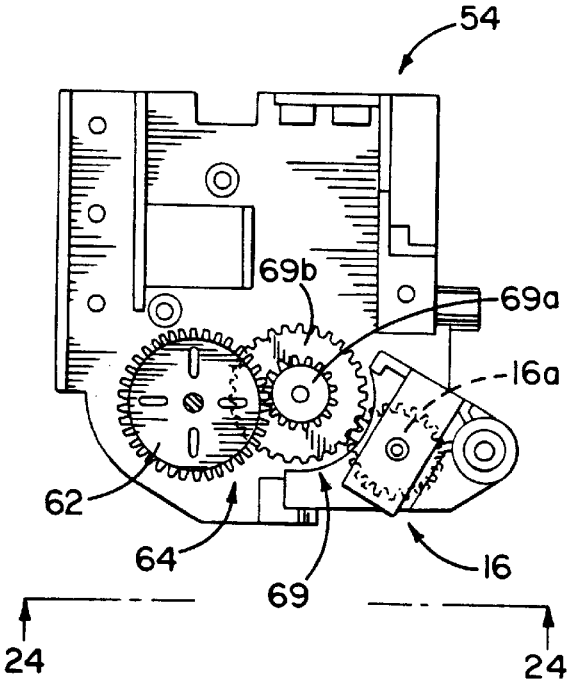
FIG. 23 is a view taken along line 23—23 of FIG. 15 showing a harness with a motor and the transmission system therefor mounted thereto.
Figure 24:
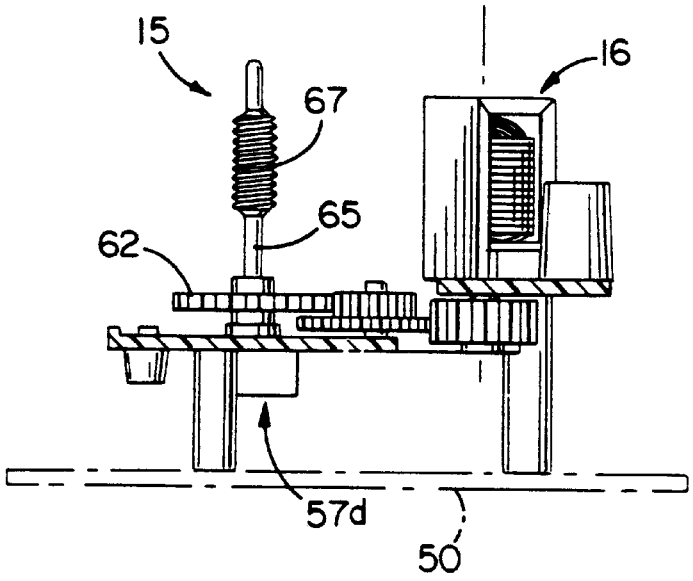
FIG. 24 is a view taken along line 24—24 of FIG. 23.

Referring to FIG. 22, the rear sensor assembly 44 includes a microswitch 208 mounted to circuit board 50 and having a plunger 210 projecting rearwardly therefrom, as is known. A rear switch actuator 212 is mounted in rear slot opening 214 formed when the housing halves 22 and 24 are connected. The actuator 212 has an elongate slightly arcuate shape to conform to the curvature of the rear of the toy body 18 and is captured in the body interior 19 at its upper end by lateral tabs 216 for pivoting thereabout and including a lower plunger engaging portion 216 thereof so that when the actuator 212 is pivoted as by pushing or rubbing on the hide 186 thereover, it will depress the plunger 210 causing the switch 208 to signal the processor 1000. With the position of the rear sensor assembly 44 at the back side of the toy body 18, actuation of the switch 208 can simulate petting of the toy 10 along its back.

Referring next to FIGS. 40–42, the tilt switch 49 will be described. As shown, the tilt switch 49 is mounted to the circuit board 50 and includes a generally cylindrical housing 218 having a bottom number 220 with a central opening 222 therein. An actuator ball 224 is disposed in the housing 218 and has a diameter sized so that when the toy 10 is at rest on a horizontal surface, a lower portion of the ball will fit through the opening 222. Thus, the opening 222 provides a seat for the ball 224 so that it remains at rest in a lower chamber 226 of the housing as defined by the bottom member 220 and an intermediate contact member 228. The contact member 228 has a hexagonal hole 230 formed therein which is larger then lower opening 222 so that the ball 224 normally is spaced from the edges of the intermediate contact member 228 about the hole 230. However, when the toy 10 is tilted such as through a predetermined angular range, the ball 224 will roll from the seat provided by the bottom member 220 and into engagement with the intermediate member 228 which signals the controller 1000. Shaking the toy 10 can also unseat the ball 224 sufficiently for it to make contact with member 228. Further, if the toy 10 is tilted sufficiently far so that its upper end 28 is below its lower end 30, the ball 224 will fit through the opening 230 with a portion thereof extending into an upper chamber 231 defined between the intermediate contact member 228 and an upper contact member 232 bounded by ring spacer 233. With the toy tilted so that it is upside down, the ball 224 can project sufficiently far through the opening 230 so that it is in engagement with the contact member 232 which will provide another signal to the controller 1000. The housing 218 is closed at its top by an upper cap member 234.

The audio sensor 48 is in the form of a microphone 236 mounted in cylindrical portion 238 formed on the interior of housing half 22 and projecting laterally therein, as best seen in FIG. 11. The light sensor and IR link assembly 47 is mounted behind opaque panel 240 attached to the face frame 118 between the eye openings 124 thereof. Referring to FIG. 25, the light sensor portion 242 of the assembly 47 is mounted between an IR transmitter elements 244 and an IR receiver element 246 on either side thereof. Together the element 244 and 246 form the IR link to allow communication between a plurality of toys 10.

Referring to FIGS. 27–29, the tongue sensor assembly 46 is illustrated. As previously discussed, the tongue sensor assembly 46 includes a tongue member 160 that has an actuator portion 164 that projects rearwardly from annular portion 162 which pivots about pivot shaft 156. The switch actuator portion 164 extends further in the rearward direction than the forward tongue portion 160 and is designed so that normally the switch actuator portion 164 is in its lower position and the tongue portion 160 is raised. A microswitch 248 is mounted to frame 54 and includes a pivotal member 250 projecting therefrom which is disposed over a lower portion 164*a* of the switch actuator 164. Accordingly, depressing the tongue portion 160 pivots the switch actuator 164, and in particular portion 164*a* thereof upwardly into engagement with the switch member 250 so as to pivot it upwardly for actuating the switch 248 and signalling the controller 1000. As the sensor assembly 46 is disposed in the mouth area, activation of the switch 248 can simulate feeding the toy 10.

The toy 10 also includes a foot portion 40 that is movable relative to the toy body 18 which allows it to rock back and forth and, if done repetitively, give the appearance that the toy 10 is dancing. The lower foot portion 40 includes battery compartment 252 which is secured to base member 254 which has upstanding mounting members 256 laterally spaced from each other in front of the battery compartment. The bracket 196 is attached to the foot portion 40 via pins 258 for pivotally pinning depending side portions 260 of the bracket member 196 to the base mounting members 256 for allowing pivoting of the foot portion 40 relative to the remainder of the toy 10.

Cam mechanism 258 is associated with the foot portion 40. Referring to FIGS. 34 and 37, the cam mechanism 258 includes an eccentric member 260 of the gear cam member 76 on the side opposite that having the arcuate slot 78 thereon. A cam follower 262 is biased upwardly by spring 264 so as to project from a substantially cylindrical housing 266 therefor. The spring 264 is seated at its lower end on top surface 252*a* of the battery compartment. The housing 266 projects through aligned openings of the printed circuit board 50 and the frame 54. Thus, when the control shaft 56 is rotated, the eccentric member 260 will come into camming engagement with the follower 262 to depress the follower 262 into the housing 266 against the bias of the spring 264 causing the body 18 of the toy 10 less the foot portion 40 thereof to pivot upwardly and forwardly, as can be seen in FIGS. 37 and 38. For guiding the pivoting movement, the base 254 includes a rear wall 270 having vertical recessed guide tracks 272 formed therein, as best seen in FIGS. 15 and 38. Each of the housing halves 22 and 24 include tabs 274 at the bottom and rear thereof which ride in tracks 272 and are limited by stops 276 formed on the wall 270 at the upper end of the tracks 272 so as to define the forwardmost pivoted position of the toy body 18 relative to the foot portion 40.

As previously stated, the cam surfaces of the cam mechanisms 58 herein are provided with precise predetermined shapes which is coordinated with the programming of the processor 1000 so that at every point of the cam surfaces, the processor 1000 knows the position of the moving body parts 14 associated therewith. In this manner, the toy 10 can be provided with a number of different expressions to simulate different predetermined physical and emotional states. For instance, when the shaft 56 is in its 7 o'clock position as looking down the shaft 56 in a direction from cam gear wheel 76 to the other end of the shaft and disc cam member 170 as in FIGS. 55–59, the toy 10 will be in its sleeping state with its eyelids and mouth closed and its ears down and the body 18 leaning forward. In the waking position depicted in FIGS. 60–64, the shaft is somewhere between the 11 and 12 o'clock positions and the eyelids are half open, the mouth is open and the ears are up at a forty-five degree position with the body tipped downwardly.

A neutral position is provided as shown in FIGS. 65–68 which is the 1 o'clock position of the control shaft 56 where the eyes are open, the mouth is closed and the ears are up at a forty-five degree angle. In addition, the disc cam member 141 includes a projection 266 on its periphery so that at the neutral position, the projection 266 actuates a leaf spring switch 268 of the initialization switch assembly 72 so as to zero the count in the control circuitry. 1000 of the position of the motor 16. In FIGS. 69–73 which corresponds to approximately the two o'clock to three o'clock position of the shaft 54, the toy 10 is provided with an excited state where the eyelids are open and the mouth is pivoted open and closed and the ears are up.

An additional advantage provided by the neutral position is that the mouth is closed thereat and open on either side thereof. Despite the fact that the toy 10 herein preferably employs a reversible motor 16, it is not desirable to have to undergo reverse rotations of the shaft 56 every time the toy generates a two syllable sound or word for power conservation purposes. In this regard, because the mouth is open on either side of the neutral position, a two syllable word can be generated by rotating the shaft 56 in one direction so as to sweep the neutral position so that the mouth opens, closes and opens again for forming the two syllable sound/word without necessitating reversal of the motor 16 for reverse rotation of the shaft 56 and the attendant power consumption thereby.

However, the fact that the motor 16 is reversible does provide the toy 10 herein with much more life-like movement of its body parts 12 as particular movements can be repeated in back and forth directions as precisely controlled by the processor 1000 in cooperation with the programmed cam surfaces causing the shaft 56 to move to predetermined positions thereof where it knows exactly what types of movements the parts will undertake thereat. Thus, if it is desired to make a part undergo back and forth movements, the controller can instruct the shaft 56 to rotate in both directions through an active region on the associated cam in both directions for full back and forth movement of the part; or, the controller can instruct the shaft 56 to go to another active region on the cam that does not make the part go through its entire range of movement and instead only go through a portion of its full range, or to some predetermined position in the full range of motion active region where the shaft can be rotated in both directions to provide specific ranges of back and forth part movement within the part's full range of motion. In this manner, the parts 12 herein can be made to undergo non-cyclic types of movements which do not simply repeat upon rotating the shaft 56 in a single direction such as found in many prior toys.

For programming of the cam surfaces so as to provide the body parts 12 with highly synchronized and coordinated relative movements, modeling of the toy's different states based on puppeteering actions required to achieve these positions of body parts can be utilized. Puppeteers use a resting position from which they generate their hand movements to make corresponding puppet parts move and progressions of such movements. Accordingly, for generating toy movements, the neutral position shown in FIGS. 65–68 of the shaft 56 and cam members 76, 141 and 170 is utilized as a starting point in programming of the movements of the parts 12 similar to the resting position puppeteers use; and because the neutral position is generally the position that is most regularly reached and/or traversed during movements of the toy body parts 12, the cam 141 is designed so that at the neutral position, the projection 266 thereof actuates the leaf spring switch 268 (FIG. 66) to zero out the count for the motor 16 on a regular basis. In this manner, the position of the shaft 56 will not become too out of synchronization with the position the controller 1000 thinks it is at when it is driven by the motor 16 and gear train transmission 64 as controlled by processor 1000 before the count in the processor is zeroed to provide for recurrent and regular calibration of the position of the shaft 56.

From the neutral position, the controller 1000 knows exactly how far the shaft 56 has to be rotated and in which direction to cause certain coordinated movements of the parts, and precise movements of individual parts. In this regard, the cams are provided with cam surfaces that have active regions and inactive regions so that in the active regions, the part associated with the particular cam is undergoing movement, and in the inactive region the part is stationary.

Figure 55:
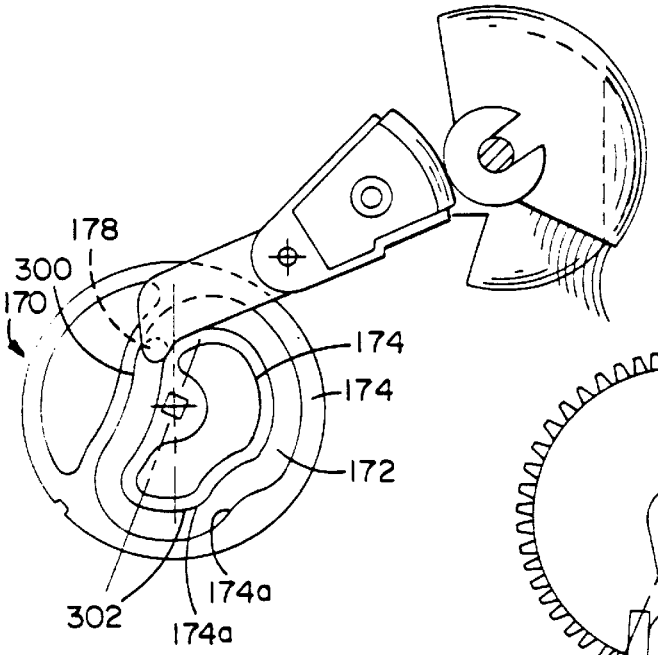
FIGS. 55–59 are views of the body parts and associated cam mechanisms with the body parts in predetermined coordinated positions to provide the toy with a sleeping state.
Figure 59:
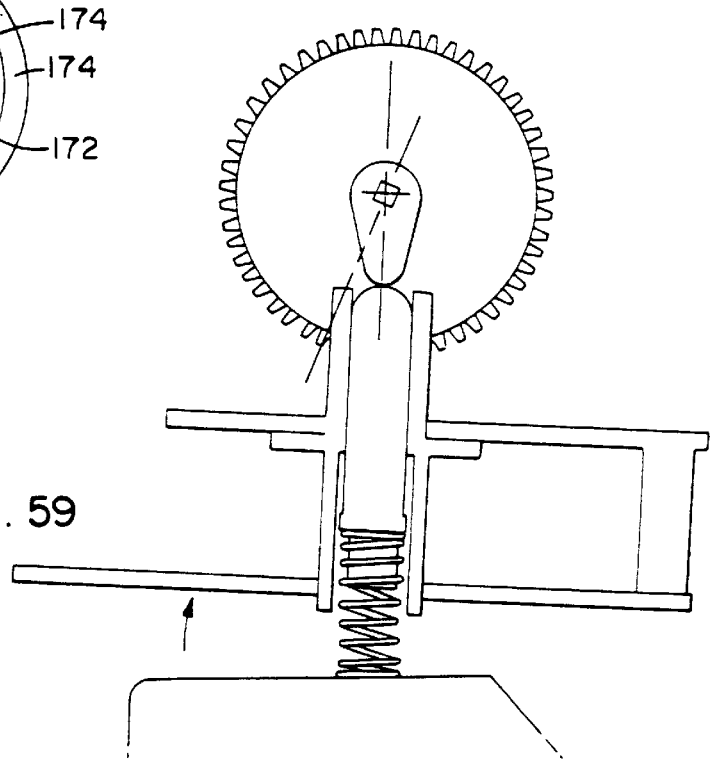
Figure 65:
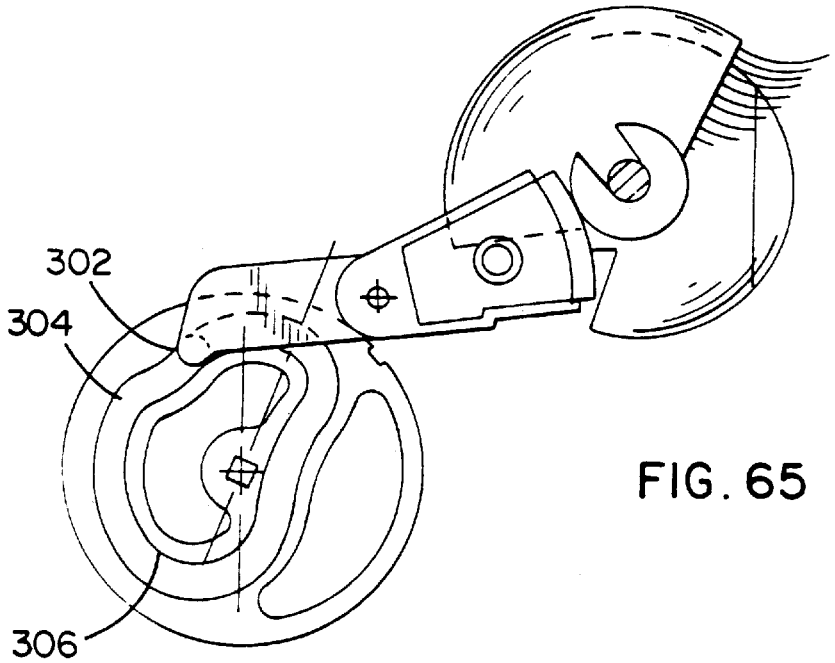
FIGS. 65–68 are views of the body parts and associated cam mechanisms with the body parts in predetermined coordinated positions to provide the toy with a neutral position.

Thus, for moving the eyelid member 136 through its entire range of motion, the shaft 56 is rotated clockwise from between the 7:00 position of FIG. 55 at point 300 along the cam surfaces 174*a* to the neutral 1:00 position of FIG. 65 at point 302 of the cam surfaces 174*a* so that the section between points 300 and 302 defines an active region of the cam surfaces 174*a*. Another active region is provided between point 302 at the neutral position and point 304 (FIG. 69) at approximately the position corresponding to the excited state where the walls 174 curve toward central axis of the cam 170 for providing a slight closing of the raised eyelids and then a reopening thereof to provide a fluttering effect as during the excited state of the toy.

The inactive region of the cam surfaces 174*a* is provided on a section of the walls 174 that maintains a substantially constant radius from the axis of the cam 170 such as between points 304 and 306 as with the other cams 76 and 141 as will be described herein so that there is little or no relative movement of the follower pin 178 relative to the cam axis as the pin 178 moves through the slot 172 between points 304 and 306.

Figure 56:
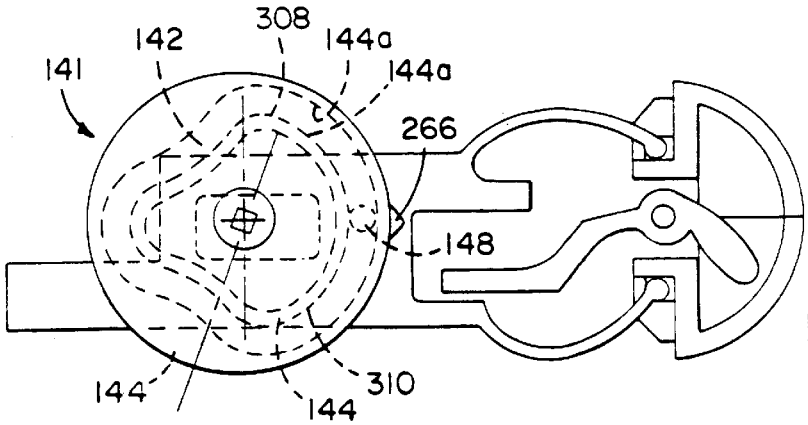

Similarly, the cam surfaces 144*a* of the mouth cam member 141 have an inactive region between points 308 and 310 where the walls 144 defining cam slot 142 maintain a substantially constant radius from the central axis of the cam 141. As shown in FIG. 56, at the 7:00 position where the toy 10 is in its sleeping state, the pin 148 of follower 146 is midway between points 308 and 310 in slot 142 with the mouth closed.

Figure 61A:
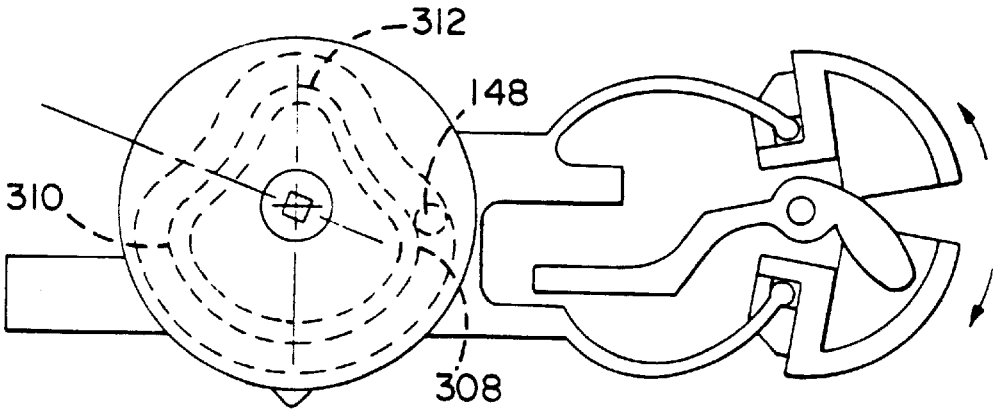
Figure 60B:
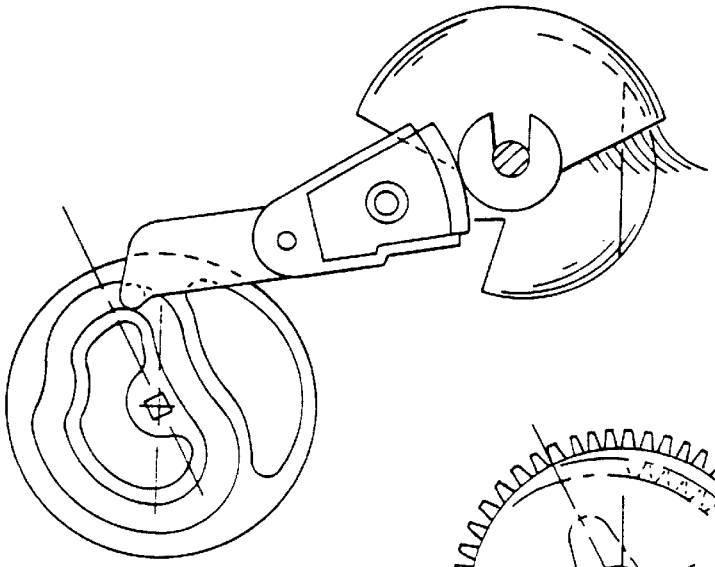
Figure 64:
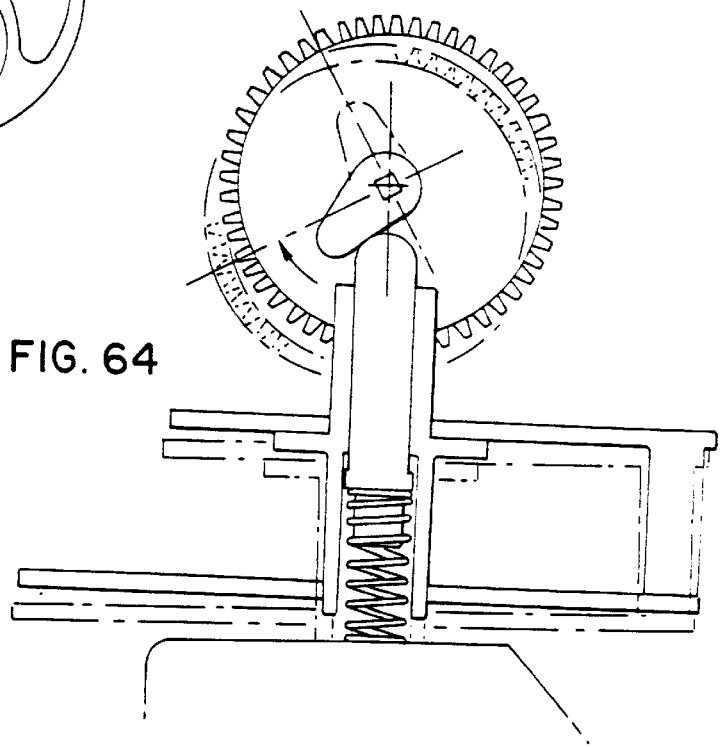
Figure 61B:
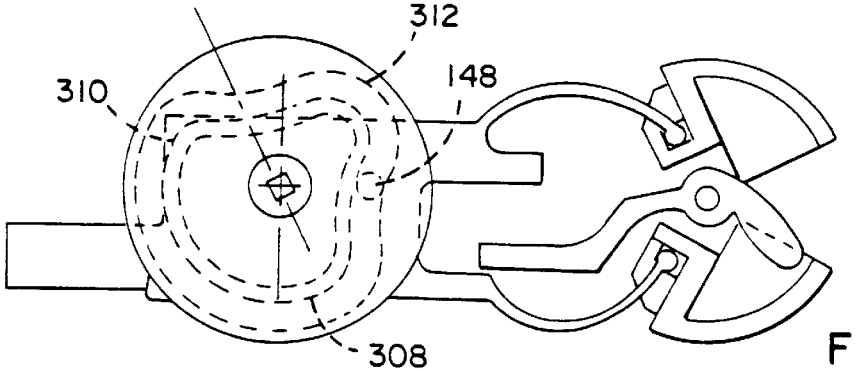
Figure 63:
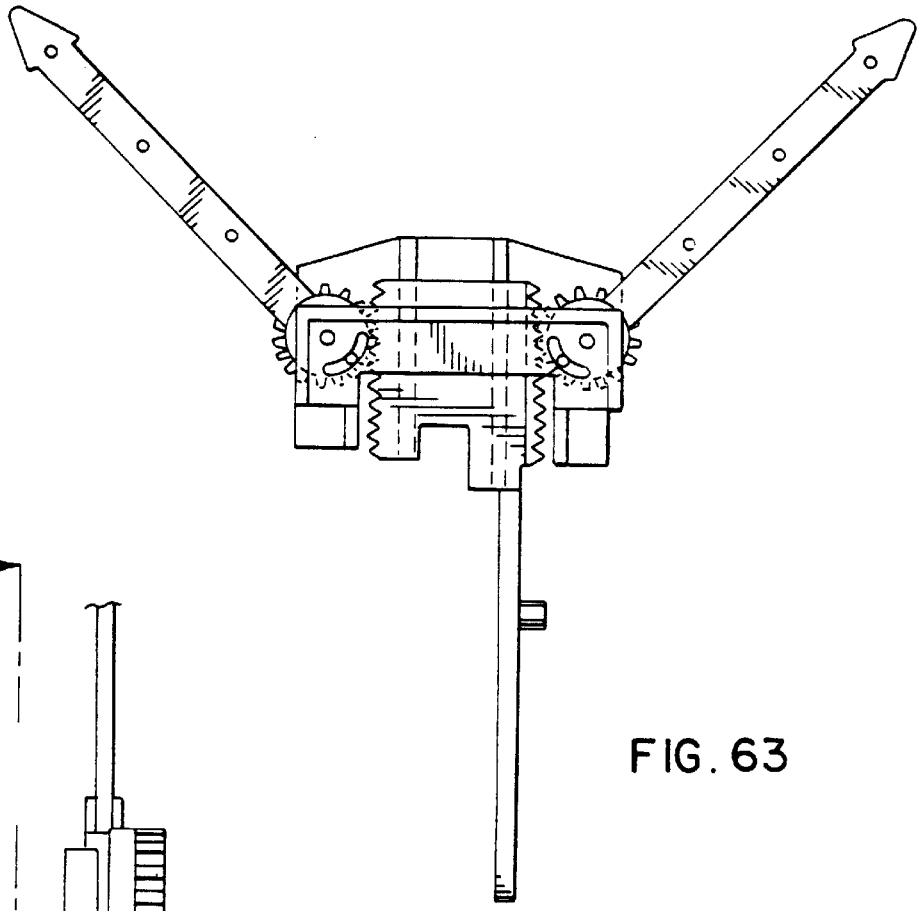
Figure 62:
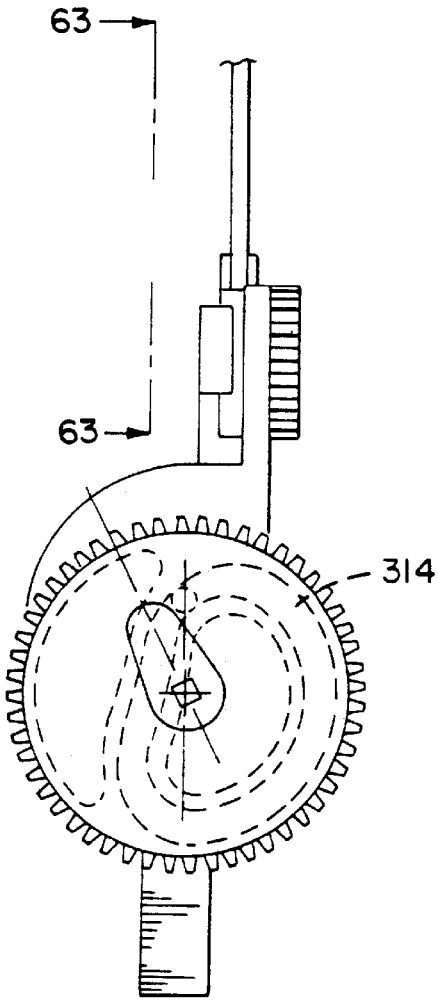
Figure 66:
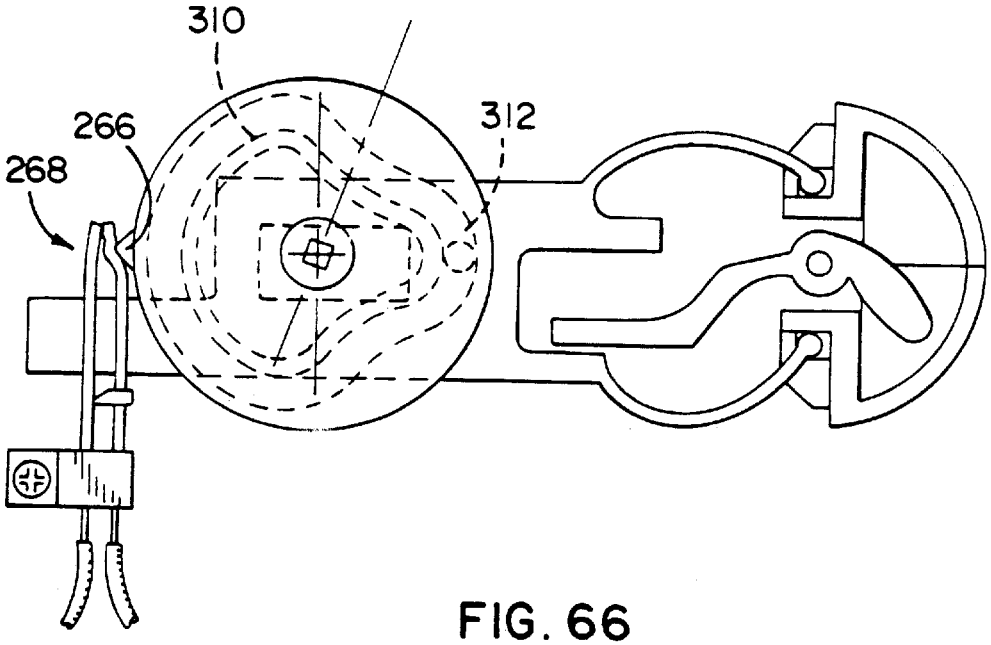
Figure 68:
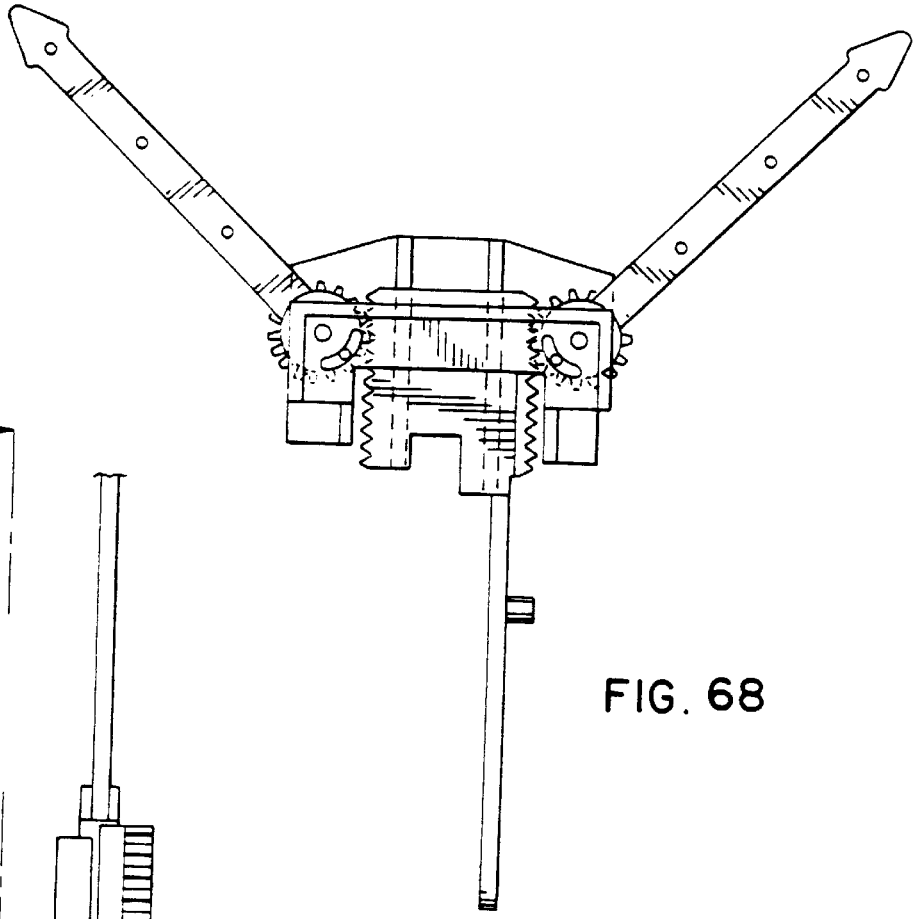
Figure 67:
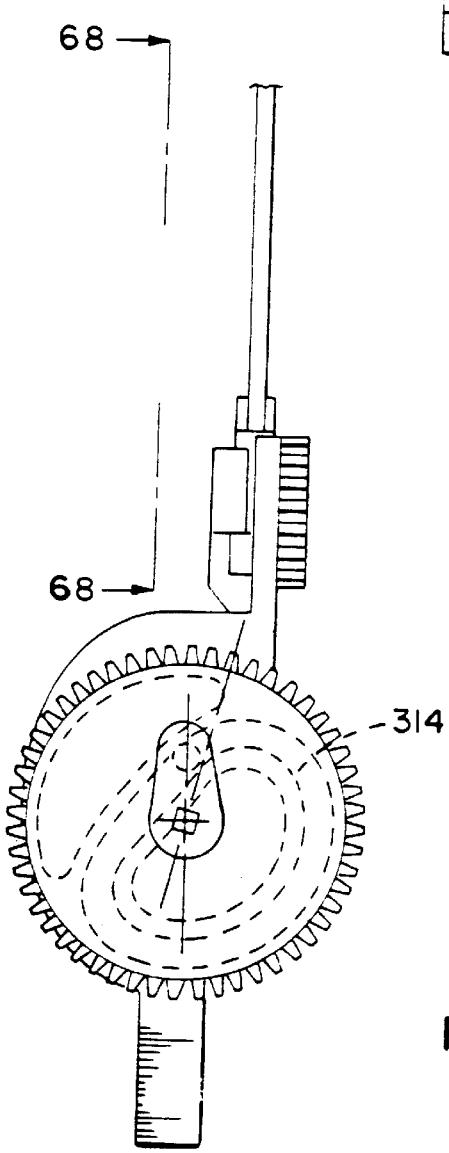
Figure 69:
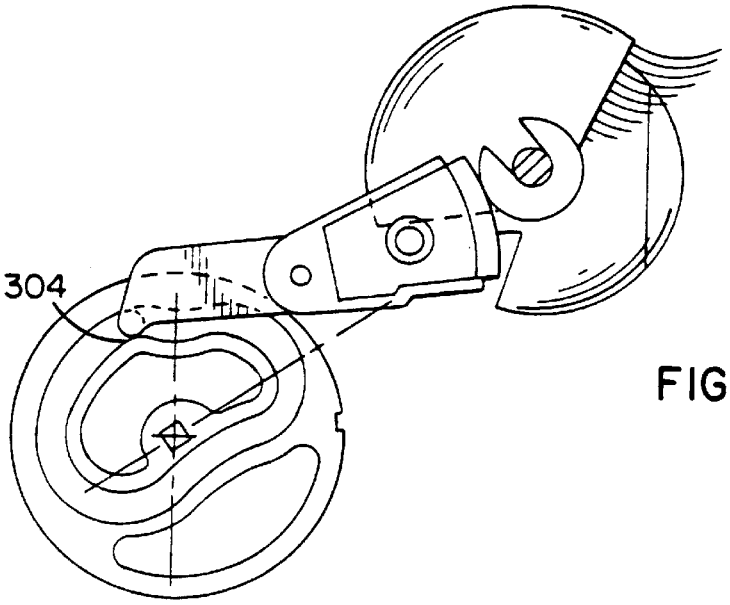
FIGS. 69–73 are views of the body parts and associated cam mechanisms in predetermined coordinated positions to provide the toy with an excited state.
Figure 70:
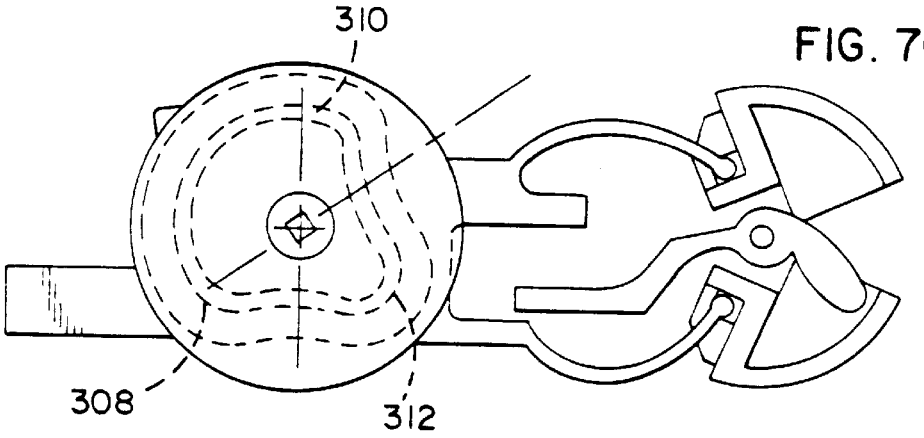
Figure 71:
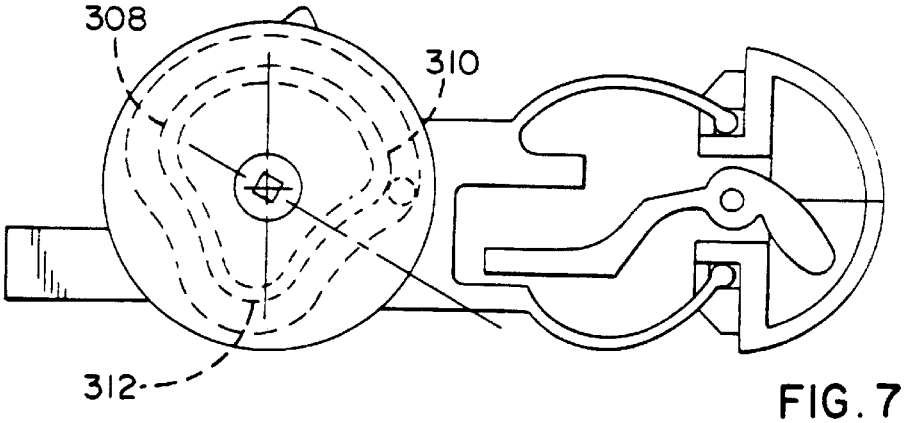
Figure 73:
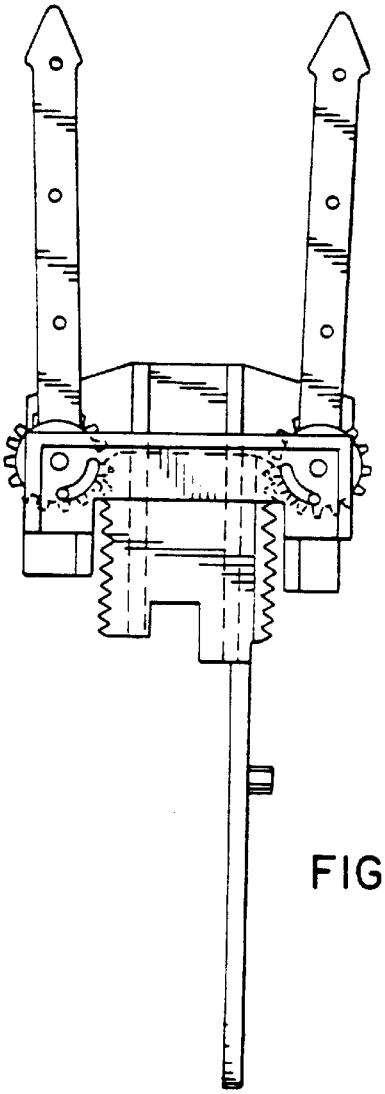
Figure 72:
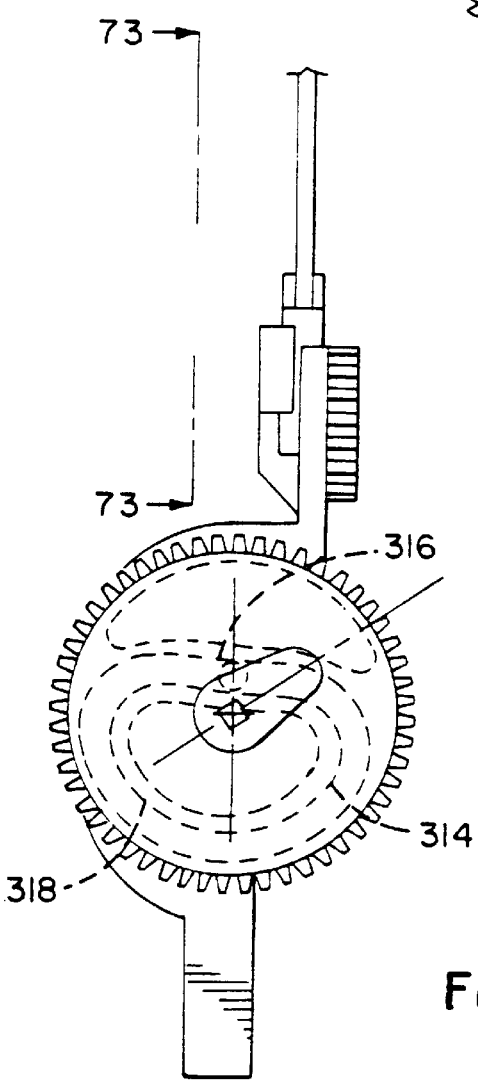

A first active region is provided along a predetermined section of the slot walls 144 between points 308 and 312 with the walls 144 slightly curving in toward the cam axis so that rotation of shaft 56 to approximately the 10:00 position shown in FIG. 61A causes pin 148 to move into this active region to make the mouth start to open. Continuing clockwise rotation of the shaft 56 with the pin 148 moving toward point 312 fully opens the mouth (FIG. 61B), and then as the walls 144 curve away from the cam axis, the mouth begins to close until it fully closes with the pin 148 at point 312 (FIG. 66). This corresponds to the neutral position with peripheral projection 266 on cam 141 actuating switch 168. A second active region is mirror image to the first active region between points 310 and 312 along slot walls 144 so that continued clockwise rotation of the shaft 56 past the 1:00 neutral position opens and then closes the mouth, as shown in FIGS. 70 and 71. As previously described, the symmetry of the active regions about the neutral position allows the mouth to form two syllables by moving from open to closed to open with a sweep of the neutral position and rotation of the shaft 56 in only one direction.

Figure 58:
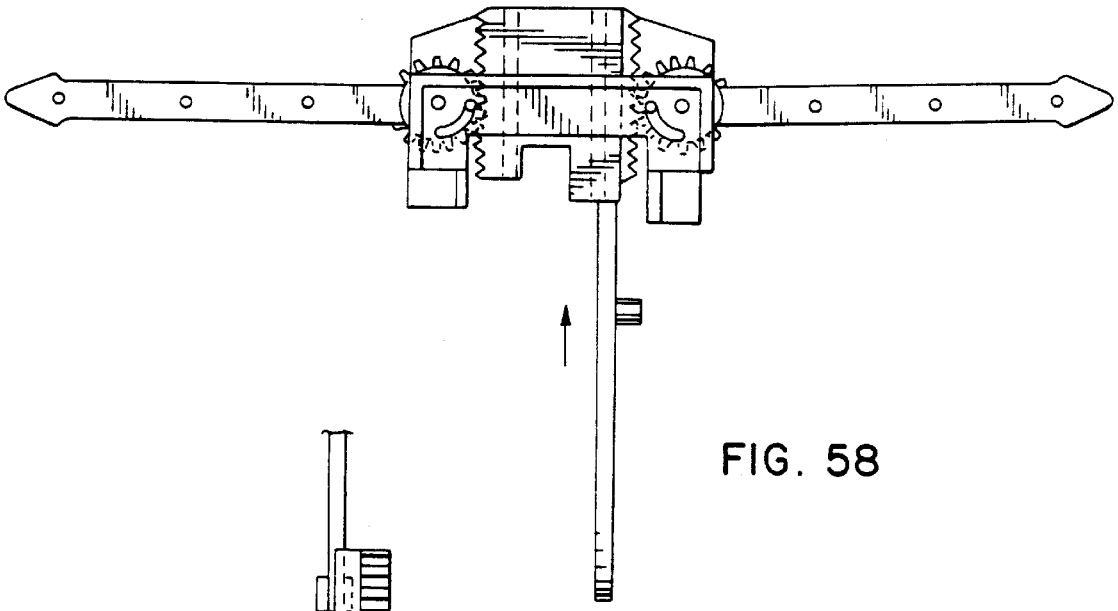
Figure 57:
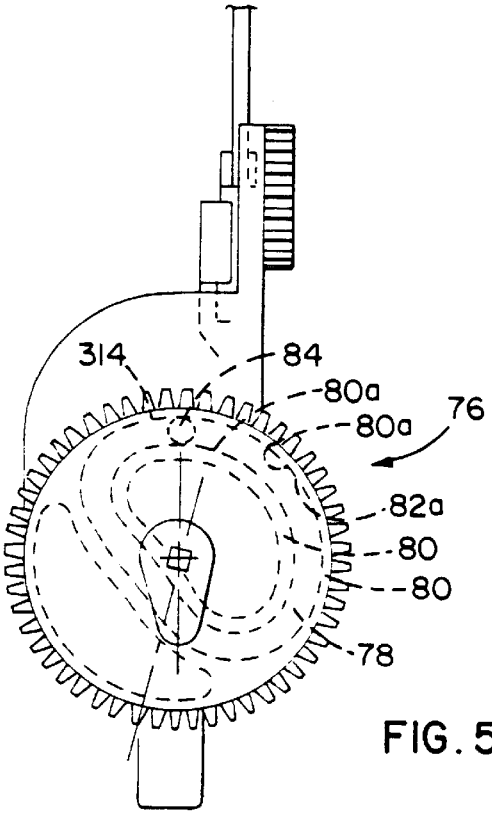
Figure 60A:
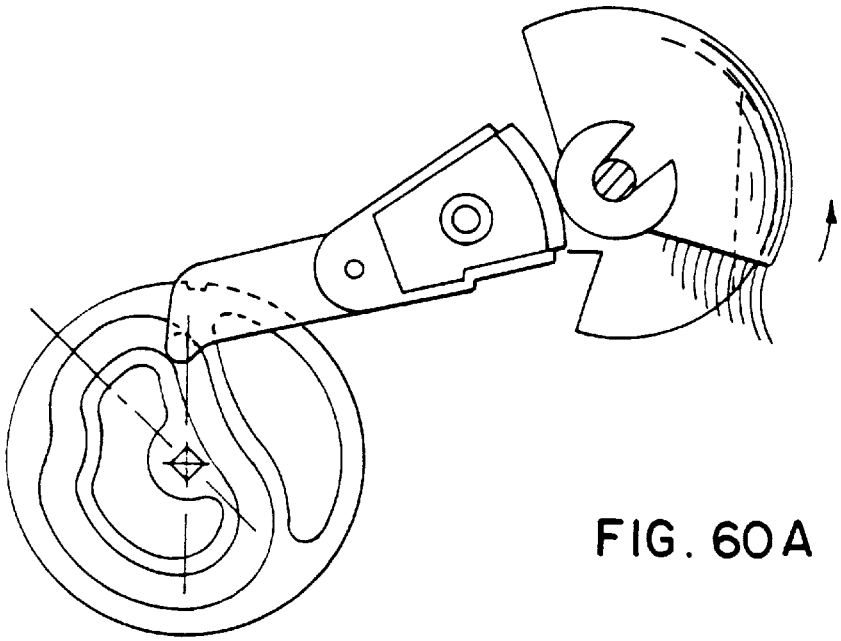
FIGS. 60–64 are views of the body parts and associated cam mechanisms in predetermined coordinated positions to provide the toy with a waking state.

The cam member 76 for moving the ears has an active region between points 314 and 316 along slot walls 80 to provide the full range of motion of the ear shafts 92. In FIG. 57, the pin 84 is at point 314 with the ear shafts 92 in their lowermost, horizontally extending position (FIG. 58). Clockwise rotation of the shaft 56 causes the pin 84 to move in slot 78 toward point 316 with the pin 84 moving closer to the central axis of the cam 76 drawing the follower 82 down to begin raising the ear shafts 92 until they reach their raised, vertically extending position, with this progression being illustrated in FIGS. 62, 63, 67, 68, 72 and 73. At point 316, the pin 84 is at its closest position to cam axis. Continued clockwise rotation of the shaft 56 past the 2:00 position and toward point 318 will cause the pin 84 in slot 78 to move toward point 318 away from cam axis until the ear shafts 92 are again at their lowermost position. The inactive region along slot walls 80 is between points 314 and 318 where they maintain a substantially constant radius from cam axis with the ears lowered and extending horizontally.

Figure 43:
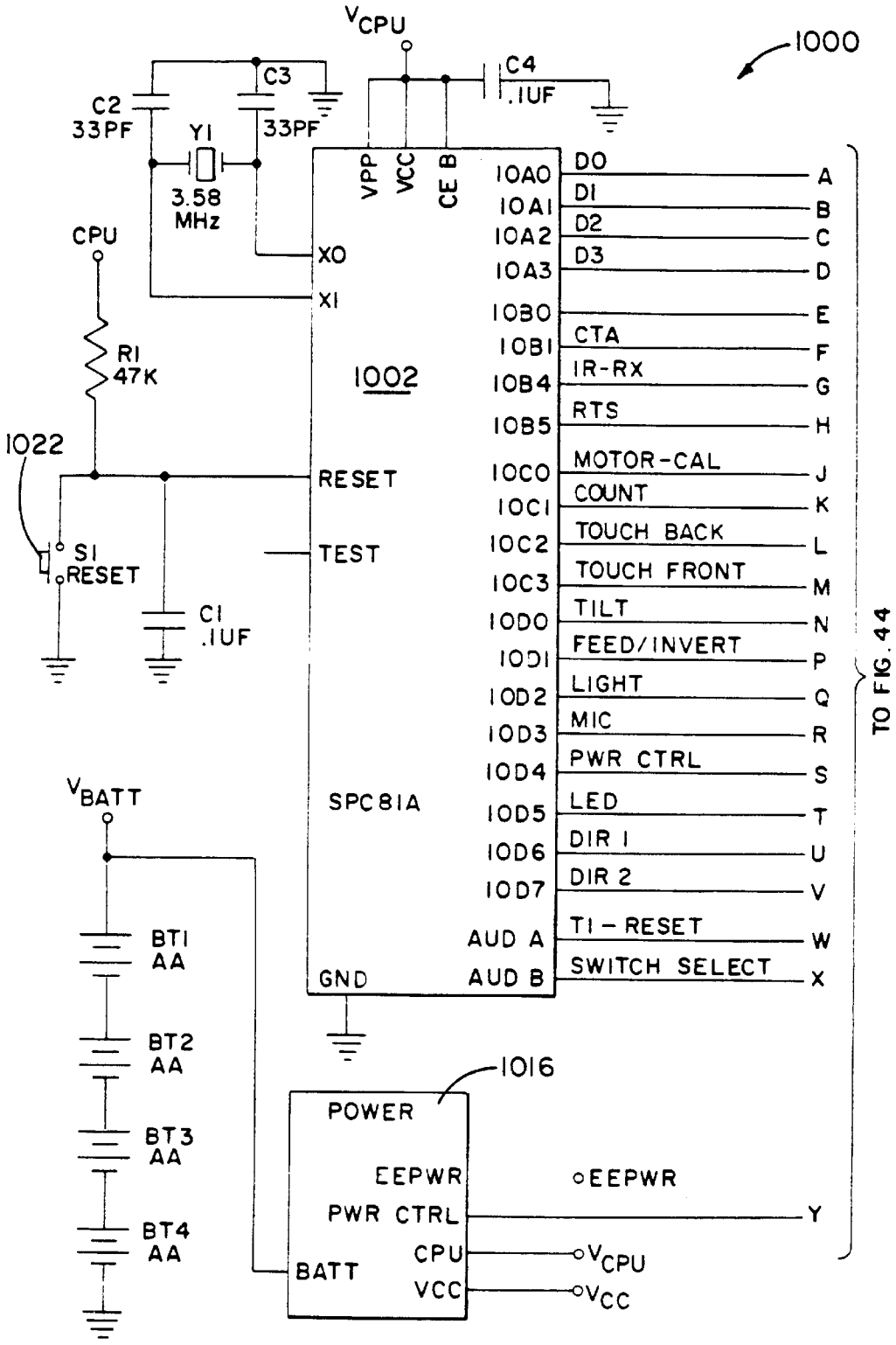
FIGS. 43 and 44 show a schematic block diagram of the embedded processor circuitry in accordance with the present invention.
Figure 44:
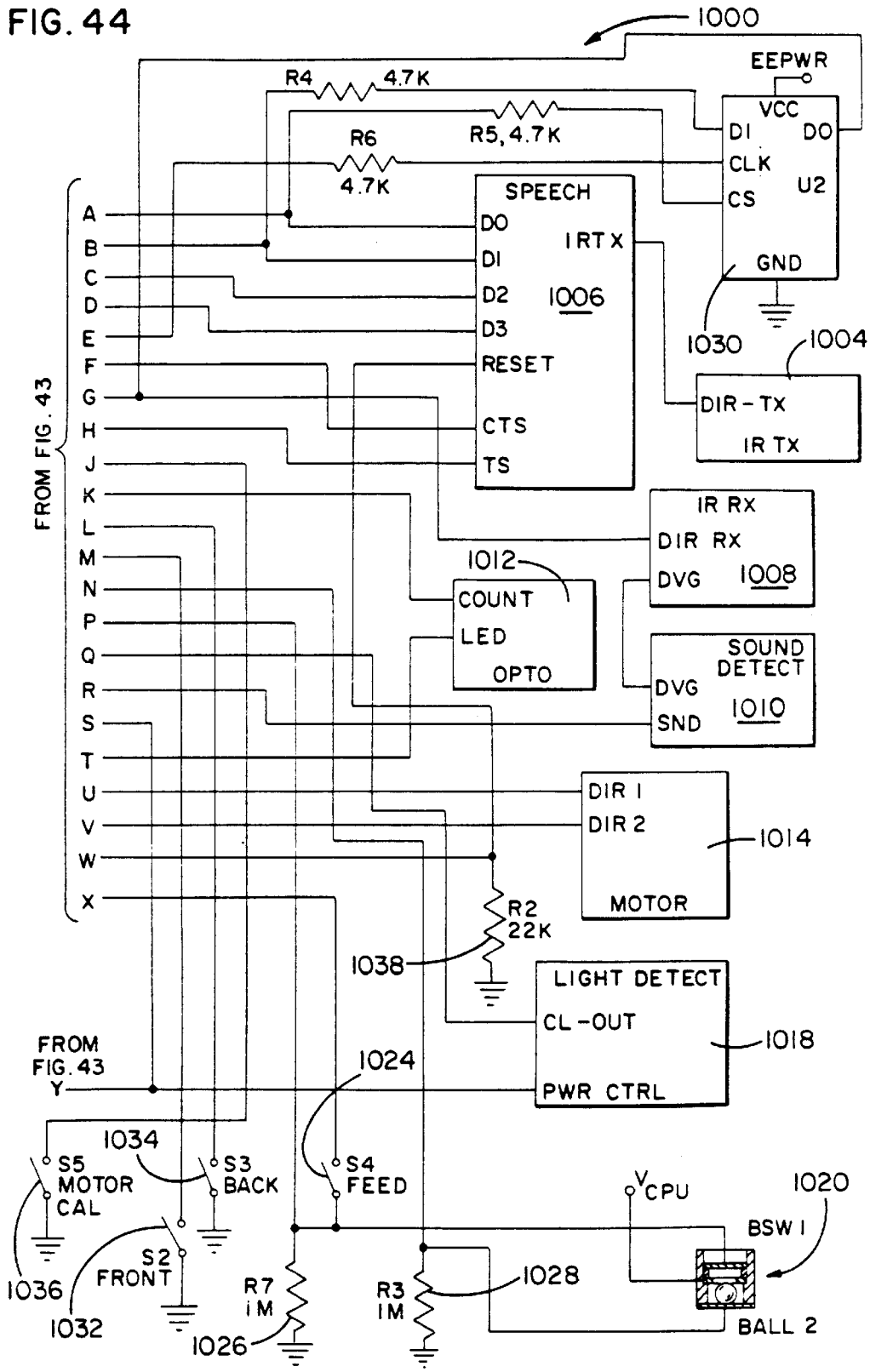

An embodiment of an embedded processor circuit for the interactive plaything is identified in FIGS. 43 and 44 as reference numeral 1000. FIGS. 43 and 44 show a schematic block diagram of the embedded processor circuitry in accordance with the present invention. As depicted, an information processor 1002 is provided as an 8-bit reduced instruction set computer (RISC) controller, herein the SunPlus SPC81A which is a CMOS integrated circuit providing the RISC processor with an 80 K byte program/data read only memory (ROM). The information processor 1002 provides various functional controls facilitated with on board static random access memory (SRAM), a timer/counter, input and output ports (I/O) as well as an audio current mode digital to analog converter (DAC). The two 8-bit current output DACs may also be used as output ports for generating signals for controlling various aspects of the circuitry 1000 as discussed further below. Other features provided by the SPC81A processor include 20 general I/O pins, four (4) interrupt sources, a key wake up function, and a clock stop mode for power saving which is employed to minimize the current draw from the batteries, BT1–BT4, herein four (4) type "AA" batteries used in the described interactive plaything.

Figures 45, 46:
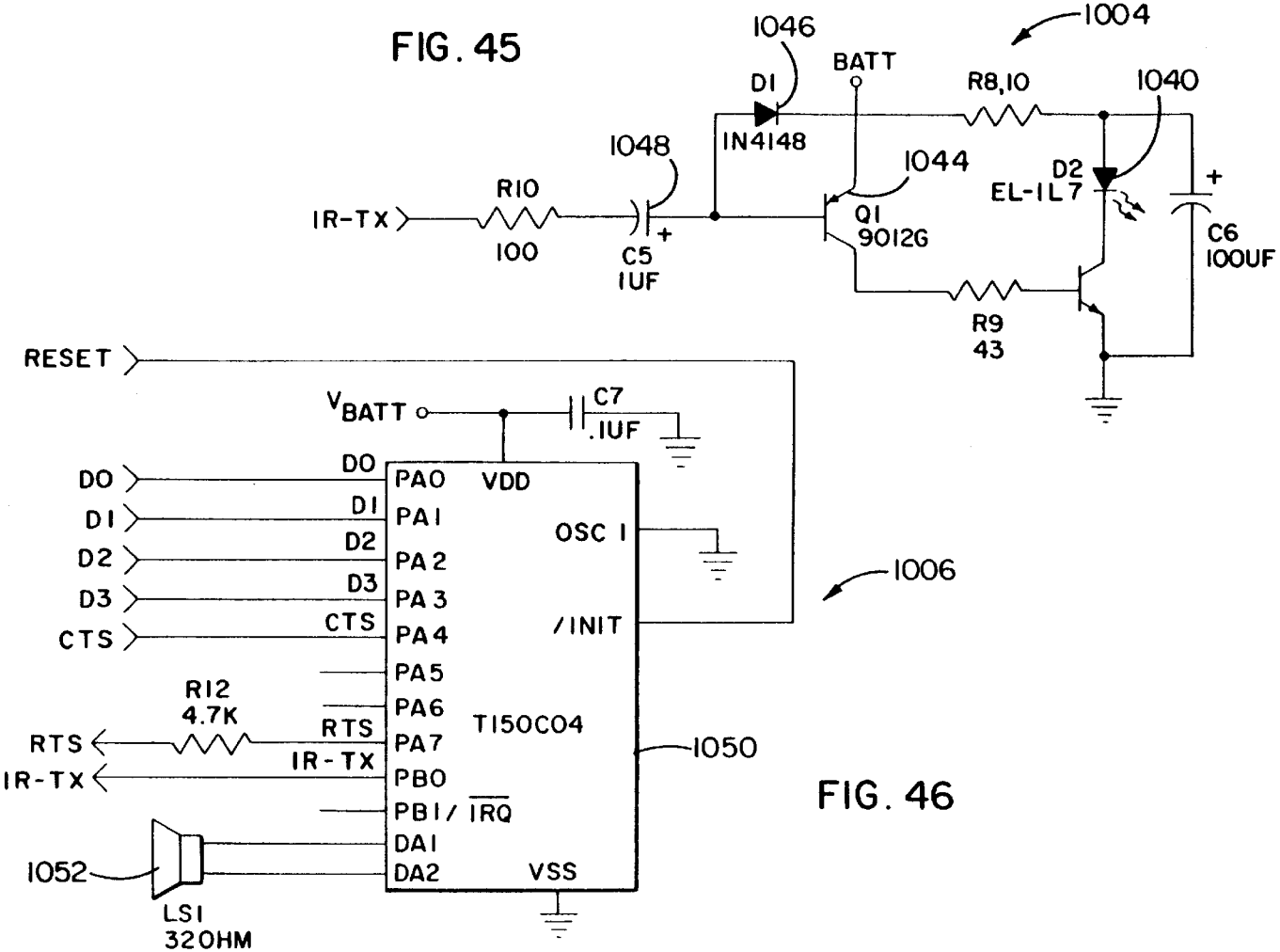
FIG. 45 is a schematic diagram of the infrared (IR) transmission circuitry.
FIG. 46 is a schematic diagram of the co-processor and audible speech synthesis circuitry.
Figure 47:
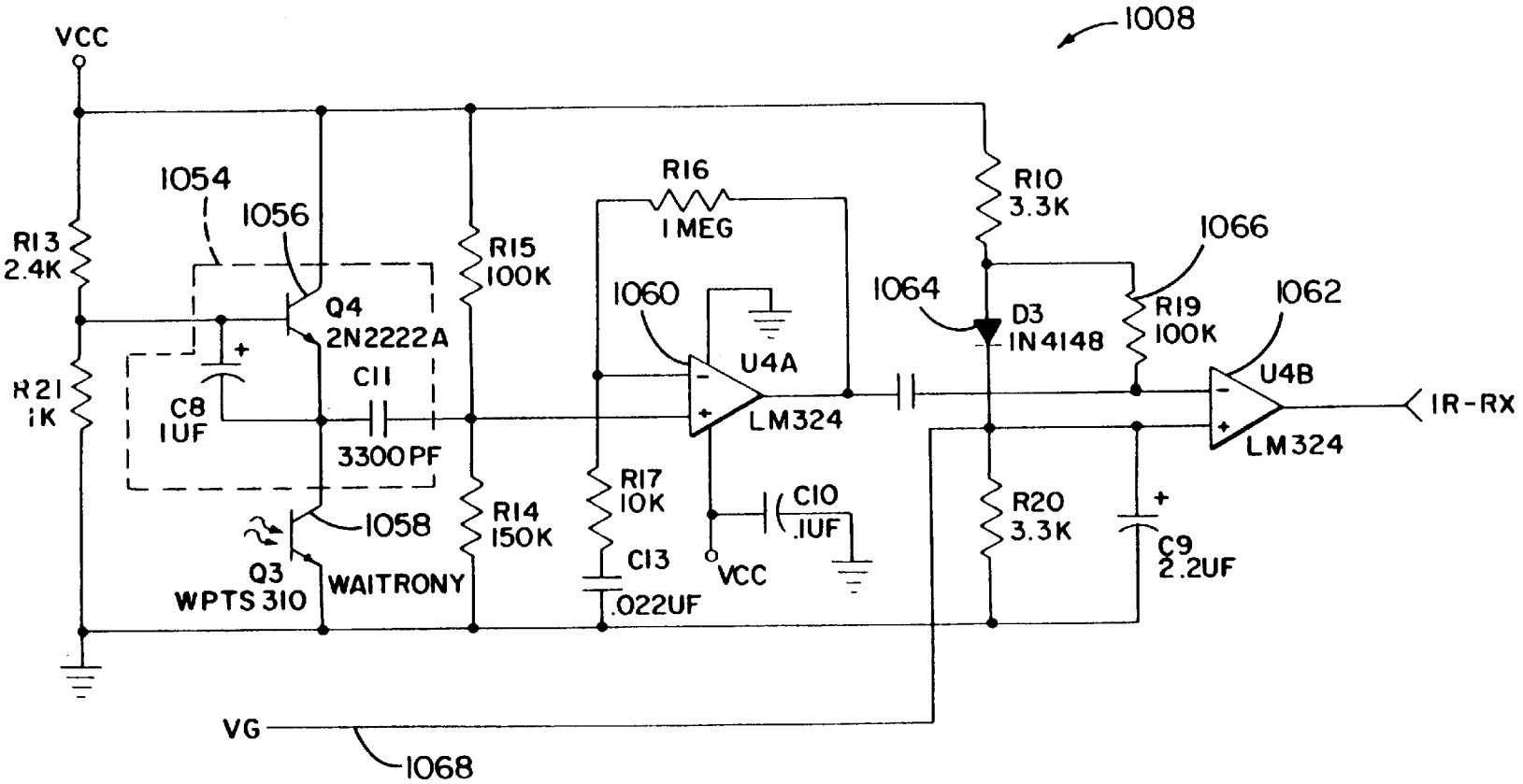
FIG. 47 is a schematic diagram of the IR signal filtering and receiving circuitry.
Figure 48:
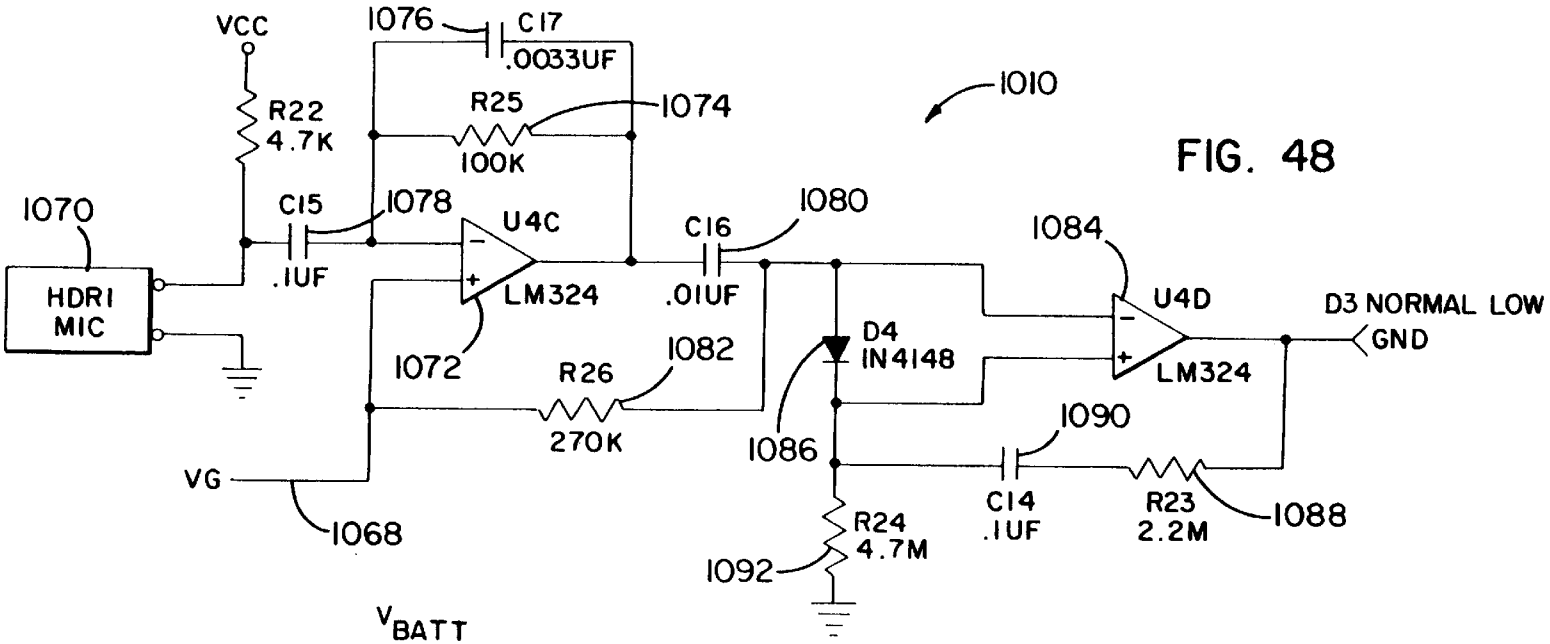
FIG. 48 is a schematic diagram of the sound detection circuitry.
Figure 49:
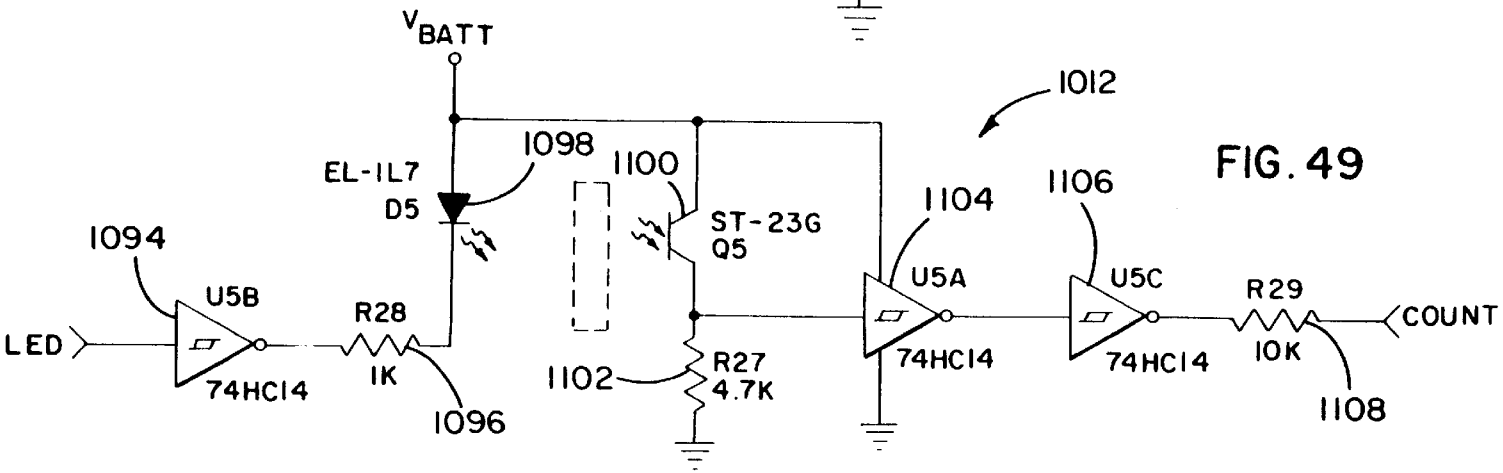
FIG. 49 is a schematic diagram of the optical servo control circuitry for controlling the operation of the motor.
Figure 50:
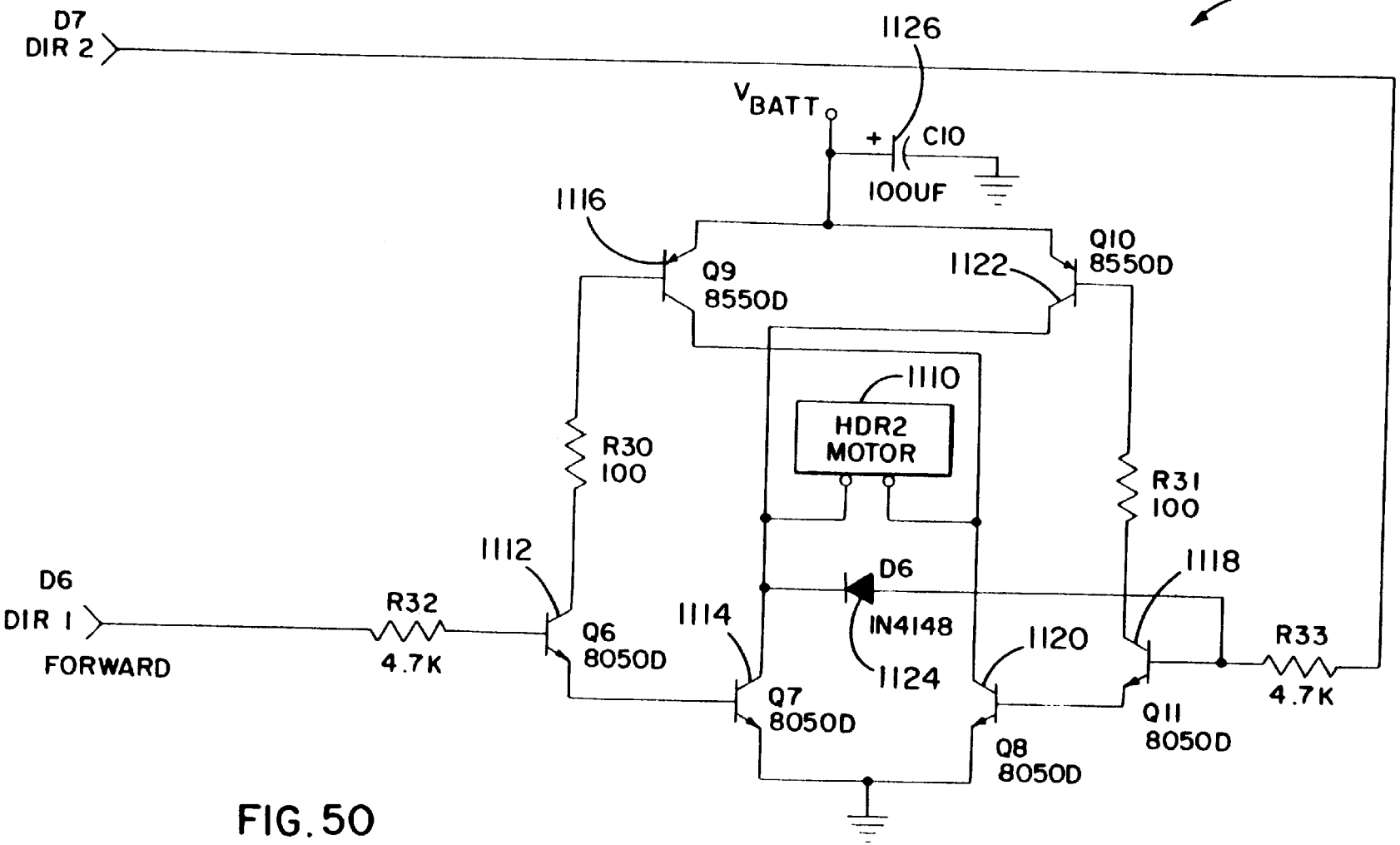
FIG. 50 is a H-bridge circuit for operating the motor in either forward or reverse directions.
Figure 51:
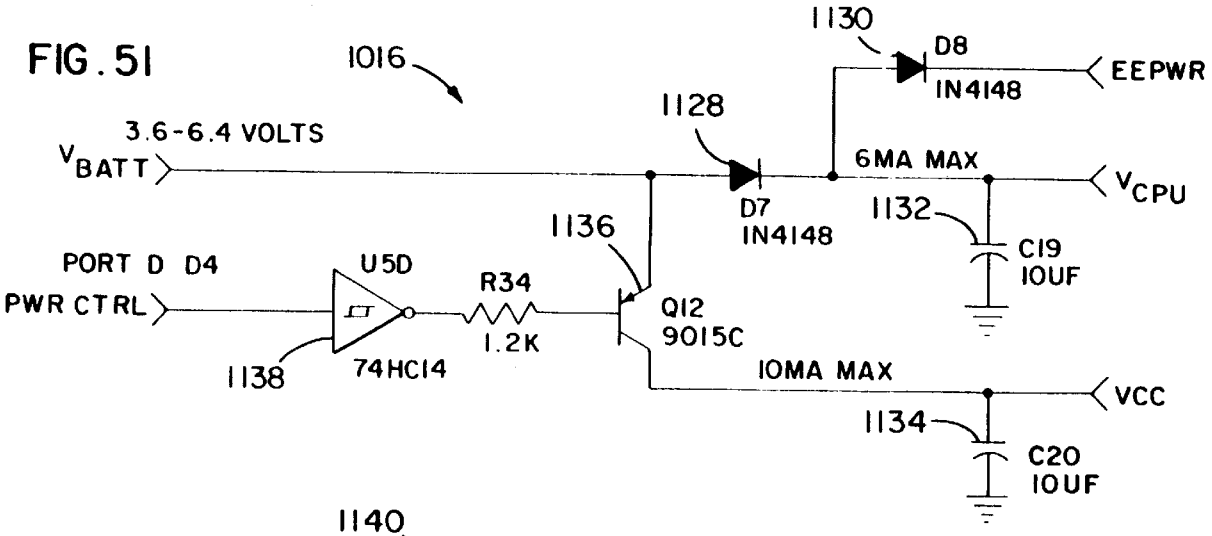
FIG. 51 is a schematic diagram of the power control circuitry for switching power to the functional section of the functional blocks identified in FIGS. 43 and 44.
Figure 52:
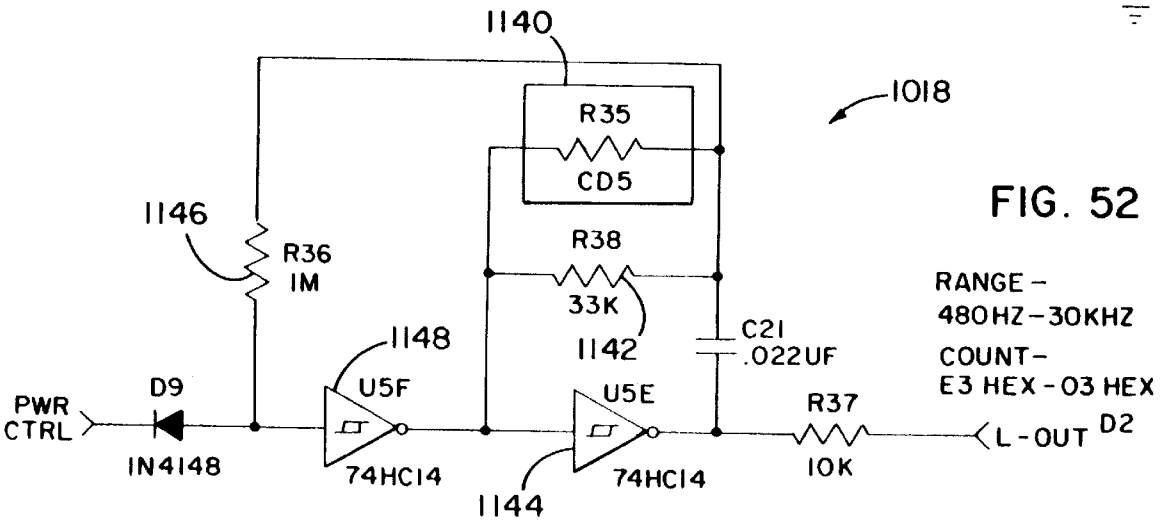
FIG. 52 is a schematic diagram of the light detection circuitry.

The information processor 1002 is designed to work with a co-processor described below, which is provided for speech and infrared communications capabilities. FIG. 45 shows a schematic diagram of the infrared (IR) transmission circuitry. FIG. 46 shows a schematic diagram of the co-processor and audible speech synthesis circuitry. As shown, an infrared (IR) transmission block 1004 provides circuitry under control of a speech processing block 1006 which is coupled to receive information from the processor 1002 via four (4) data lines D0–D3. FIG. 47 shows a schematic diagram of the IR signal filtering and receiving circuitry. An infrared receive circuit block 1008 is coupled to the information processor 1002 for receiving infrared signals from the transmit circuitry 1004 of another interactive toy device as described herein. FIG. 48 shows a schematic diagram of the sound detection circuitry. A sound detection block 1010 is used to allow the information processor 1002 to receive audible information as sensory inputs from the child which is interacting with the interactive plaything. FIG. 49 shows a schematic diagram of the optical servo control circuitry for controlling the operation of the motor 16. Optical control circuitry 1012 is used with the motor control circuitry 1014, discussed below, to provide an electronic motor control interface for controlling the position and direction of the electric motor 1100. FIG. 50 shows a H-bridge circuit for operating the motor in either forward or reverse directions. A power control block 1016 is used to regulate the battery power to the processor CPU, nonvolatile memory (EEPROM) and other functional components of the circuit 1000. FIG. 51 shows a schematic diagram of the power control 16 circuitry for switching power to the functional section of the functional blocks identified in FIGS. 43 and 44. Additionally, the power control block 1016 provides for switching of the power to various functional components through the use of control via the information processor 1002. FIG. 52 shows a schematic diagram of the light detection circuitry. A light detection block 1018 is provided for sensory input to the information processor 1002 through the use of a cadmium sulfide cell in an oscillator circuit for generating a varying oscillatory signal observed by the information processor 1002 as proportional to the amount of ambient light With reference to FIGS. 43 and 44, various other sensory inputs provide a plurality of sensory inputs coupled to the information processor 1002 allowing the interactive plaything to be responsive to its environment and sensory signals from the child. A tilt/invert sensor 1020 is provided to facilitate single pull double throw switching with a captured conductive metal ball 224 allowing the unswitched CPU voltage to be provided at either of two input ports indicating tilt and inversion of the plaything respectively, as discussed further below. Various other sensory inputs of the described embodiment are provided as push button switches, although pressure transducers and the like may also be provided for sensory input. A reset switch 1022 is connected to the reset pin of the processor 1002 for shorting a charged capacitance, herein 0.1 $\mu$F which is charged via a pull up resistor to provide the reset signal to the SunPlus processor 1002 for initializing operations of the processor in the software. A feed switch 1024 is provided as a momentary push button controlled by the tongue of the plaything, which is multiplexed with the audio ADC provided as a switch-select allowing the processor 1002 to multiplex the feed input with the inversion switch 1020. To this end, resistors 1026 and 1028 pull down the inputs to the tilt and feed/invert I/O ports of the processor 1002, but either the tilt/invert switch 1020 or the feed switch 1024 may be used to pull up an input to the processor 1002. Additional momentary switches are provided for the front and back sensors of the plaything respectively as push buttons 1032 and 1034. A motor calibration switch is provided as switch 1036.

Figure 53:
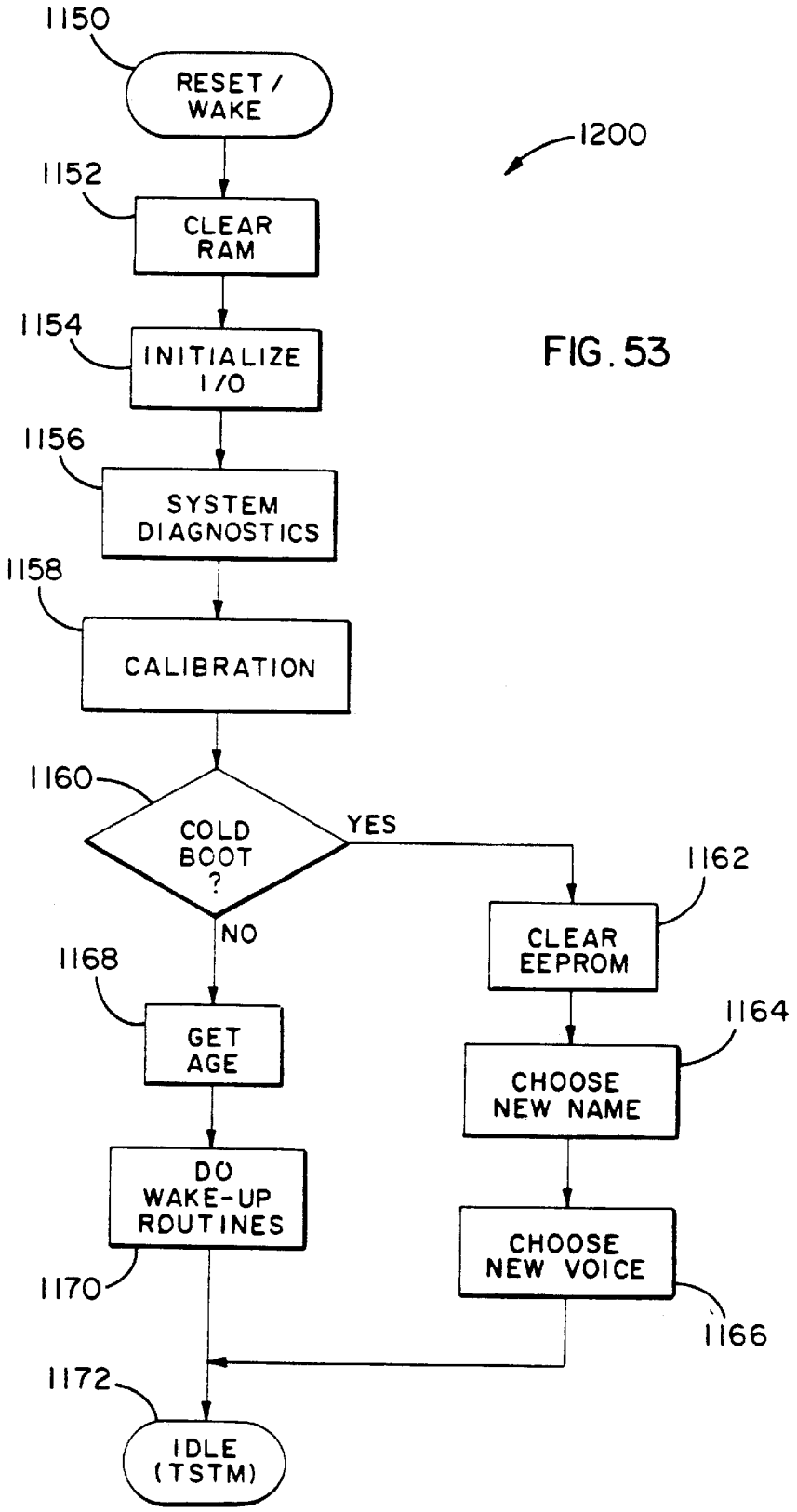
FIGS. 53 and 54 illustrate a program flow diagram for operating the embedded processor design embodiment of FIGS. 43 and 44 in accordance with the invention.
Figure 54:
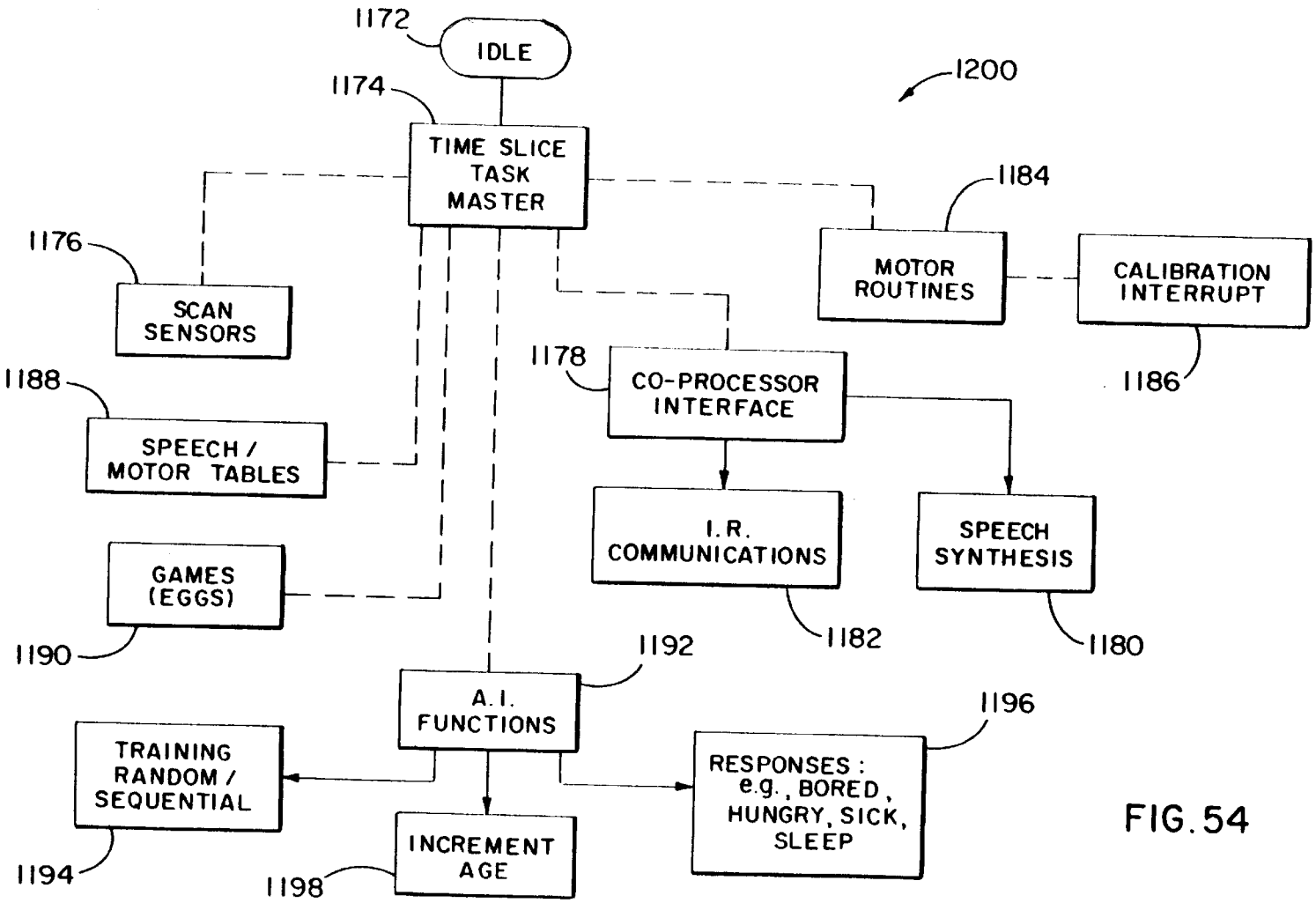

The interactive plaything as described includes the electric motor block 1014 which is coupled to at least one actuator linkage coupled for moving a plurality of movable members for kinetic interaction with the child in order to convey information about the operational status of the plaything to the child. As discussed, each of the movable members 12 is mechanically interconnected by at least one actuator linkage. The motor interface described below, an optical servo control 1012, is provided between the information processor 1002 and the motor control block 1014 for controlling the at least one actuator linkage with the information processor 1002. As described, the plurality of sensory inputs, i.e., switches 1020, 1024, 1032, 1034, and the audio, light, and infrared blocks, are coupled to the information processor 1002 for receiving corresponding sensory signals. A computer program discussed below in connection with FIGS. 53 and 54 illustrating a program flow diagram for operating the embedded processor design embodiment of FIGS. 43 and 44 facilitates processing of the sensory signals for operating the at least one actuator linkage responsive to the sensory signals from the child or the environment of the interactive plaything. Accordingly, a plurality of operational modes of the plaything is provided by the computer program with respect to the actuator linkage operation and corresponding sensory signal processing for controlling the at least one actuator linkage to generate kinetic interaction with the child with the plurality of movable members corresponding to each of the operational modes of the plaything which provides interactive rudimentary artificial intelligence for the interactive plaything. As discussed, the interactive plaything includes a doll-plush toy or the like having movable body parts 12 with one or more of the body parts of the doll being controlled by the plurality of movable members for interacting with the child in a life-like manner.

FIG. 45 shows the circuitry employed in the infrared transmission block 1004. The IR-TX output port of the information processor 1002 is capacitively coupled to a switching transistor 1044 having a voltage drop across its emitter base junction defined by a diode 1046. The data line from the port of the information processor 1002 is capacitively coupled via a capacitor 1048. An infrared LED, diode 1040, EL-1L7, is switched with transistor 1042 which is turned on with the switching transistor 1044 in order to minimize current draw from the data port of the information processor 1002. The infrared transmission with the LED 1040 is programmed using the information processor according to a pulse width modulated (PWM) signal protocol for communicating information from the information processor 1002. The infrared signals generated from the LED 1040 may be coupled to the infrared receive block 1008 described below, or to another device in communication with the information processor 1002. To this end, the infrared transmission block 1004 may be used for signal coupling to another computerized device, a personal computer, a computer network, the internet, or any other programmable computer interface.

FIG. 46 shows the speech block 1006 which employs a co-processor 1050, herein a Texas Instruments speech synthesis processor, TSP50C04, which incorporates a built-in microprocessor allowing music and sound effects as well as speech and system control functions. As discussed further below, the co-processor 1050 controls audio functions as well as the infrared transmission circuitry discussed above in connection with FIG. 45, allowing for co-processor control of infrared transmission such that the information processor 1002 works with its co-processor 1050 for infrared communications. The Texas Instruments TSP50C04 processor 1050 provides a high performance linear predictive coding (LPC) 12 bit synthesizer with an 8 bit microprocessor which is coupled via data lines D0–D3 with clear to send handshaking signal CTS to the information processor 1002. The interface between the speech synthesis processor, co-processor 1050, and the information processor 1002 is disclosed, e.g., in Texas Instruments U.S. Pat. No. 4,516,260 to Breedlove et al. for "Electronic Learning Aid or Game Having Synthesized Speech" issued May 7, 1985, which discloses an LPC speech synthesizer in communication with a microprocessor controller means for obtaining speech data from a memory using the control means to provide data to the LPC synthesizer circuit, as provided by the information processor 1002 and the co-processor 1050 herein. Additionally, the co-processor 1050 includes a digital to analog converter (DAC) capable of driving an audio speaker from the 10 bit DAC for voice or music reproduction. Thus, an audio speaker 1052 is provided as a 32 ohm speaker driven by the DAC output pins of the Texas Instruments processor 1050. Accordingly, the information processor 1002 programs in accordance with the program flow diagram discussed below, and communicates with the co-processor 1050 for generating LPC speech output at the speaker 1052.

The infrared receive block 1008 is detailed in FIG. 47 which includes circuitry for filtering, amplification, and signal level detection facilitating signal discrimination for use in infrared signal reception at the information processor via a port data pin, IR-RX, of the information processor 1002. The circuitry for infrared signal reception 1008 includes filtering circuitry 1054 indicated in dashed lines, which includes a transistor 1056 providing a high pass filtering (HPF) function for blocking 60 Hz and the 120 Hz harmonic to keep out ambient light to avoid false triggering of the infrared receive block 1008. Accordingly, the transistor 1056 may be turned on using a phototransistor 1058 herein WPTS310, in a circuit providing low gain at low frequencies and high gain at high frequencies to discriminate infrared transmissions from the infrared transmission block 1004 or the like. A gain stage is provided with an operational amplifier 1060, herein a LM324, in a non-inverting gain configuration with a 1 megohm and 10 K ohm resistor providing a gain of approximately 101 theoretical. The output of the gain stage from op amp 1060 introduces an amplified signal which is capacitively coupled to a comparator stage in which another op amp 1062, also provided as an LM324, which is configured as a comparator with a diode voltage drop across a diode 1064 between a voltage divider network provided between VCC and ground coupled to the inverting side of the op amp 1062 via a 100 K ohm resistor 1066. The non-inverting side of the op amp 1062, which provided in the open loop gain configuration provide a sufficiently large gain to provide a virtual ground at the non-inverting input, virtual ground (VG) 1068, the non-inverting put being capacitively coupled to ground effectively providing a zero voltage input to the comparator stage of the infrared receive block 1008. The comparator output of the op amp 1062 is provided as the data signal IR-RX, to the information processor 1002 for measurement of the incoming PWM infrared data signal. The signal received over the IR-RX port data input is also measured for voltage, frequency, and temperature shifts in order to allow the information processor 1002 to compensate for the co-processor variations of the co-processor 1050. Thus an inexpensive yet robust compensation scheme is provided between the processors for changes associated with voltage frequency and temperature or the like.

FIG. 48 is a schematic diagram of the circuitry employed in the sound detection block 1010. The sound detection circuitry employs a microphone 1070 coupled via a filtering stage and a one-shot circuit for detecting high frequency audible noises such as clapping or the like. The high frequency filtering (HPF) which is sensitive to abrupt sounds is provided with an op amp 1072, LM324, having resistive and capacitive feedback loop provided by a resistor 1074 and capacitor 1076 for high frequency filtering, the microphone 1070 being capacitively coupled by a capacitor 1078. The output of the HPF op amp 1072 is capacitively coupled with a capacitor 1080 to the one-shot stage described below. Additionally, a feedback resistor 1082 provides feedback to the non-inverting input to op amp 1072, which is also connected to virtual ground 1068, to set the sensitivity to the one-shot by varying the voltage presented to an op amp 1084 configured for one-shot monostable operation with a voltage drop provided across diode 1086 between the inverting and non-inverting inputs of the op amp 1084. A feedback resistor 1088 and capacitor 1090 are coupled to the non-inverting side of the op amp 1084 with a shunt resistor 1092 establishing a normal low output (SND) from the sound detection circuitry, which is coupled to the information processor 1002 for facilitating the sound detection.

The optical servo control circuitry 1012 is shown in FIG. 49 employing a slotted wheel optical obstruction 62 shown as a dashed box between the light transmission and reception portions of the circuitry described herein. A LED control signal is sent from the information processor 1002 to a buffered inverter 1044, inverter logic 74HC14 which has hysteresis and provides current buffering to minimize the current drain off the output data pins of the information processor 1002. The inverter 1044 drives a 1 K ohm resistor 1096 for current limiting an infrared LED 1098, an EL-1L7, which is powered from the battery voltage (VBATT) for generating an infrared light source for use with the slotted gear obstructions. A phototransistor 1100, ST-23G, is used as an infrared photo detector for generating a light pulse count signal coupled via a resistor 1102 to an inverter 1104 which is followed by a second buffered inverter 1106, also 74HC14, which provides the signal output through a resistor 1108. The hysteresis provided by inverters 1104 and 1106 facilitate an automatic resetting of the circuit to avoid needlessly using battery power, providing a normally low count output signal while the motor is at rest.

The motor control circuitry 1014 is shown in FIG. 50 which includes a H-bridge circuit for operating the motor 1110 in either of its forward or reverse directions. The motor 1110 is a Mabuchi motor Model No. SU-020RA-09170 having a three volt nominal operating voltage, drawing approximately 180 milliamps. The H-bridge circuit facilitates a first forward direction and a second reverse direction provided at data output pins D6 and D7 respectively of the information processor 1002. The first forward direction provides a signal to a switching transistor 1112 which turns on transistors 1114 and 1116 to draw current through the motor 1110 to power the motor with the VBATT voltage drawing current in a first current path through the motor 1110. The second reverse direction provides a signal to a switching transistor 1118 which turns on transistors 1120 and 1122 causing current to flow through the motor 1110 in a second direction in reverse to that of the first direction. A diode 1124 is provided between the base of transistor 1118 and the collector of transistor 1114 in order to prevent a condition in which both the forward and reverse directions are energized, which of course would be an erroneous state. Also shown in the control circuit 1014, the VBATT signal is filtered with a 100 $\mu$F capacitor, capacitor 1126, which filters the spurious signals generated by the switching of the motor 1110.

The power control block 1116 as shown in FIG. 51 is provided to present appropriate voltage levels to the memory, microprocessor, and various other control circuitry with a switched VCC potential. As shown, the battery voltage is provided as arranging between 3.6 to 6.4 volts which undergoes two diode voltage drops at diode 1128 and diode 1130 to present voltage to the electrically programmable read only memory (EEPROM) 1030 which provides a 1 kilobit non-volatile memory for data storage with a 93LC46 type EEROM which operates between 2.4 to 5.5 volts. The voltage to the CPU, VCPU, is current limited at approximately 6 milliamps and filtered with a capacitor 1132 to ensure proper recreation of the microprocessor and logic circuitry. The power control output of the information processor 1002 is buffered and inverted with a logical inverter 1138 also provided as a 74HC14 which drives a switching transistor 1136 to switch the VCC voltage, provided as being current limited to 10 milliamps and filtered with a capacitor 1134. Accordingly, the EEPWR and the CPU are provided with unswitched filtered voltage levels, while the VCC is switched to provide for cut off of power to various portions of the circuitry for minimizing current draw on the batteries and extending the life of the batteries.

The light detection circuitry 1018 shown in FIG. 52 is also controlled with the power control data output of the information processor 1002 which turns on an oscillator circuit which incorporates a cadmium sulfide, CdS LDR, photoconductive cell provided as a resistive element in a feedback loop along with a resistor 1142 provided in parallel to an inverter 1144, a 74HC14, which oscillates in the range of 480 Hz to 330 kHz used to generate a count relative to the illumination impinging on the photoconductive cell 1140. A feedback resistor 1146 and an inverter 1148 are provided to control the operation of the oscillator output L-OUT. The light detection output provides a count to the information processor 1002, in the range of E3 to 03 hexadecimal. The cadmium sulfide cell 1140 in the feedback loop of the oscillator circuit provides the oscillating signal as being proportional to the visible light. The cadmium sulfide cell 1140 is provided in the embodiment as Kondo Electric Model No. KE10720 and provides a sintering film fabrication by which the photoconductive layer provides a highly sensitive variable resistance. Accordingly, the light detection circuitry 1018 facilitates sensory input of the relative ambient light available for processing with the information processor 1002.

The software associated with the above-described light detector circuitry 1018 provides a response much as that of the human eye by obtaining average light readings of the oscillatory output to make a determination of the ambient light of the surrounding environment. Upon initial power up a short sample is obtained to define an ambient light reading of the oscillatory output, and upon further operation, a ten second moving average is then provided as an average sample of the output of the light detection circuitry 1018. The moving average is used to determine if the light level is changing relative to, e.g., a lighter or darker ambient light environment. A timer is also set in software such that complete covering of the cell 1140 causes a speech output from the synthesizer co-processor 1050 announcing that it is dark. The ten second moving average thereby provides an intelligent response from the cell 1140 such that when it is uncovered and allowed to be exposed to visible light, a response is not provided by the plaything 10 but rather the ambient light reading updates according to the ten second moving average software protocol. Thus, a change from a dark state back to a previous ambient light state does not invoke a vocal response. Additionally, the moving average as implemented in software and as described herein provides an extended dynamic range for the overall spectrum from light to dark determination of the environment. This allows the light detector circuit 1018 to operate over a wide range of ambient light environments.

FIGS. 53 and 54 illustrate the program flow diagram of the software included in the microfiche appendix to the application, which provides for the operating of the embedded processor circuitry of FIGS. 43 and 44 described above. The program flow diagram 1200 at step 1150 the embedded processor circuitry 1000 is reset or a wake signal is detected from the invert sensor 1020, at which point the software clears the RAM on the information processor 1002 at step 1152. Program flow proceeds with an initialization of the I/O data ports of the embedded processor circuitry at step 1154. System diagnostics are executed at step 1156 and calibration of the system is provided at step 1158. The initialization, diagnostics, and calibration routines are executed prior to the normal run mode of the circuitry 1000. At initialization the preset motor speed assumes a mid-battery life, setting the pulse width such that the motor will not be running at its maximum six volts which make damage to the motor. The information processor 1002 then determines the appropriate pulse width which should be provided for the corresponding battery voltage.

The wake up routines continue at step 1160 which determines whether the program 1200 is executing a cold boot, i.e., the first time upon which the circuit 1000 is powered up, and if decision step 1160 determines that this is a cold boot, special initialization of the system is executed at this time. At step 1162, the non-volatile EEPROM 1030, 93LC46, is cleared and a new name is chosen from a look up table which contains 24 different names for the interactive plaything. Additionally, upon a cold boot, step 1166 allows the plaything to choose its voice with the information processor which is also provided for in software using a voice table as a look up table which selects the voice upon initialization. Where it is determined that the cold boot has previously been executed and that decision step 1160 indicates the program is presently not undergoing a cold boot, step 1168 determines the age of the plaything which is provided with at least four different age levels in the program 1200. Step 1170 then continues with the wake up routines and the program 1200 is placed in its idle state at step 1172 which provides for a Time Slice Task Master (TSTM) which allows for polling of the various I/O ports and sensory inputs while the program 1200 is idle.

FIG. 54 illustrates the Time Slice Task Master which facilitates a number of software functions for the interactive plaything. The sensors are polled at a scanned sensor step 1176 which is periodically checked by the TSTM 1174. Motor and speech tables are provided through a routine at step 1188 which provides for a number of levels of hierarchal cables which are used to patch together words in the case of programming of the speech synthesizer, or complex motor movement functions in the case of motor operation via the motor tables. In patching words and sounds together, a "say" table may be employed in which the table provides for a series of data bytes which are used to pronounce particular sounds or words. For instance, the first byte of the say table would include the speed of the speech, in which changing speed would result in changing the pitch of the speech generated. A second byte from the say table may be used to set the pitch without changing the speed to provide for voice inflections and the like. The bytes following would include the voice data used in vocalizing the sounds with the LPC speech synthesizer. The table ends with a end of table notation, herein "FF" hexadecimal. Similarly, motor cables would include data bytes, e.g., wherein the first byte would define a speed for the motor being proportional to the data entry and a second byte may be employed for pausing the motor a "0" hexadecimal entry. The data bytes following would define the motor movement and an end of table character "FF" hexadecimal is again employed. Accordingly, the motor tables are used to patch predetermined motor movements together. A second level of speech and motor tables are also defined by macro tables providing a second level of motor and speech programming in which several complex operations may be joined together as a macro routine. An additional third level table is provided as a sensor table coupled to the macro tables providing, e.g., responses to sensor detection. The tables are defined in an include file which is included in the microfiche appendix to the application. The programming with speech and motor tables facilitates the use of cost effective hardware in combination with the program 1200 to facilitate complex speech and motor operations with the inactive plaything allowing it to provide appropriate verbal responses and mechanical operation allowing the child an overall play activity with rudimentary artificial intelligence and language learning, as discussed herein.

A number of games and other routines using speech and motor functions are defined as routines provided at step 1190. A number of these games are referred to herein as eggs or "Easter eggs" which are complete activities undertaken by the interactive plaything which includes singing songs, burping, playing hide and seek, playing simon, and the like. For instance, when the toy is inverted to wake it from its sleeping state, it responds in a rooster song, saying "cock-a-doodle-doo" and going through a routine with its eyes and ears to wake up. A single bit per game or egg scenario is assigned, and each time a sensor is triggered, the program increments the counter and tests all game routines for a match. If a particular sentence does not match, then its disqualified bit is set and the routine moves on to determine whether other scenarios should be triggered by the child's manipulation of the sensors. If at any time all bits are set, then the counter is cleared to zero and the program starts counting over again. When a table associated with the scenario receives an end of table indication "FF" then the egg or game scenario is executed. In the described embodiment there are 24 possible egg routines. Each time a sensor is triggered, the system timer is reset. A sensor timer is reset with a global timekeeping variable. This timer is also used for the random sequential selection of sensor responses. If the timer goes to zero before the egg routine is complete, i.e., the plaything having not been played with within the defined time period, then all disqualified bits are cleared and counters are cleared. Other criteria based on the plaything's life as stored in memory may affect the ability to play games. For instance, if the plaything is indicated as being sick, either by having received a signal from another plaything to enter the sick condition, then no game would be played.

As discussed herein, the motor of the interactive toy is constantly being exercised and calibrated, at step 1184. The TSTM 1174 runs a number of motor routines facilitating the operation of the motor via the motor tables. Periodically, e.g., when the motor is in the neutral position, the calibration interrupt is received from step 1186 which causes a frequent recalibration of the motor.

At step 1178, the Texas Instruments co-processor is interfaced via a co-processor interface allowing for the operation of the speech synthesizer via the information processor 1002, as discussed above. Speech synthesis according to the LPC routines is performed at step 1180. Additionally, the co-processor 1050 facilitates infrared (IR) communications at step 1182 allowing for communications between interactive toys as discussed herein.

Various artificial intelligence (AI) functions are provided via step 1192. Sensor training is provided at step 1194 in which training between the random and sequential weightings defines a random sequential split before behavior modification of the interactive toy, allowing the child to provide reinforcement of desirable activities and responses. In connection with the AI functions, step 1196 is used for appropriate responses to particular activities or conditions, e.g., bored, hungry, sick, sleep. Such predefined conditions have programmed responses which are undertaken by the interactive toy at appropriate times in its operative states. Additionally, as discussed, the interactive toy maintains its age (1–4) in a non-volatile memory 1030, and step 1198 is used to increment the age where appropriate.

Accordingly, summarizing the wide range of life-like functions and activities the compact and cost-effective toy 10 herein can perform to entertain and provide intelligent seeming interaction with a child, the following is a description of the various abilities the preferred toy 10 has and some of the specifics in terms of how these functions can be implemented. The toy plaything 10 is provided with the computer program 1200 which enables it to speak a unique language concocted exclusively for the toy plaything herein, such as from a combination of Japanese, Thai, Mandarin, Chinese and Hebrew. This unique "Furbish" language is common to all other such toy playthings. When it first greets the child, the toy plaything will be speaking its own unique language. To help the child understand what the toy plaything is saying, the child can use the dictionary (Appendix A) that comes with the toy plaything 10.

The toy plaything 10 responds to being held, petted, and tickled. The child can pet the toy plaything's tummy, rub its back, rock it, and play with it, e.g., via sensory input buttons 1032 and 1034. Whenever the child does these things, the toy plaything will speak and make sounds using the speech synthesizer of the co-processor 1050. It will be easy for the child to learn and understand Furbish. For example, when the toy plaything wakes up, it will often say "Da a-loh u-tye" which means "Big light up." This is how the toy plaything says "Good Morning!" Eventually, the toy plaything will be able to speak a native language in addition to its own unique language. Examples of native languages the toy 10 may be programmed with include English, Spanish, Italian, French, German and Japanese. The more you play with the toy plaything, the more it will use a native language.

The toy plaything 10 goes through four stages of development. The first stage is when the child first meets the toy plaything. The toy plaything is playful and wants to get to know the child. The toy plaything also helps the child learn how to care for it. The second and third stages of development are transition stages when the toy plaything begins to be able to speak in a native language. The fourth stage is the toy plaything's mature stage when it speaks in the native language more often but will also use its own unique language. By this time the child and toy plaything will know each other very well. The toy plaything is programmed to want the child to play with it and care for it.

At various times the toy plaything 10 is programmed to require certain kinds of attention from the child. Just like a child, the toy plaything is very good at letting people know when it needs something. If the toy plaything is hungry, it will have to be fed. Since it can talk, the child will have to listen to hear when the toy plaything tells the child it wants food. If the toy plaything says "Kah a-tay" (I'm Hungry), it will open its mouth so the child can feed it as by depressing its tongue. The toy plaything will say "Yum Yum" so the child will know that it is eating. As the child feeds the toy plaything, it might say "koh-koh" which means that it wants more to eat. If the child does not feed the toy plaything when it gets hungry, it will not want to play anymore until it is fed. When the toy plaything is hungry, it will usually want to eat 6 to 10 times. When the child feeds the toy plaything, he should give it 6 to 10 feedings so that it will say "Yum Yum" 6 to 10 times. Then the toy plaything will be full and ready to play.

If the child does not feed the toy plaything it is programmed to begin to get sick, e.g., step 1196. The toy plaything 10 will tell the child that it is sick by saying "Kah boo koo-doh" (I'm not healthy). If the child allows the toy plaything to get sick, soon it will not want to play and will not respond to anything but feeding. Also, if the toy plaything gets sick, it will need to be fed a minimum of 10–15 times before it will begin to get well again. After the toy plaything has been fed 10–15 times it will begin to feel better, but to nurse it back to complete health, the child will have to play with it. Just like a child, when the toy plaything feels better it laughs, giggles, and is happier. The child will know when its better because the toy plaything will say "Kah noo-loo" (Me happy) and will want to play games.

When the toy plaything is tired it will go to sleep. It will also tell the child when it is tired and wants to go to sleep. The toy plaything is usually quiet when it sleeps, but sometimes it snores. When it is asleep, it will close its eyes and lean forward. Sometimes the child can get the toy plaything to go to sleep by petting it gently on its back for a while. If the child pets the toy plaything between 10 and 20 times, it will hum "Twinkle, Twinkle" and then go to sleep. The child can also get the toy plaything to go to sleep by putting it in a dark room or covering its eyes for 10–15 seconds.

If the child does not play with the toy plaything for a while, it will take a nap until the child is ready to play again. When the child is ready to play with the toy plaything, he will have to wake the toy plaything up. When the toy plaything is asleep and the child wants to wake it up, he can pick it up and gently tilt it side to side until it wakes causing the tilt/invert sensor 1020 to resume from the low power mode. Sometimes, the toy plaything may not want to wake up and will try and go back to sleep after it is picked up. This is okay and the child just has to tilt the toy plaything side to side until it wakes up.

There are many ways to play with the toy plaything. The child and toy plaything can make up their own games or play some of the games and routines discussed herein which the toy plaything 10 is already programmed to use, e.g. the eggs 1190. One game is like "Simon Says". During this game the toy plaything will tell the child what activities to do and then the child has to repeat them. For example, the toy plaything may say, "Pet, tickle, light, sound." The child has to pet the toy plaything's back, tickle its tummy, cover its eyes, and clap his own hands. As the child does each of these, the toy plaything will say something special to let the child know that he has done the right action. The special messages are: for TICKLE the toy plaything will giggle; for PET, it will purr; for LIGHT, it will say "No Light"; and for SOUND, it will say "Big Sound". When the child hears the toy plaything say these things, he will know that he has done the right action. The first game pattern will have four actions to repeat. Then if the child does the pattern correctly, the toy plaything will reward the child by saying, "whoopiee!", or by even doing a little dance. The toy plaything then will add one more action to the pattern. If the child does not do the pattern correctly, the toy plaything will say "Nah Nah Nah Nah Nah Nah!" and the child will have to start again with a new pattern.

To play, the toy plaything says, "Tickle my tummy", "Pet my back", "Clap your hands", or "Cover my eyes". When the child wants to play this game it is important that he waits for the toy plaything to stop moving and speaking after each action before doing the next action. Therefore, to get the toy plaything to play, after the child tickles it, he should wait for it to stop moving before petting the toy plaything's back. Then after the child pets the toy plaything's back, he should wait until it stops moving before the child claps his hands.

If the child does the pattern correctly and gets the toy plaything to play the game, the toy plaything will say its name and "Listen me" so the child will know it is ready to play. If the child wants to play the game and follows the pattern and the toy plaything does not say its name and then "Listen me", the toy plaything is not paying attention to the child. The child will then have to get the toy plaything's attention by simply picking the toy plaything up and gently rocking it side to side once or twice. The child should then try again to play.

Once the toy plaything is ready to play, it will begin to tell the child which pattern to repeat. The toy plaything can make patterns up to 16 actions. If the child masters one pattern, the toy plaything will make up another new pattern so the child can play again and again. To end the game, pick up the toy plaything and turn it upside down. The toy plaything will then say "Me done" so the child will know to stop playing.

In another game the toy plaything can answer questions and tell the child secrets. To play, the child initiates the game by performing the following pattern of instructions on the toy plaything: "Cover my eyes", "Uncover my eyes", "Cover my eyes", "Uncover my eyes", and "Rub my back". The toy plaything will then say "Ooh too mah" to let the child know it is ready. The child may then ask the toy plaything a question. Once the question is asked, rub the toy plaything's back to get it to answer. If the child does not ask the toy plaything a question within 20 seconds, the toy plaything will think the child does not want to play and say "Me done". The child will then have to get the toy plaything to play again by repeating the pattern. When the child wants to play this game, it is important that he wait for the toy plaything to stop moving and speaking after each action before doing the next action. Therefore, to get the toy plaything to play, after the child covers the toy plaything's eyes, he should wait for the toy plaything to stop moving before petting its back. If the child wants to play the game and follows the pattern, but the toy plaything does not say "Ooh too mah", then the toy plaything is not paying attention to the child. The child will then have to get the toy plaything's attention by simply picking the toy plaything up and gently rocking it side to side once or twice. The child should then try again to play. It is best to wait 3 to 5 seconds before doing each step in the game start pattern to make sure the toy plaything knows the child wants to play the game. To end this game, pick up the toy plaything and turn it upside down. The toy plaything will then say "Me done" so the child will know to stop playing.

Another game the toy plaything can play is HIDE AND SEEK. The toy plaything will start to make little noises to help the child find the toy plaything. To play, the child initiates the game by performing the following pattern of instructions on the toy plaything: "Cover my eyes", "Uncover my eyes", "Cover my eyes", "Uncover my eyes", "Cover my eyes", "Uncover my eyes", "Cover my eyes", "Uncover my eyes". The toy plaything will then say its name and then "Hide me" to let the child know it is ready to hide. The child will have one minute to hide the toy plaything. Once the toy plaything has been hidden, it will wait for three minutes to be found. If the child does not find the toy plaything within three minutes, the toy plaything will say, "Nah Nah Nah" three times. If the child wants to play the game and follows the pattern, but the toy plaything does not say its name and then "Hide me", the toy plaything is not paying attention to the child. The child will then have to get the toy plaything's attention by simply picking the toy plaything up and gently rocking it side to side once or twice. The child should then try again to play. When playing this game it is important that the child wait for the toy plaything to stop moving and speaking after each action before doing the next action. Therefore, to get the toy plaything to play after the child covers its light sensor, the child should wait for the plaything to stop moving before covering the toy plaything's eyes again. It is best to wait 3 to 5 seconds before doing each item in the game start pattern to make sure the toy plaything knows the child wants to play the game. The toy plaything will make small noises occasionally in order to help the child find the toy plaything. When the child finds the toy plaything and picks it up, the toy plaything will do a little dance to show that it is happy. To end this game, pick up the toy plaything and turn it upside down. The toy plaything will then say "Me done" so the child will know to stop playing.

One of the other activities the toy plaything likes to do is dance. The child can make the toy plaything dance by clapping his hands 4 times. The toy plaything will then dance. The child can get the toy plaything to dance again by clapping his hands one more time or by playing some music. It is best to wait 3 to 5 seconds between clapping each time to make sure the toy playthings knows the child wants it to dance. The toy plaything dances best on hard, flat surfaces. It can dance on other surfaces, but prefers wood, tile, or linoleum floors.

The child can teach the toy plaything to do tricks. While the child is playing with the toy plaything, he might tickle its tummy. The toy plaything may then do something the child likes, for example, give a kiss. As soon as the toy plaything gives a kiss, the child should pet its back 2 times. This tells the toy plaything that the child likes it when the toy plaything gives a kiss. The child should wait for the toy plaything to stop moving each time he pets the toy plaything's back before petting it again. Then the child should tickle the toy playthings's tummy again. The toy plaything may then or not give another kiss, depending how it feels at the time. If the toy plaything gives a kiss, the child should then pet the toy plaything's back again two times, remembering to always wait for it to stop moving each time before petting it again. If the toy plaything does not give a kiss, its tummy should be tickled again until it gives the child a kiss. The child should then pet the toy plaything's back two times. Then every time the toy plaything gives a kiss when the child tickles its tummy, the child should pet the toy plaything's back two times. Soon, every time the toy plaything's back is tickled it will give a kiss. If the child always pets the toy plaything's back when it kisses, it will always remember to give kisses when its tummy is tickled. If the child forgets to pet the toy plaything's back, it may forget to give a kiss when its tummy is tickled.

The example above is for an activity that the toy plaything does when its tummy is tickled. The same thing can be done for other activities the child would like the toy plaything to do if he covers the toy plaything's eyes, makes a big sound, picks up and rocks the toy plaything, or turns it upside-down. The important thing is that the child tell the toy plaything to repeat the action by petting its back 2 times after the toy plaything does it the first time, and then 2 times after every other time.

If the child wants to change what the toy plaything does, he can pet the toy plaything's back after another activity and it will begin to replace the original trick. Therefore, if the toy plaything was taught to give a kiss when its eyes were covered but the child wanted it to make a raspberry sound instead, the child should pet the toy plaything's back 2 times after the raspberry sound is made when the eyes are covered.

Toy playthings love to talk to each other. A conversation between two or more playthings can be started by placing them so that they can see each other and then tickle the toy plaything's tummy or pet its back. If the toy playthings do not start talking, try again. Toy playthings can also dance with each other by starting one of them dancing.

The toy playthings have to be in the line of sight of each other in order to communicate. Place the toy playthings facing each other and within 4 feet of each other. Toy playthings can communicate with more than one toy plaything at a time. In fact, any toy plaything placed so that it can see another toy plaything will enable communication between them. To start a conversation, tickle the toy plaything's tummy or pet its back.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

APPENDIX A

FURBISH TO ENGLISH [+ POSSIBLE PHRASES]

ay-ay = Look/See
When the light gets brighter he may say. "Hey Kah/ay-ay/u-nye." [Hey, I see you.]
ah-may = Pet
To you he might say "ah-may/koh koh" [Pet me more!]
a-loh = Light
Furby may say "Dah/a-loh/u-tye" [Big light up] [Good morning.]
a-loh/may-lah = Cloud
a-tay = Hungry/Eat
And at lunch time "Kah/a-tay" [I'm hungry]
boh-bay = Worried
If he gets jarred he may say. "Kah-dah/boh-bay." [I'm scared]
boo = No
If you cover Furby's eyes. Furby might say "hey/kah/Boo/ayay/u-nye" [Hey, I don't see you]
dah = Big
When he has really had a good time "Dah/doo-ay" [Big fun]
doo? = What?/Question?
"a-loh/doo?" [where is the light?]
doo-ay = Fun
If Furby really likes something he might say "dah/doo-ay/wah!" [Big fun!]
doo-moh = [Please feed me]
When Furby is hungry he might ask you to "Doo-moh/a-tay" [Please feed me]
e-day = Good
e-tah = Yes
kah = Me
When Furby is happy you might hear "kah/may-may/u-nye" [I love you]
koh-koh = Again
koo-doh = Heath
If Furby has a tummy ache he might say "Kah/boo/Koo-doh" [I'm not healthy]
Lee-Koo = Sound
At a sudden noise he might say "Dah/lee-koo/wah!" [Loud sound!]
loo-loo = Joke
When you turn him upside down he might say "Hey/boo/loo-loo" [Hey. No jokes]
may-may = Love
When Furby REALLY likes you he will say "Kah/may-may/u-nye" [I love you]
may-lah = Hug
or "Doo-moh/may-lah/kah" [Please hug me]
may-tah = Kiss
Furby may ask for a kiss by saying "May-tah/kah" [Kiss me]
mee-mee = Very
At lunch time you might hear "Kah/mee-mee/a-tay" [I'm very hungry]
Nah-Bah = Down
In the evening "Dah/a-loh/nah-bah" [Sun down (Good night)]
nee-tye = Tickle
If Furby is bored he might ask you to "Nee-tye/kah" [Tickle me]
noh-lah = Dance
It's party time! "Dah/noh-lah" [Big dance]
noo-loo - Happy
When Furby is with his friends you might hear him say "Kah/mee mee/noo-loo/wah!" [I'm very happy!]
o-kay = OK
toh-dye = Done
toh-loo - Like
If Furby is flirting he may say "Kah/toh-loo/may-tah" [I see you]
u-nye = You
Or playing hide and seek "Kah/ay-ay/u-nye" [I see you]
u-tye = Up
And when he thinks it's time to get up "Dah/a-loh/u-tye" [Sun up(Good Morning)]

-continued

APPENDIX A wah! = Yea!/exclamation!
When he is very hungry. "Hey/kah/mee-mee/ay-tay/wah!" [Hey, I'm very hungry!]
way-loh = Sleep
If you wake Furby up and he is still tired. "Yawn/Kah/way-loh/koh-koh." [I'm sleeping more]
wee-tee = Sing
At bedtime Furby might say: "Wee-tee/kah/way-loh" [Sing me to sleep]

ENGLISH TO FURBISH

| | |
|---|---|
| Again/More = | koh-koh |
| Ask = | oh-too-mah |
| Big = | dah |
| Boogie/Dance = | noh-lah |
| Cloud = | a-loh/may-lah |
| Done = | toh-dye |
| Down = | Nah-bah |
| Fun = | doo-ay |
| Good = | e-day |
| Happy = | noo-loo |
| Health = | koo-doh |
| Hide = | Who-bye |
| Hug = | may-lah |
| Hungry = | a-tay |
| Joke = | loo-loo |
| Kiss = | may-tah |
| Light = | a-loh |
| Like = | toh-loo |
| Listen = | ay-ay/lee-koo |
| Love = | may may |
| Maybe = | may-bee |
| Me = | kah |
| No = | boo |
| OK = | o-kay |
| Pet = | ah-may |
| Please = | doo-moh |
| Scared = | dah/boh-bay |
| See = | ay-ay |
| Sing = | wee-tee |
| Sleep = | way-loh |
| Sound = | lee-koo |
| Sun = | dah/a-loh |
| Tickle = | nee-tye |
| Up = | u-tye |
| Very = | mee mee |
| Where? = | doo? |
| Worry = | boh-bay |
| Yeah! = | wah! |
| Yes = | e-tah |
| You = | u-nye |

FURBISH TO ENGLISH PHRASES

| | |
|---|---|
| Kah/toh-loo/may-tay = | Me like kisses |
| Wee-tee/kah/way loh = | Sing me to sleep |
| Kah/boo/ay-ay/u-nye = | I can't see you |
| Kah/a-tay = | I'm hungry |
| Kah/toh-loo/moh-lah/wah! = | I like to dance! |
| E-day/doo-ay/wah! = | I like this! |
| Kah/mee-mee/a-tay = | I very hungry |
| Nee-tye/kah = | Tickle me |
| Boo/koo-doh/e-day = | Don't feel good |
| o-too-mah = | Ask |

What is claimed is:

1. A method of operating one or more interactive playthings, comprising the steps of:

providing an electric motor with a plurality of movable members coupled to an actuator linkage for interaction with a child for conveying information about the operational status of the plaything to the child;

providing a speech synthesizer for audio interaction with the child;

processing information for controlling the motor and the speech synthesizer;

generating sensory inputs for information processing;

operating in one of a plurality of operating modes in response to the processed information and the sensory inputs to modify the operation of the movable members and the audio interaction;

providing an infrared communication link as a sensory input for information processing; and causing a plurality of the interactive playthings to communicate with one another via the infrared communication link.

2. A method as recited in claim 1 comprising the step of providing a doll having movable body parts with one or more of the body parts of the doll being controlled by the movable members for interacting with the child in a life-like manner.

3. A method as recited in claim 2 wherein said generating step facilitates a voice response provided by the speech synthesizer to visual and auditory sensory inputs created in the environment of the interactive plaything.

4. A method as recited in claim 3 wherein said information processing step provides rudimentary artificial intelligence impacting on the verbal response, language learning, motor operation, and overall operating modes of the interactive plaything to provide life-like and intelligent interactions.

5. A method as recited in claim 3 wherein said information processing step coordinates movements of the plurality of movable members to provide the toy with differing operational states including sleeping, waking, and excited states with the speech synthesizer generating words that complement the different states such as snoring and various exclamations.

6. A method as recited in claim 1 wherein the information processing step provides a unique language with the speech synthesizer for audio interaction with the child.

7. A method as recited in claim 6 wherein the information processing step modifies the unique language generated with the speech synthesizer for subsequent audio interaction with the child.

* * * * *